US008624822B2

(12) United States Patent
Uehara et al.

(10) Patent No.: US 8,624,822 B2
(45) Date of Patent: Jan. 7, 2014

(54) LIGHT SOURCE APPARATUS, DISPLAY APPARATUS, TERMINAL APPARATUS, AND CONTROL METHOD THEREOF

(75) Inventors: Shin-ichi Uehara, Tokyo (JP); Masao Imai, Tokyo (JP)

(73) Assignee: NLT Technologies, Ltd., Kanagawa (JP)

( * ) Notice: Subject to any disclaimer, the term of this patent is extended or adjusted under 35 U.S.C. 154(b) by 648 days.

(21) Appl. No.: 11/681,703

(22) Filed: Mar. 2, 2007

(65) Prior Publication Data

US 2007/0211013 A1 Sep. 13, 2007

(30) Foreign Application Priority Data

Mar. 3, 2006 (JP) ..... 2006-058721
Mar. 1, 2007 (JP) ..... 2007-052113

(51) Int. Cl.
*G09G 3/36* (2006.01)

(52) U.S. Cl.
USPC ..... 345/102

(58) Field of Classification Search
USPC ..... 345/102, 204; 353/122; 348/625
See application file for complete search history.

(56) References Cited

U.S. PATENT DOCUMENTS

| | | | | |
|---|---|---|---|---|
| 6,069,676 | A | 5/2000 | Yuyama | |
| 6,144,359 | A * | 11/2000 | Grave | 345/102 |
| 6,340,994 | B1 * | 1/2002 | Margulis et al. | 348/625 |
| 7,053,880 | B2 * | 5/2006 | Lim et al. | 345/102 |
| 2006/0044290 | A1 * | 3/2006 | Hurwitz et al. | 345/204 |
| 2007/0035707 | A1 * | 2/2007 | Margulis | 353/122 |

FOREIGN PATENT DOCUMENTS

| | | | |
|---|---|---|---|
| CN | 1650673 | A | 8/2005 |
| CN | 1702512 | A | 11/2005 |
| JP | 10-49074 | A | 2/1998 |
| JP | 2002-533870 | A | 10/2002 |
| JP | 2004-193029 | A | 7/2004 |
| JP | 2004-361618 | A | 12/2004 |
| JP | 2005-302737 | A | 10/2005 |
| JP | 2006-058058 | A | 3/2006 |
| WO | 00/37904 | A1 | 6/2000 |

OTHER PUBLICATIONS

Ki-Chan Lee et al., "Distinguished Contributed Paper: Integrated Amorphous Silicon Color Sensor on LCD Panel for LED Backlight Feedback Control System", Technology Development Group, LCD Development Center, LCD Business, Samsung Electronics, SID Digest, 2005, pp. 1376-1379.

* cited by examiner

*Primary Examiner* — Quan-Zhen Wang
*Assistant Examiner* — Tony Davis
(74) *Attorney, Agent, or Firm* — Sughrue Mion, PLLC

(57) ABSTRACT

A light source apparatus has two or more light sources that have different light-emission spectra and that can be controlled independently, and also has light sensors for detecting the quantity of light emitted by the light sources. The light sensors are composed of one type of light sensor that is not provided with a color filter for selecting the wavelength of received light, and the light sensors are sensitive to wavelength ranges that are sufficiently broad to simultaneously receive light in red, green, and blue wavelength ranges. A control circuit controls the two or more light sources to emit light in a time sequential fashion, and compares reference data with the output values of the light sensors to control the quantity of light emitted by the light sources by means of a light source drive circuit. It is thereby possible to reduce the cost and size of a light source apparatus that is capable of correcting changes in hue.

17 Claims, 38 Drawing Sheets

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
TRANSMITTANCE

TIME
t1
t2
t3
t4

INTENSITY

TIME
INTENSITY

TIME
INTENSITY

TIME
INTENSITY

TIME
INTENSITY

TIME
INTENSITY

TIME
INTENSITY

TIME
INTENSITY

TIME
INTENSITY

TIME
INTENSITY

TIME
INTENSITY

TIME
INTENSITY

TIME
LIGHT SENSOR OUTPUT t1 t2 t3 t4 t5 t6 t7 t8 t9 t10 t11 t12 t13 TIME

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
TEMPERATURE SENSOR OUTPUT

TIME
t1
t2
t3
t4

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
RED LIGHT SENSOR OUTPUT

TIME
WHITE LIGHT SENSOR OUTPUT

TIME
t1
t2
t3

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1 t2 t3 t4 t5 t6

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t0
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
TRANSMITTANCE

TIME
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT FOR LIGHT SOURCE

TIME
LIGHT SENSOR OUTPUT FOR EXTERNAL LIDGT

TIME
t0
t1
t2
t3
t4
t5

ELECTRIC CURRENT

TIME
ELECTRIC CURRENT

TIME
ELECTRIC CURRENT

TIME
INTENSITY

TIME
INTENSITY

TIME
INTENSITY

TIME
LIGHT SENSOR OUTPUT

TIME
t1
t2
t3
t4

ELECTRIC CURRENT

TIME
ELECTRIC CURRENT

TIME
ELECTRIC CURRENT

TIME
INTENSITY

TIME
INTENSITY

TIME
INTENSITY

TIME
HAZE

TIME
LIGHT SENSOR OUTPUT

TIME
t1
t2
t3
t4

FIRST LINE LIGHT SENSOR OUTPUT

TIME
SECOND LINE LIGHT SENSOR OUTPUT

TIME
THIRD LINE LIGHT SENSOR OUTPUT t0
t1
t2
TIME

LIGHT SOURCE APPARATUS, DISPLAY APPARATUS, TERMINAL APPARATUS, AND CONTROL METHOD THEREOF

BACKGROUND OF THE INVENTION

1. Field of the Invention

The present invention relates to a light source apparatus capable of correcting changes in hue, to a display apparatus provided with this light source apparatus and capable of correcting the hue of a display, to a terminal apparatus equipped with this display apparatus, and to a method for controlling these apparatuses.

2. Description of the Related Art

Because of their thin profile, light weight, small size, low energy consumption, and other advantages, display apparatuses that use liquid crystals have been widely deployed and used in a range of devices that includes monitors, televisions (TV: Television), and other large terminal apparatuses; notebook-type personal computers, cash dispensers, vending machines, and other mid-sized terminal apparatuses; and personal TVs, PDAs (Personal Digital Assistance: personal information terminal), mobile telephones, mobile gaming devices, and other small terminal apparatuses. Since the liquid crystal molecules themselves are non-self-emitting molecules that do not emit light on their own, some kind of light source is needed in order for the display to be perceived. Liquid crystal display apparatuses can be generally classified as transmissive, reflective, or transflective (using transmitted light and reflected light jointly) according to the type of light source used. Energy consumption can be reduced in the reflective type, since it can utilize external light in the display apparatus and there is no need to provide the display apparatus with a light source, but contrast and other aspects of display performance are inferior compared to the transmissive type. Therefore, transmissive and transflective liquid crystal display apparatuses are currently in the mainstream. In transmissive and transflective liquid crystal display apparatuses, a light source apparatus is installed on the back surface of a liquid crystal panel, and a display is created using the light emitted by the light source apparatus. Specifically, a light source apparatus that is separate from the liquid crystal panel is essential in current mainstream liquid crystal display apparatuses.

The display performance of terminal apparatuses has been improved with recent technological advances, and while these apparatuses have previously only been capable of monochromatic characters, they have recently become capable of displaying color image information of higher definition. In a liquid crystal panel capable of displaying color, each of the pixels is configured from red, green, and blue sub-pixels, and the sub-pixels of these three colors have color filters corresponding to the respective colors. Multicolor displays are formed by controlling the combination of the transmittances of these sub-pixels. Specifically, current mainstream liquid crystal panels have color filters as constituent elements, and the color reproduction areas on a chromaticity diagram are substantially established according to the spectroscopic characteristics of the color filters and to the spectrum of light emitted from the aforementioned light source apparatus. In general, the spectroscopic characteristics of the color filters and the matching of the light source spectra are vital to enlarging the color reproduction areas and displaying bright primary colors. Specifically, the spectroscopic characteristics of each color in the color filters are designed so that the respective transparent wavelengths do not overlap, and the light source spectra are set so that the emitted light has peaks in each of the red, green, and blue wavelength ranges.

Light-emitting diode (LED) technology in particular has recently been rapidly developing, and LEDs have therefore been used as light sources in the display apparatuses of not only portable terminal apparatuses, but also of larger terminal apparatuses. Particularly, LEDs corresponding to the three light colors red, green, and blue are used as light sources, whereby sharper emitted light peaks for the three primary colors can be preserved in the light source spectrum, making it possible to enlarge the color reproduction areas and to achieve a brighter display. However, a technique for achieving balance among the colors is vital in cases in which red-green-blue LEDs or other multicolor LEDs are used as light sources. In cases in which this balance is disrupted for any reason, the hues of the light sources change, and the hue of the display therefore also changes. In view of this, a technique for achieving this color balance, i.e., a method for detecting and controlling the state of the colored light-emitting elements has been proposed.

FIG. 1 is a schematic structural view showing the first conventional liquid crystal display apparatus equipped with a light source control device and described in JP-A 2004-361618. As shown in FIG. 1, the first conventional liquid crystal display apparatus 1001 equipped with a light source control device is composed of a liquid crystal panel 1002, a liquid crystal driver 1006 for driving the liquid crystal panel 1002, a display control circuit 1007 for supplying a signal to the liquid crystal driver 1006, a backlight 1003 disposed on the reverse side of the liquid crystal panel 1002 as seen from the viewing side, a backlight control circuit 1005 for controlling the backlight, and a light detector 1004 disposed on the viewing side of the liquid crystal panel 1002.

The liquid crystal panel 1002 has a liquid crystal display unit 1002*a*, which is a display area for displaying information; and a large number of pixels are disposed in the liquid crystal display unit 1002*a*. These pixels are arranged so that each set of three pixels includes a red, green, and blue pixel in order to achieve a color display. The pixels of these three colors are obtained by forming color filters of each color on a substrate, which is a constituent element of the liquid crystal panel 1002.

Furthermore, a detection pixel 1002*b* that does not function as a display is formed on part of the periphery of the liquid crystal display unit 1002*a* of the liquid crystal panel 1002. This detection pixel 1002*b* is composed of three detection pixels, for the colors red, green, and blue. The detection pixels for the three colors are obtained by forming color filters of each color on a substrate, in the same manner as the display pixels of the liquid crystal panel 1002. Specifically, the pixels in the liquid crystal display unit 1002*a* and the detection pixel 1002*b* are formed under the same conditions as when the liquid crystal panel 1002 is manufactured, and therefore have the same characteristics. Accordingly, the state of the detection pixel 1002*b* is a reflection of the state of the pixels of the liquid crystal display unit 1002*a*.

The backlight 1003 functions as a light source for the liquid crystal panel 1002, and the backlight has as constituent elements a red light-emitting diode, a green light-emitting diode, and a blue light-emitting diode. The liquid crystal panel 1002 is illuminated with white light that is a mixture of these three colors. Furthermore, these three light-emitting diodes are connected to the backlight control circuit 1005, and are configured so that the emission intensities of the three colors are controlled individually. Specifically, the backlight 1003 is configured so that light from the red, green, and blue light-emitting diodes is mixed and white light is emitted, and since color changes are corrected in the liquid crystal panel 1002, which uses the white light as a light source, the backlight control circuit 1005 can adjust the emitting intensities of the light-emitting diodes of each color.

The light detector 1004 is configured from three light detectors that correspond to the red, green, and blue detection pixels 1002*b*. The output from these light detectors 1004 is inputted to the backlight control circuit 1005.

In the first conventional liquid crystal display apparatus equipped with a light source control device and described in JP-A 2004-361618 and that is configured in this manner, the light detector 1004 detects the intensities of each color via the red, green, and blue detection pixels 1002*b*. The pixels are formed on the liquid crystal panel 1002 and have the same conditions as the pixels of the liquid crystal display unit 1002*a*. The result is inputted to the backlight control circuit 1005. The backlight control circuit 1005 operates so as to differentiate the inputted results, and in cases in which it is determined that the color balance is disrupted and the desired chromaticity has been lost, the backlight control circuit adjusts the light intensity of the light-emitting diode of the corresponding color of the backlight 1003 and maintains a specific chromaticity. In one example, the emission intensity of the red light-emitting diode of the backlight 1003 is adjusted to maintain the desired chromaticity in cases in which a deviation from the desired value is detected in the intensity of red light. This detection is based on a signal from the red light detector 1004 disposed facing the detection pixel 1002*b* for red light. The same applies to green and blue light. The states of the light-emitting diodes for each color are thereby controlled so that the hue of the display does not change even in cases in which a plurality of light-emitting diodes that emit light in different colors is used. Since the color filter characteristics and liquid crystal characteristics of the liquid crystal panel 1002 are also taken into account to control the states of the light-emitting diodes of each color, these effects can be prevented and chromaticity can always be stably maintained even in cases in which the color filters change over time.

FIG. 2 is a schematic structural diagram showing a second conventional display apparatus equipped with a light source control device and described in SID 05 Digest p. 1376-1379. As shown in FIG. 2, the second conventional display apparatus 2001 equipped with a light source control device is composed of a liquid crystal display panel 2002; a backlight 2003 disposed on the reverse side of the liquid crystal display panel 2002 as seen from the viewing side; a light-emitting diode drive circuit module 2005 for driving the light-emitting diodes that are the constituent elements of the backlight; a light-emitting diode control module 2006 for controlling the light-emitting diode drive circuit module 2005; a light sensor module 2007 for outputting the states of the light-emitting diodes to the light-emitting diode control module 2006; and red, green, and blue light sensors 2004 connected to the light sensor module 2007 and assembled on the liquid crystal display panel 2002.

The backlight 2003 functions as a light source for the liquid crystal display panel 2002. This backlight has a red light-emitting diode, a green light-emitting diode, and a blue light-emitting diode as constituent elements, and the liquid crystal display panel 2002 is illuminated with white light that is a mixture of these three colors.

The light sensor 2004 is a photodiode formed from a non-crystalline silicon layer used as a semiconductor layer of a thin-film transistor that constitutes the pixels of the liquid crystal display panel 2002. The light sensor is formed on parts (e.g., upper and lower regions) of the liquid crystal display panel 2002 that lie outside the display area. Since the light sensor 2004 detects the three color red, green, and blue individually, color filters equivalent to the color filters of the pixels are set into the irradiated side of the light sensor 2004.

In the second conventional display apparatus equipped with a light source control device and described in SID 05 Digest p. 1376-1379 and that is configured in this manner, the light sensor 2004 detects the intensities of red, green, and blue light; the results are inputted to the light sensor module 2007 to determine the balance of the colors; the light-emitting diode control module 2006 controls the light-emitting diode drive circuit module 2005 on the basis of these results; and the light-emitting diodes for each color constituting the backlight 2003 are driven. It is thereby possible to inhibit occurrences in which the balance of the colors is disrupted and the desired chromaticity is lost, and changes in hue caused by changes in temperature and temporal changes can be reduced in particular. Therefore, the hue can always be stably maintained. In the present conventional example, since the light sensor is formed as an integral part of the liquid crystal display panel, there is no need to provide a separate light sensor outside of the liquid crystal display panel, the device can be reduced in size, and costs can be lowered.

However, the above-described conventional display apparatuses equipped with a light source control device are subject to the following problems. Specifically, in the first conventional display apparatus equipped with a light source control device, a minimum of three light detectors or light sensors are needed for the colors red, green, and blue, and it is therefore difficult to reduce the size of the detectors and controllers, and it is also difficult to lower costs.

In the second conventional display apparatus equipped with a light source control device, the light sensor is formed integrally with the liquid crystal display panel. It is therefore easier to reduce size and lower costs than with the first conventional display apparatus, which is equipped with a light source control device and in which the light detector was provided separately from the liquid crystal display panel. However, three light sensors are needed for the colors red, green, and blue in the second light source control device. A greater number of connections with the light sensor module is therefore provided to the exterior of the liquid crystal display panel. Not only is it difficult to reduce size owing to these connections, but reliability is also reduced, and it is difficult to lower costs. Furthermore, since three light sensors correspond to the colors red, green, and blue, separate wavelength filters are needed and it is difficult to lower costs any further.

SUMMARY OF THE INVENTION

An object present invention is to provide a light source apparatus capable of correcting changes in hue, whereby costs can be lowered and the light source apparatus can be reduced in size; to provide a display apparatus equipped with this light source apparatus and capable of correcting the hue of a display; to provide a terminal apparatus equipped with this display apparatus; and to provide a method for controlling these apparatuses.

The light source apparatus according to the present invention comprises two or more light sources that have different light-emission spectra and that can be controlled independently, light detectors for detecting the quantity of light emitted by the light sources, and a controller for driving and controlling the light sources by using results obtained by the light detectors, wherein the controller controls the two or more light sources to emit light in a time sequential fashion, and controls the quantity of light emitted by the light sources on the basis of a chronological output produced by the light detectors in accordance with the time sequential emission of light.

In the present invention, the hue of light emitted by the light source apparatus can be maintained in a specific state because the light sources can be maintained in a specific state even if temperature changes, temporal changes, or other such factors cause the state of the light sources to change. The light source apparatus can also be made smaller and less expensive because there are fewer different types of detectors. Furthermore, it is possible to reduce discomfort experienced by the viewer as a result of the fact that the light sources emit light of all colors in a time sequential fashion. This is because the light sources are calibrated separately for each color so that the brightness of the light source apparatus during calibration can be reduced to less than the brightness in an application in which light of all colors is emitted simultaneously.

It is also preferable that the light detectors be composed of only one type. Fewer types and a smaller number of detectors can thereby be used, and the light source apparatus can be made smaller and less expensive. Reducing the number of detectors makes it possible to reduce the number of connections with a control circuit. Therefore, less space is needed for wiring, and size can be reduced.

Furthermore, the controller may retain data as a reference for the output values of the light detectors, and may compare this reference data with the output values of the light detectors to control the quantity of light from the light sources. The state of the light sources can thereby be easily detected by comparing output with this reference data.

Furthermore, the control can be configured so as to store sets of reference data that are equal to or greater in number than the different types of light sources. Corrections that correspond to a greater variety of conditions can thereby be made.

Furthermore, a plurality of light sources of the same type can be used as the two or more light sources. Furthermore, the controller may control the two or more light sources so that the light sources of the same type simultaneously emit light in a time sequential fashion, and the controller may also control the quantity of light emitted by the light sources on the basis of a chronological output produced by the detectors in accordance with the time sequential emission of light. Fluctuations due to temperature changes are thereby made to have the same tendencies with the same hues, and the time needed for correction can thereby be reduced.

With the two or more light sources, the light sources constituting the same type of light source can be adjusted independently. These light sources may be controlled to emit light in a time sequential fashion, and the quantity of light emitted by the light sources may be controlled on the basis of a chronological output produced by the detectors in accordance with the time sequential emission of light. It is thereby possible in particular to precisely correct the initial characteristic nonuniformities and temporal changes of each of the light sources.

Furthermore, it is preferable that the light sources and the light detectors be disposed so as to allow for the most possible combinations in which the distances between the light sources and the light detectors are equal. Costs can be lowered further because the reference data stored by the controller can thereby be shared, and fewer sets of reference data are stored.

Furthermore, the light detectors may be composed of a single light sensor. The number of light sensors can thereby be reduced, and the number of connections between the light sensor and the control circuit can also be reduced. Therefore, less space is needed for wiring, size can be reduced, and costs can be lowered.

The light detectors may also be composed of a plurality of light sensors, and the light sensors may be disposed in accordance with the light sources. It is thereby possible to make precise corrections, even to characteristic nonuniformities in the light sources.

Furthermore, it is preferable that 16 milliseconds be the time period for controlling the emission of light by the two or more light sources in a time sequential fashion. It is thereby possible to greatly reduce calibration-induced discomfort experienced by the user, because the user can no longer be aware of time sequential emission of light.

Furthermore, it is preferable that, compared with a regular display application, the quantity of light be less during the time in which the two or more light sources are controlled to emit light in a time sequential fashion. The brightness of the display screen during calibration can thereby be further reduced, and it is possible to further reduce discomfort experienced by the user due to the fact that the light sources emit light of each color in a time sequential fashion.

The quantity of light during the time in which the two or more light sources are controlled to emit light in a time sequential fashion may also be equal to the quantity of light during a regular display application. The effects of noise generated by the detectors can thereby be reduced, and corrections can be made more precise.

Furthermore, the quantity of light emitted by the light sources may be controlled when the light source apparatus is brought into active mode from standby mode. The light sources can thereby be calibrated before the light source apparatus is lighted, which enables the light source apparatus to be used in a suitable state when lighted.

Furthermore, the operation for controlling the quantity of light emitted by the light sources may be performed a plurality of times. A plurality of calibrations allows for more accurate control, and hue can therefore be corrected with greater precision.

Furthermore, it is preferable that the light source apparatus comprise a temperature detector that outputs detection results to the controller, and that the controller use the detection results of the temperature sensor to control the quantity of light emitted by the light sources. The light-emitting elements can thereby be maintained in a specific state, and the hue of the light emitted by the light source apparatus can be maintained in a specific state even when the temperature suddenly changes while the device is being used.

The controller may also retain data as a reference for the output values of the temperature detector, and may compare this reference data with the output values of the temperature detector to determine whether to start the operation for controlling the quantity of light emitted by the light sources. A control circuit can retain output reference data for the temperature detector, whereby the temperature state can be easily detected from the comparisons with the reference data.

Furthermore, the temperature detector is preferably disposed in proximity to the light sources. Fluctuations in the light sources caused by changes in temperature can thereby be easily detected.

Furthermore, light-emitting diodes can be appropriately used as the light sources. The light source apparatus can thereby be made smaller and thinner.

Furthermore, the light-emitting diodes may be composed of three light-emitting elements, which are red, green, and blue. This allows for a brighter display having a broader chromaticity range in combination with a transmissive display panel.

In the light source apparatus of the present invention, the light detectors can have a light-receiving wavelength range that corresponds to at least two or more light-emitting wavelength ranges of the light sources. The light detectors can thereby be made to correspond to two or more light sources and used together with a detection method based on controlling the time sequential emission of light by the light sources, whereby fewer light detectors than light sources can be used, costs can be lowered, and size can be reduced.

The time period in which the time sequential emission of light by the light sources is used to detect and control the quantity of light emitted by the light sources may be separate from the time period in which the emission of light by the light sources is used as illumination means. The detection method based on controlling the time sequential emission of light by the light sources can also be applied to a display apparatus in which the light sources are not constantly emitting light in a time sequential fashion.

Furthermore, the time period in which the two or more light sources simultaneously emit light may be included within the time period for detecting and controlling the quantity of light emitted by the light sources. The quantity of light emitted by the light sources is thereby reduced in the time period for detecting and controlling the quantity of light emitted by the light sources, whereby the user can be prevented from experiencing discomfort.

Furthermore, a constant time cycle may be formed by the time period for detecting and controlling the quantity of light emitted by the light sources, and by the time period in which the light emitted by the light sources is used as illumination means. It is thereby made less likely that the user will be aware that the apparatus is in a time period in which the state of the light sources is detected and controlled, and the state of the light sources can be periodically detected and controlled, which allows for greater precision.

Furthermore, a time period for reducing the light quantity of the light sources may be included between the time period for detecting and controlling the quantity of light emitted by the light sources, and the time period in which the light emitted by the light sources is used as illumination means.

Furthermore, means may be provided for detecting external light, and detection results obtained by the means may be used to control the quantity of light emitted by the light sources. Control that corresponds to the surrounding environment can thereby be performed, adjustments can be made so that the brightness of the screen is improved in bright surroundings to achieve a clearer display, and the brightness of the screen can be reduced in dark surroundings so that the user is not affected by glare. Furthermore, the hue of external light can be reflected and the display screen can be given a yellow hue in bright yellowish surroundings, thereby resolving the issue of a viewer seeing the display screen as bluish-white after adapting to yellowish surroundings.

The display apparatus according to the present invention comprises the previously described light source apparatus and a transmissive display panel for transmitting light emitted from the light source apparatus and thereby adding an image to the light.

It is preferable that the transmittance of the transmissive display panel be reduced when the quantity of light emitted by the light source apparatus is controlled.

Discomfort experienced by the user during calibration can thereby be greatly reduced because the user can no longer perceive light when the light sources are lighted and colors are emitted in a time sequential fashion during calibration. Furthermore, the effects of external light can be greatly reduced because the transmittance of the display panel during calibration is low. Particularly, it is possible to eliminate the effects of light that has passed through the display area of the display panel from the viewer's side, entered a light guide plate, and propagated through the light guide plate.

Furthermore, the transmittance may be reduced by displaying a black color on the transmissive display panel.

Furthermore, the transmissive display panel is preferably in a normally black mode having low transmittance when the power source is off. It is thereby possible to eliminate the effects of external light and to perform the correction operation on the light sources even when the transmissive liquid crystal display panel is in standby mode.

Furthermore, when the light source apparatus and the transmissive display panel are brought from standby mode into active mode, the transmissive display panel may be brought into active mode after the operation of controlling the quantity of light emitted by the light sources is complete. The light sources can thereby be calibrated before the display apparatus is used, and the display apparatus can therefore be used in a suitable state when the light sources are lighted.

Furthermore, the light detectors can be formed from an amorphous silicon layer used as a semiconductor layer of a thin-film transistor that constitutes the pixels of the transmissive liquid crystal display panel. The need to provide additional light sources outside of the display panel can thereby be eliminated, and size can be reduced while costs can be lowered.

Furthermore, the light detectors are preferably disposed in the non-display area of the transmissive display panel. The effects of external light on the light sensors can thereby be reduced, and detection precision can be improved.

Furthermore, the transmissive display panel may be a liquid crystal panel, and a liquid crystal panel in either transverse electric field mode or homeotropic alignment mode can be appropriately used.

Furthermore, the liquid crystal panel may be a liquid crystal panel in field sequential mode.

Furthermore, a polarization plate used in the liquid crystal panel is preferably disposed so as to cover the light detectors. The effects of external light on the light sensors can thereby be reduced, and detection precision can be improved.

The display apparatus of the present invention may comprise the previously described light source apparatus and a transmissive display panel for transmitting light emitted from the light source apparatus and thereby adding an image to the light, wherein the time cycle formed by the time period for detecting and controlling the quantity of light emitted by the light sources, and by the time period for using the light emitted from the light sources as illumination means may be correlated with the refresh rate of the transmissive display panel. The video image display performance of the display apparatus can thereby be improved. Furthermore, since the operations for detecting and correcting the light source state can be repeated in short time cycles, not only it is less likely that the user will perceive the operations for detecting and correcting the light source state, but high quality display can also be achieved because control can be performed at high speeds.

Furthermore, in this display apparatus, the display panel is a display panel in field sequential mode.

The terminal apparatus according to the present invention comprises the previously described display apparatus.

The terminal apparatus may, e.g., be a portable phone, a personal information terminal, a game console, a digital camera, a video camera, a video player, a notebook personal computer, a cash dispenser, or a vending machine.

Furthermore, the operation for controlling the quantity of light emitted by the light sources may be performed when the terminal apparatus is brought from standby mode into active mode. The light sources can thereby be calibrated before the terminal apparatus is used, and the terminal apparatus can therefore be used in a suitable state when the light sources are lighted.

Furthermore, the operation for controlling the quantity of light emitted by the light sources may be performed when the display contents of the terminal apparatus are changed. It is thereby possible to correct characteristic fluctuations caused by heat generated by the light sources, and to prevent discomfort experienced by the user during calibration.

Furthermore, the terminal apparatus may have a folding structure, and the operation for controlling the quantity of light emitted by the light sources may be performed when the device is opened from a closed state. The light sources can thereby be calibrated before the terminal apparatus is used, and the terminal apparatus can therefore be used in a suitable state when the light sources are lighted.

Furthermore, it is preferable that the device have a structure wherein part of the casing of the terminal apparatus is disposed on the light detectors, and external light is blocked by this part of the casing. The effects of external light on the light sensors can thereby be further reduced, and detection precision can be further improved.

In the control method for a light source apparatus according to the present invention, the light source apparatus comprises two or more light sources that have different light-emission spectra and that can be controlled independently, light detectors for detecting the quantity of light emitted by the light sources, and a controller for driving and controlling the light sources by using results obtained by the light detectors, wherein the controller controls the two or more light sources to emit light in a time sequential fashion, and controls the quantity of light emitted by the light sources on the basis of a chronological output produced by the light detectors in accordance with the time sequential emission of light.

In the control method for a light source apparatus according to the present invention, the light source apparatus comprises two or more light sources that have different light-emission spectra and that can be controlled independently, light detectors for detecting the quantity of light emitted by the light sources, a temperature detector for detecting the temperature, and a controller for driving and controlling the light sources by using results obtained by the light detectors and the temperature detector, wherein the controller controls the two or more light sources to emit light in a time sequential fashion, and controls the quantity of light emitted by the light sources on the basis of a chronological output produced by the light detectors in accordance with the time sequential emission of light.

In the control method for a display apparatus according to the present invention, the display apparatus comprises two or more light sources that have different light-emission spectra and that can be controlled independently, light detectors for detecting the quantity of light emitted by the light sources, a controller for driving and controlling the light sources by using results obtained by the light detectors, and a transmissive display panel for transmitting light emitted from the two or more light sources and thereby adding an image to the light, wherein the controller controls the two or more light sources to emit light in a time sequential fashion, and controls the quantity of light emitted by the light sources on the basis of a chronological output produced by the light detectors in accordance with the time sequential emission of light; and wherein the transmittance of the transmissive display panel is reduced during the time sequential emission of light.

In the control method for a display apparatus according to the present invention, the display apparatus comprises two or more light sources that have different light-emission spectra and that can be controlled independently, light detectors for detecting the quantity of light emitted by the light sources, a controller for driving and controlling the light sources by using results obtained by the light detectors, and a transmissive display panel for transmitting light emitted from the two or more light sources and thereby adding an image to the light, wherein the controller controls the two or more light sources to emit light in a time sequential fashion, the time period for controlling the quantity of light emitted by the light sources, and the time period for using the light emitted from the light sources as illumination means are separated on the basis of a chronological output produced by the light detectors in accordance with the time sequential emission of light, and the two time periods form a constant time cycle and have a correlation with the refresh rate of the transmissive display panel.

In the control method for a terminal apparatus according to the present invention, the terminal apparatus comprises two or more light sources that have different light-emission spectra and that can be controlled independently, light detectors for detecting the quantity of light emitted by the light sources, a controller for driving and controlling the light sources by using results obtained by the light detectors, and a transmissive display panel for transmitting light emitted from the two or more light sources and thereby adding an image to the light, wherein the controller controls the two or more light sources to emit light in a time sequential fashion, and controls the quantity of light emitted by the light sources on the basis of a chronological output produced by the light detectors in accordance with the time sequential emission of light when the terminal apparatus is brought from standby mode into active mode.

In the control method for a terminal apparatus according to the present invention, the terminal apparatus comprises two or more light sources that have different light-emission spectra and that can be controlled independently, light detectors for detecting the quantity of light emitted by the light sources, a controller for driving and controlling the light sources by using results obtained by the light detectors, and a transmissive display panel for transmitting light emitted from the two or more light sources and thereby adding an image to the light, wherein the controller controls the two or more light sources to emit light in a time sequential fashion, and controls the quantity of light emitted by the light sources on the basis of a chronological output produced by the light detectors in accordance with the time sequential emission of light when the display contents of the terminal apparatus are changed.

In the control method for a terminal apparatus according to the present invention, the terminal apparatus comprises a shape with a folding structure and comprises two or more light sources that have different light-emission spectra and that can be controlled independently, light detectors for detecting the quantity of light emitted by the light sources, a controller for driving and controlling the light sources by using results obtained by the light detectors, and a transmissive display panel for transmitting light emitted from the two or more light sources and thereby adding an image to the light, wherein the controller controls the two or more light sources to emit light in a time sequential fashion, and controls the quantity of light emitted by the light sources on the basis of a chronological output produced by the light detectors in accordance with the time sequential emission of light when the terminal apparatus is opened after being folded shut.

In the control method for a terminal apparatus according to the present invention, the terminal apparatus comprises two or more light sources that have different light-emission spectra and that can be controlled independently, light detectors for detecting the quantity of light emitted by the light sources, a controller for driving and controlling the light sources by using results obtained by the light detectors, and a transmissive display panel for transmitting light emitted from the two or more light sources and thereby adding an image to the light, wherein the time period for using the light emitted from the light sources as illumination means is separated from the time period in which the controller controls the two or more light sources to emit light in a time sequential fashion and controls the quantity of light emitted by the light sources on the basis of a chronological output produced by the light detectors in accordance with the time sequential emission of light; the time period for detecting and controlling the quantity of light emitted by the light sources is started by an external signal inputted to the controller; an instruction is sent to the controller in accordance with the external signal when the display in the terminal apparatus changes, and a time period for detecting and controlling the quantity of light emitted by the light sources is created based on this instruction.

According to the present invention, a light source apparatus capable of correcting changes in hue can be made smaller and less expensive.

DESCRIPTION OF THE PREFERRED EMBODIMENTS

Figure 1:
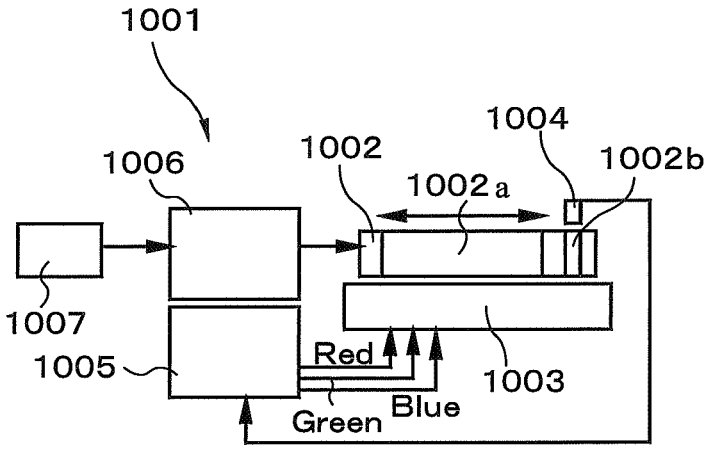
FIG. 1 (PRIOR ART)
FIG. 1 is a schematic structural diagram showing a first conventional liquid crystal display apparatus equipped with a light source control device disclosed in Patent Document 1.
Figure 2:
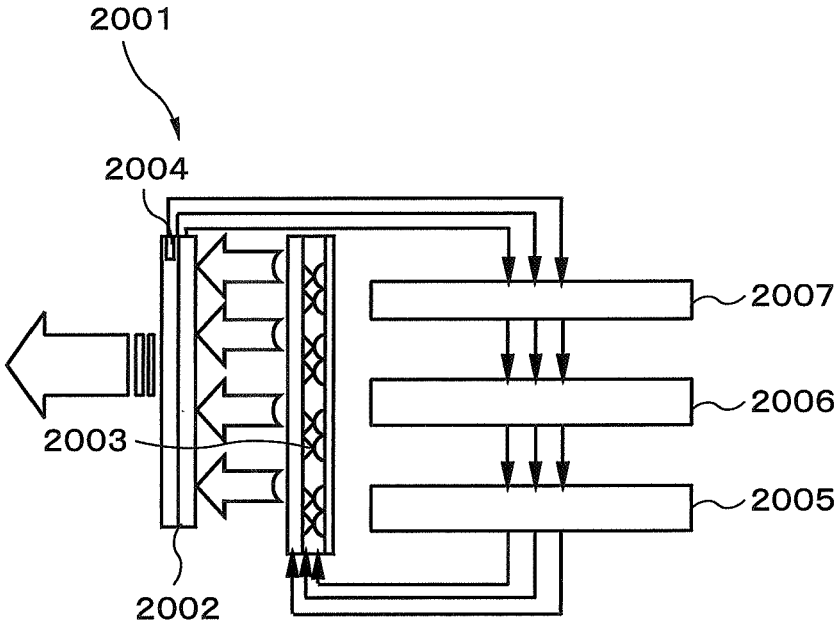
FIG. 2 (PRIOR ART)
FIG. 2 is a schematic structural diagram showing a second conventional liquid crystal display apparatus equipped with a light source control device disclosed in Non-patent Document 1.
Figure 3:
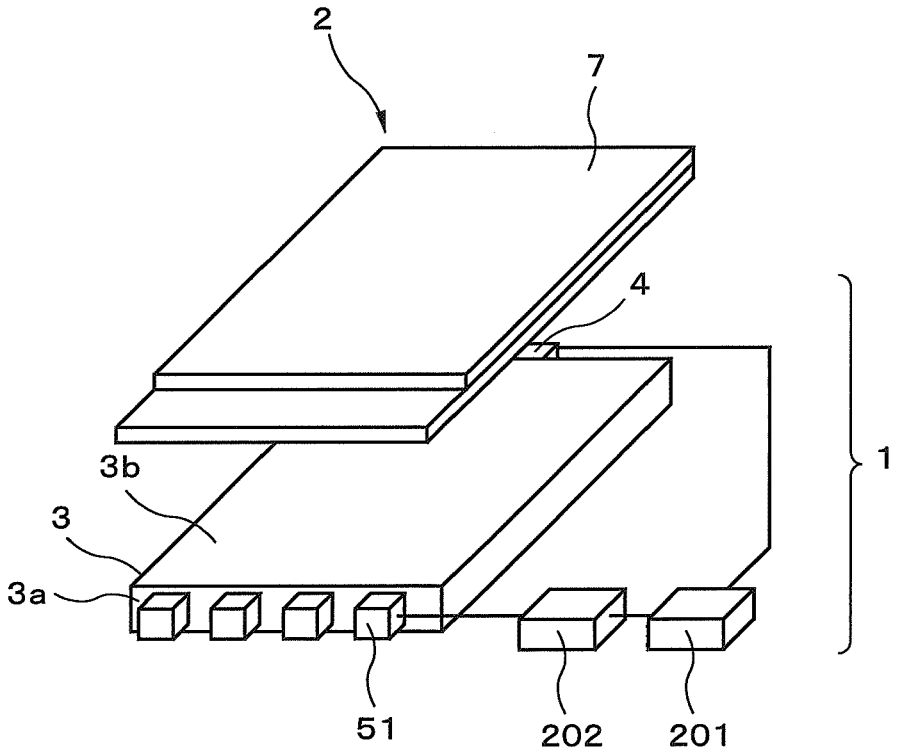
FIG. 3 is a perspective view showing the display apparatus according to the first embodiment of the present invention.
Figure 4:
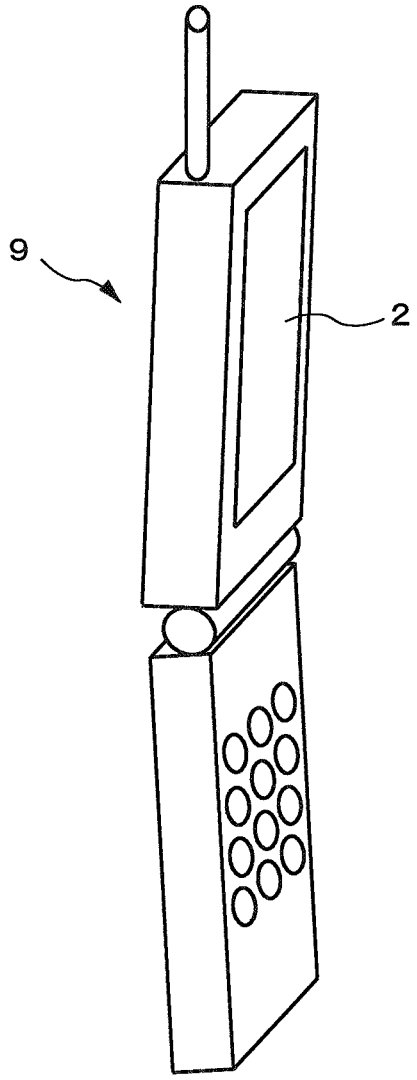
FIG. 4 is a perspective view showing a terminal apparatus according to the present embodiment.

The light source apparatus, display apparatus, terminal apparatus, and method for controlling these apparatuses according to embodiments of the present invention are described in detail below with reference to the attached diagrams. The light source apparatus, display apparatus, terminal apparatus, and method for controlling these apparatuses according to the first embodiment of the present invention will first be described. FIG. 3 is a perspective view showing a display apparatus according to the present embodiment, and FIG. 4 is a perspective view showing a terminal apparatus according to the present embodiment.

As shown in FIG. 3, a display apparatus 2 according to the first embodiment is composed of a light source apparatus 1 and a transmissive liquid crystal display panel 7. The light source apparatus 1 is provided with a light guide plate 3 composed of a transparent material. The light guide plate 3 is in the shape of a rectangular plate. Light sources 51 are disposed at a position facing one side surface (light incidence surface 3*a*) of the light guide plate 3. The light sources 51 are RGB (Red Green Blue) LEDs (Light-Emitting Diodes) 51 in which red, green, and blue light-emitting elements are placed in the same package. A plurality of RGB-LEDs 51 is arrayed along the light incidence surface 3*a* of the light guide plate 3, and one example of the number of LEDs is four. With the light guide plate 3, the incident light from the light incidence surface 3*a* is uniformly outputted from the principal surface (light output surface 3*b*). The plate performs the role of outputting, in planar form, the light outputted from the LEDs, which are point sources of light. Furthermore, a light source drive circuit 202 for driving the light sources is provided, and the RGB-LEDs 51 are connected to this circuit.

A light sensor 4 for sensing the light-emitting intensities of the light sources is provided to the side of the light guide plate 3 opposite the light incidence surface 3*a*. The light sensor 4 is, e.g., a photodiode, only one of which is placed on the surface of the light guide plate 3 opposite the light incidence surface 3*a* in the present embodiment. Unlike the light sensor described in the conventional example, the light sensor 4 is not provided with color filters for selecting the wavelength of received light. Specifically, the light sensor 4 is composed of one type of light sensor, and is sufficiently sensitive for a wide wavelength range in which light with red, green, and blue wavelengths can be received simultaneously. The light sensor 4 is used to sense the intensity of light that is continually propagated through the light guide plate 3 rather than being outputted from the light output surface 3*b* in the direction of the normal.

Furthermore, a control circuit 201 for controlling the light source drive circuit 202 is provided, and the light sensor 4 is connected to this control circuit 201. Specifically, the sensing results from the light sensor 4 are inputted to the control circuit 201.

The control circuit 201 is a circuit for controlling the light source drive circuit 202 as previously described, and has internally stored data as a reference for the input signal from the light sensor 4. This reference data is composed of individual data for the number of individually controllable colors in the light sources. Specifically, in the case of the RGB-LEDs 51, the control circuit 201 stores as reference data the data sensed by the light sensor 4 when the red, blue, and green light-emitting elements are individually lighted with the ideal intensities. The control circuit 201 checks this reference data against the results sensed by the light sensor 4. In cases in which the sensing results are greater than the reference data, the control circuit controls the light source drive circuit 202 so as to reduce the light emission intensity, and in cases in which the sensing results are less than the reference data, the control circuit controls the light source drive circuit 202 so as to increase the light emission intensity. In cases in which the sensing results are equal to the reference data, the control circuit controls the light source drive circuit 202 so as to maintain the same light emission intensity. A signal for selecting whether to light or extinguish the light source apparatus 1 is inputted to the control circuit 201. Specifically, in cases in which the terminal apparatus equipped with the light source apparatus 1 extinguishes the light source apparatus 1, the signal carries an instruction to extinguish the light source apparatus, whereby the control circuit 201 can control the light source drive circuit 202 to extinguish the RGB-LEDs 51. The control circuit 201 can receive an instruction from the terminal apparatus to control the light source drive circuit 202 and to light the RGB-LEDs 51 in the same manner.

The aforementioned transmissive liquid crystal display panel 7 is disposed facing the light output surface 3*b* of the light guide plate 3, and images are added to the light by allowing the light outputted from the light output surface 3*b* to pass through.

The display apparatus 2 may be installed, e.g., in the display part of a portable phone 9, as shown in FIG. 4. Specifically, a portable phone 9 as a portable terminal according to the present embodiment comprises the display apparatus 2 described above.

The following is a description of the operation of the display apparatus relating to the present embodiment configured as described above; i.e., the method for controlling the light source apparatus according to the present embodiment. FIGS. 5A through 5G are timing charts showing the hue correction operation of the light source apparatus according to the present embodiment, wherein time is plotted on the horizontal axis of each chart, FIG. 5A has the electric current sent to the red element of the RGB-LEDs by the light source drive circuit plotted on the vertical axis, FIG. 5B has the electric current sent to the green element of the RGB-LEDs by the light source drive circuit plotted on the vertical axis, FIG. 5C has the electric current sent to the blue element of the RGB-LEDs by the light source drive circuit plotted on the vertical axis, FIG. 5D has the light emission intensity of the red element of the RGB-LEDs plotted on the vertical axis, FIG. 5E has the light emission intensity of the green element of the RGB-LEDs plotted on the vertical axis, FIG. 5F has the light emission intensity of the blue element of the RGB-LEDs plotted on the vertical axis, and FIG. 5G has values of the output results of the light sensor plotted on the vertical axis.

Figures 5A, 5B, 5C, 5D, 5E, 5F, 5G:
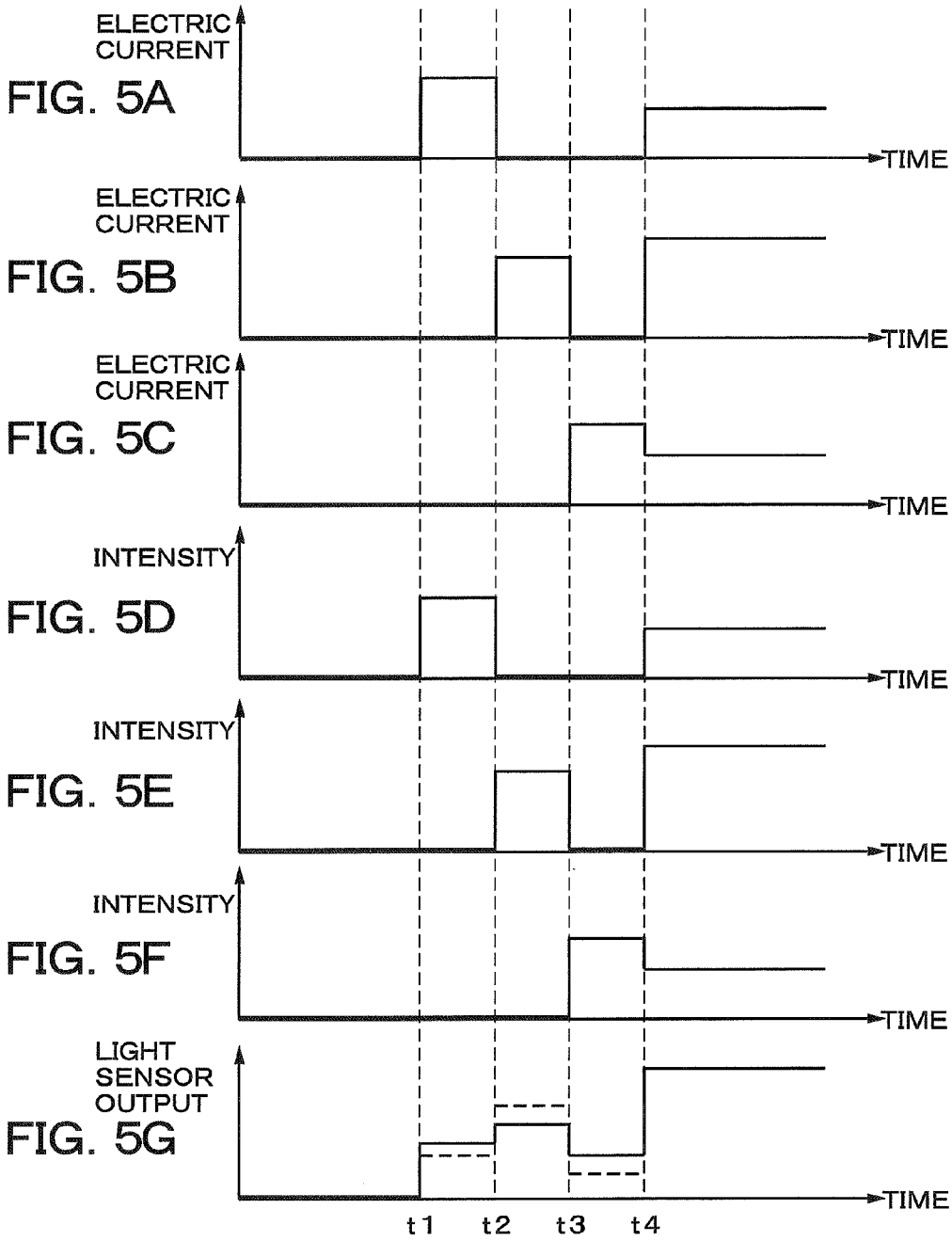
FIGS. 5A through 5G are timing charts showing the hue correction operation of the light source apparatus according to the present embodiment, wherein time is plotted on the horizontal axis of each chart, FIG. 5A has the electric current sent to the red element of the RGB-LEDs by the light source drive circuit plotted on the vertical axis, FIG. 5B has the electric current sent to the green element of the RGB-LEDs by the light source drive circuit plotted on the vertical axis, FIG. 5C has the electric current sent to the blue element of the RGB-LEDs by the light source drive circuit plotted on the vertical axis, FIG. 5D has the light emission intensity of the red element of the RGB-LEDs plotted on the vertical axis, FIG. 5E has the light emission intensity of the green element of the RGB-LEDs plotted on the vertical axis, FIG. 5F has the light emission intensity of the blue element of the RGB-LEDs plotted on the vertical axis, and FIG. 5G has values of the output results of the light sensor plotted on the vertical axis.

Prior to time t1 in FIG. 5, the light source apparatus is off and the RGB-LEDs are extinguished. Specifically, the electric current flowing into the red, green, and blue light-emitting elements of the RGB-LEDs is 0, as shown in FIGS. 5A through C, and the light-emitting intensities of the red, green, and blue light-emitting elements of the RGB-LEDs are thereby also kept at 0, as shown in FIGS. 5D through F. As a result, the output results of the light sensor are also substantially 0, as shown in FIG. 5G.

By contrast, time t1 is the time at which the light source apparatus turns on. For example, the light source apparatus can be turned on in a case in which the power source of a portable phone equipped with the light source apparatus is turned on, or in a case in which the portable phone is a folding phone having inwardly folding display surface and operating surface, as shown in FIG. 4, and in which, when the phone is folded shut, the light source apparatus is turned off because the used cannot view the display surface, and the light source apparatus is then turned on when the phone is opened during use.

When the light source apparatus is turned on at time t1; i.e., when the control circuit 201 receives a turn-on instruction, the control circuit 201 does not simultaneously turn on the red, green, and blue light-emitting elements of the RGB-LEDs 51, but instead first supplies a specific electric current to only the red light-emitting element, as shown in FIGS. 5A through 5C. The time period is from t1 to t2, and one example of this time period is 16 ms. The value of the specific electric current is preset in the control circuit 201 in advance. Supplying the specific electric current to the red light-emitting element causes only the red light-emitting element to light up, as shown in FIGS. 5D through 5F. The light sensor 4 receives the light from the red light-emitting element at this time and outputs the results to the control circuit 201. The solid line in FIG. 5G indicates the output results of the light sensor 4. Furthermore, the dashed line indicates the reference data of the light sensor 4 preset in advance in the control circuit 201; i.e., the data that is to be outputted by the light sensor 4 in cases in which the red light-emitting element is lighted with the ideal intensity during the time period t1-t2. In cases in which there is a difference between the solid line and the dashed line, the control circuit 201 concludes that the light-emitting state of the red light-emitting element of the RGB-LEDs 51 is different from the reference state. Specifically, the control circuit 201 matches the reference data with the results detected by the light sensor 4, and in cases in which the detection results are greater than the reference data, the control circuit controls the light source drive circuit 202 so as to reduce the light emission intensity, while in cases in which the detection results are less than the reference data, the control circuit controls the light source drive circuit 202 so as to increase the light emission intensity. Furthermore, in cases in which the detection results are equal to the reference data, the control circuit controls the light source drive circuit 202 so as to maintain the same light emission intensity. The light-emitting state of the red light-emitting element is thereby calibrated to the reference state.

Next, when the calibration of the red light-emitting element is completed at time t2, the control circuit 201 sets the electric current flowing to the red light-emitting element to 0, and supplies a specific electric current to the green light-emitting element. Only the green light-emitting element is thereby lighted, and the green light-emitting element is calibrated in the same manner as the red light-emitting element. This time period is from t2 to t3. When the calibration of the green light-emitting element is completed, the blue light-emitting element is calibrated in the same manner at time t3 to t4. Specifically, a specific electric current is supplied to the blue light-emitting element, whereby only the blue light-emitting element is lighted, and the red and green light-emitting elements are extinguished.

When the calibration of the RGB-LEDs 51 is completed at time t1 to t4, the red, green, and blue light-emitting elements of the RGB-LEDs 51 are simultaneously lighted at time t4. The drive conditions for the light-emitting elements at this time employ the calibration results at time t1 to t4, as shown in FIGS. 5A through 5F. The light-emitting elements can thereby be maintained in a specific state, and the hue of the light emitted by the light source apparatus can be maintained in a specific state.

Next, the effects of the present embodiment will be described. According to the light source apparatus of the present embodiment, when the light source apparatus is turned on, the red, green, and blue light-emitting elements of the light source RGB-LEDs are lighted in a time sequential fashion, and the light emission of the elements can be received by a single light sensor to calibrate the state of the light source. A specific state can thereby be maintained even when the states of the light-emitting elements of these colors change due to temperature changes, temporal changes, and other factors, and the hue of the light emitted by the light source apparatus can therefore be maintained in a specific state. Furthermore, only a single light sensor need be provided in the present embodiment, allowing the types and numbers of light sensors to be reduced, the light source apparatus to be made smaller, and costs to be lowered in comparison with cases in which three light sensors that correspond to wavelength ranges of the colors red, blue, and green are provided, as in the conventional examples described in connection with the present invention. Reducing the number of light sensors makes it possible to reduce the number of connections between the light sensor and the control circuit, and less space is therefore needed for the wiring, enabling a reduction in size. Furthermore, the control circuit has reference data for the light sensor output, whereby a comparison with the reference data can be made and the state of the light source can be easily sensed. Furthermore, calibrating the light source separately for each color allows the brightness of the light source apparatus during calibration to be reduced in comparison with an application in which light source apparatus light of all the colors is emitted simultaneously. Therefore, it is possible to reduce the discomfort experienced by the viewer when the colors of the light source are emitted in a time sequential fashion.

The light sensor in the present embodiment is provided on the surface of the light guide plate opposite the light incidence surface, as previously described. The light guide plate is generally formed to be larger than the display area of the display panel, and is designed to be capable of uniformly illuminating the display area. Therefore, the light sensor disposed on the end surface of the light guide plate is disposed farther to the outside than the display area, i.e., on the reverse side of the frame portion of the display panel. Light-blocking parts of the color filters are formed on the frame portion of the display panel. Therefore, the effects of external light on the light sensor can be reduced, whereby sensory precision can be improved. A polarization plate used in the display panel may be disposed on the light sensor. The effects of external light can be further reduced by the absorption of light in the polarization plate. Part of the casing of the portable phone may also be disposed over the light sensor, and this part of the casing may be used to block external light.

In the present embodiment, the calibrations at time t1 to t4 were made only once when the light source apparatus was turned on, but the present invention is not limited to this option alone, and the calibrations may also be made a plurality of times. Such calibrations make more accurate control possible, and the hue can therefore be corrected with greater precision. Also, the calibration time for the light-emitting element of each color was 16 ms, but another time period may also be set up. The calibration time should be short and is preferably 1 frame or less (16 ms or less), taking into account that the light source apparatus blinks in red, green, and blue and a correct display is not possible during the time needed for a light source apparatus to become usable in a display after being turned on. Since the viewer cannot perceive the calibration if it is 1 frame or less, a discomfort that accompanies calibration can be greatly reduced.

Furthermore, in the present embodiment, calibration of the light-emitting elements constituting the RGB-LEDs was started at the same time that the light source apparatus was turned on at time t1, but a time period may also be allowed to elapse between the time the light source apparatus is turned on and the time calibration of the light-emitting elements is started. The output of the light sensor may be detected while the light source is extinguished during this time period, and the detection results may be used as an offset for correction. Effects of the external light can thereby be removed from the calculations, and more accurate detection can be achieved in cases in which external light is superposed during calibration.

In the present embodiment, the light-emitting intensities during calibration of the light source at time t1 to t4 were at substantially the same level as the light-emitting intensities from time t4 onward, but the present invention is not limited to this option alone. Particularly, the light-emitting intensities during calibration of the light source at time t1 to t4 can be made less than at time t4 onward, whereby the brightness of the displayed images during calibration can be further lowered, and viewer discomfort caused by the emission of colors of the light source in a time sequential fashion can be reduced.

Furthermore, the reference data of the light sensor preset in advance in the control circuit contained the minimum number of colors, but the present invention is not limited to this option alone, and the reference data may include a greater amount of data. Examples include a case in which the portable phone is configured to allow the user to vary the screen brightness settings, and a case in which reference data for each brightness setting is stored and optimal reference data is used according to the set brightness. The configuration may also allow the user to vary the hue settings, and a plurality of sets of reference data may be stored for this purpose. It is thereby possible to make corrections that correspond to a wider variety of conditions.

Furthermore, an example was described in which the control circuit matched the reference data with the detection results of the light sensor, and the light source drive circuit was controlled so as to reduce the light emission intensity of the light source in cases in which the detection results were greater than the reference data, but a margin may be created for the difference in values between the detection results and the reference data. Specifically, the light source drive circuit may be controlled so as to reduce the light-emitting intensities of the light source in cases in which the detection results are greater than the reference data by a constant value, and the light source drive circuit may be controlled so as to maintain the same light-emitting intensities in cases in which the detection results are within a specific range.

In the present embodiment, an example was described in which the reference data of the light sensor preset in advance in the control circuit was used for calibration, but the present invention is not limited to this option alone. For example, it is also possible to create data that is equivalent to the reference data by calculating the detection results.

Instead of storing a plurality of sets of reference data for different brightness settings for cases in which the screen brightness settings are varied, another possibility is to retain a specific coefficient that corresponds to the brightness settings and to multiply the reference data of the basic brightness settings by the coefficient or to perform other calculations, whereby a plurality of sets of reference data can be created. It is thereby possible to reduce the number of sets of reference data that are to be stored by the control circuit, the configuration of the control circuit can be simplified, and costs can be lowered. It is also possible to perform calculations in such a way that, e.g., typical data on temporal changes is stored as a coefficient, and the lighted time is counted to reflect this coefficient. For example, a red LED tends to degrade more than other elements, and situations may arise in which the red LED alone will not agree any longer with the reference data during long-term lighting. A constant balance can be achieved at this time by setting the coefficient so that the amount of light decreases with lighting time.

Furthermore, in cases in which the results detected by a light sensor are inadequate and the reference data and the calibrations do not yield any improvement, it is possible that the light source for a certain color is defective and has quickly deteriorated. In such cases, it is possible, by performing calibration in accordance with the light source whose output has decreased, to ensure a balance in hue even though the overall brightness has decreased.

The reference data may also be established with respect to temporal changes in the light emission intensity of a light source. Specifically, a light source tends to emit different amounts of light as time passes after the light source is turned on. Particularly, when some time has elapsed after the light source is turned on, the amount of light often stabilizes after increasing. In view of this, the reference data is established in advance so that the light-emitting elements of each color emit light with a specific balance in cases in which the amount of light has stabilized. As a result, the reference data is established with consideration for a specific time period when the light source is calibrated while being on, and the balance between the light-emitting elements of each color is therefore disrupted. However, a specific balance between the colors is achieved again as time elapses and the amount of light stabilizes.

As described above, an important aspect of the present invention is that a specific event during startup of an apparatus or the like is used as a trigger to calibrate a light source. The main point of the present invention is that a plurality of types of light sources with different light emission spectra emits light in a time sequential fashion, and a light detection device having a wider light reception spectrum than the light emission spectra is used, whereby the light sources can be controlled upon reducing the number of different types of light receivers. Specifically, performing calibrations by using a specific event as a trigger is not a necessary aspect of the present invention. However, since the use of such a trigger can reduce the possibility that the user will be aware of the calibrating operation, the calibrating operation of the present invention can be more favorably applied to the device.

Other than turning the light source apparatus on as previously described, another possible example of a suitable event as a trigger for calibration is to turn on the display apparatus or terminal apparatus equipped with the light source apparatus. Other examples include changing to power consumption mode in which the display screen has a low brightness, or returning from power consumption mode. Furthermore, a device for integrating the usage time of the light source apparatus may be provided and calibration may be performed after a specified time has elapsed, in which case time fluctuations in the light sources can be appropriately corrected. The configuration may also allow for the user to calibrate the light sources of their own accord. As an example, a calibration button can be provided. The user can be at ease because of the possibility to make corrections of their own accord.

As previously described, is it preferable that the control circuit retain reference data corresponding to changes in the screen brightness settings, but is it also preferable that the calibrating operation be performed using as a trigger the instance when the user changes the brightness settings of the screen. It is thereby possible to more accurately reflect corrections that use the reference data. Furthermore, it is also suitable to enable not only screen brightness settings but also hue settings, and to perform calibration using the user's setting changes as a trigger. Terminal apparatuses have come to be used on a global scale, and the same terminal apparatuses are being used increasingly more often in a variety of countries, but since there are many different preferences, there has been a demand for a simple method to adapt to these preferences. With the configuration of the present invention, not only can the hue of the screen be easily set and varied, but the correcting operation can be simplified, which is extremely preferable.

Possible suitable events in a portable terminal apparatus include changing to vibrating mode; i.e., receiving a call or an email with a portable phone or the like, and the ringing of an alarm set by the user. This is because the probability is low that the user is focusing on the screen while the device vibrates, and even if the user is focusing on the screen, the possibility that the user will be aware of the calibration as a result of this vibration can be reduced, and there is less of a chance that the user will experience calibration-induced discomfort. Furthermore, it is possible to ensure that the user will be aware of calibration by allowing more time for the calibration operation, or to attract the attention of the user by the joint use of vibration and the calibrating operation. Calibration can also be performed more favorably during communication with the portable phone because the user is not focusing on the screen.

The events for the triggers described above can be used independently or in combination with each other. The configuration may also allow for an adaptation to a plurality of events, and calibration may be performed when any of the events are concluded. The degree of freedom with the calibrating operation can thereby be dramatically improved, allowing for more precise corrections.

As previously described, a feature of the present invention in that the light receivers used to control the light sources are fewer in number than the types of light sources. This is because the spectra of the light receivers is wider than the light emission spectra of the light sources, and the types of light receivers can be fewer than the types of light sources. Therefore, the present invention can be applied to a configuration in which, e.g., light receivers having different dynamic ranges are provided, and the brightness of the screen can be corrected with greater precision. Specifically, the light receivers may include light receivers for detecting low brightness with high precision in states of low brightness, and light receivers for detecting high brightness with high precision in states of high brightness. Calibration may be performed using the detection results of the light receivers that are more suited to the amount of light from the light sources. For example, the calibrating operation may be performed using two types of light receivers, i.e., one type for detecting low brightness and one type for detecting high brightness, provided for the red, green, and blue light-emitting elements of the RGB-LEDs. In this case, when conventional red, green, and blue light receivers are used, a total of six light receivers must be provided both for low brightness detection and for high brightness detection. Not only does the configuration become complicated, but control also becomes complicated. However, extremely significant effects can be achieved in the present invention because only two types of light receivers are needed. Thus, in cases in which the correction parameters include not only the wavelength range but also the dynamic range and other parameters, the number of light receivers must be increased to form a matrix when a conventional method is used, which is much more complicated, but these objects can be achieved with a simple configuration in the present invention.

In the present embodiment, an example was described in which the detection operation was performed when light was emitted in a time sequential fashion, but it is apparent that another option may be to continuously detect a white state produced by the simultaneous emission of light by light-emitting elements of three colors from time t4 onward, and to use this approach as a means for preventing situations in which the amount of light from the light sources fluctuates abnormally, for example. Furthermore, the result of detecting the white state can be used to improve the precision of the calibrating operation. For example, one possibility is a method in which reference data for white states is stored in advance, and if the detection results are greater than the reference data, the difference between the two is factored into the reference data as a weight factor.

Yet another possibility is to provide the control circuit with a circuit for temporarily storing the conditions for driving the light-emitting elements, and to perform the calibrating operation and store the difference between the existing conditions and the reference data when a change is made from active mode to standby mode. When the power source is turned on in the subsequent cycle, a drive is initiated on the basis of this data, and stable conditions are recreated to start the operation.

Furthermore, in the present embodiment, an example was described in which the light source RGB-LEDs were composed of light-emitting elements of the three colors red, green, and blue, but the present invention is not limited to this option alone. The present invention can be similarly used with light sources having light-emitting elements that emit colors other than red, green, and blue, or light sources having more than three types of light-emitting elements, as long as the light-emitting elements can be individually controlled. Examples of such light sources include five-color LEDs that have light-emitting elements for aqua and yellow in addition to red, green, and blue; and two-color LEDs having blue and yellow light-emitting elements. Also, in the present embodiment, the RGB-LEDs had all three red, green, and blue light-emitting elements placed in one package, but the differently colored light-emitting elements may also be mounted in different packages. Furthermore, the light source is not limited to LEDs, and electroluminescence elements or other such elements can also be used. A laser light source can also be used, which enables displays of a wider chromaticity range.

Furthermore, the display panel used with the light source apparatus of the present invention is not limited to a liquid crystal panel, and any display panel that uses a light source apparatus may be used. The liquid crystal panel is also not limited to the transmissive type, and any panel that has a transmissive area in each pixel may be used. A transflective liquid crystal panel having a reflective area in a portion of each pixel, a visible-everywhere transflective liquid crystal panel, or a micro-reflective liquid crystal panel may also be used.

Furthermore, in the present embodiment, a portable phone was used as an example of the terminal apparatus, but the present invention is not limited to this option alone. Compatible display apparatuses of the present invention include not only mobile telephones, but also PDAs (Personal Digital Assistant: personal information terminal), gaming devices, digital cameras, digital video cameras, and various other types of mobile terminal apparatuses. The display apparatus according to the present embodiment may be installed not only in mobile terminal apparatuses, but also in notebook-type personal computers, cash dispensers, vending machines, and other various types of terminal apparatuses.

Figure 6:
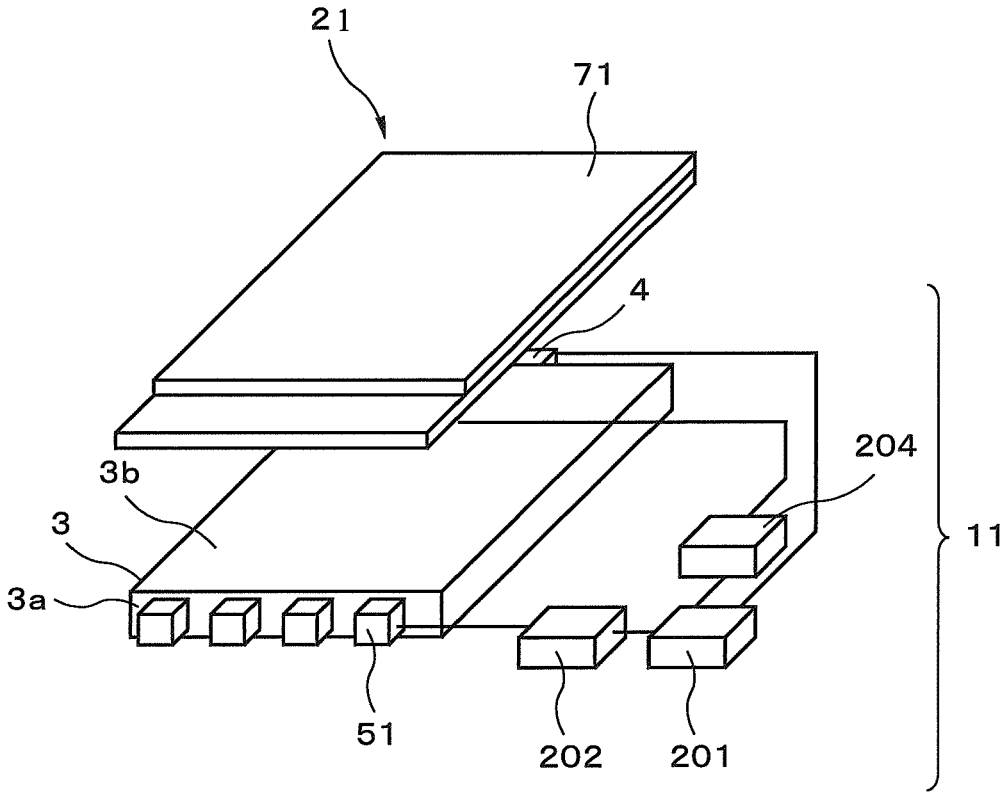
FIG. 6 is a perspective view of the display apparatus according to the second embodiment of the present invention.

Next, a second embodiment of the present invention will be described. FIG. 6 is a perspective view showing the display apparatus according to the present embodiment. As shown in FIG. 6, a display apparatus 21 and light source apparatus 11 according to the second embodiment use a transmissive liquid crystal display panel 71 that operates on a vertical alignment principle instead of the transmissive liquid crystal display panel 7 used by the display apparatus 2 and light source apparatus 1 according to the first embodiment. A display panel drive circuit 204 for driving the transmissive liquid crystal display panel 71 is connected to the control circuit 201, and the display panel drive circuit 204 is under the control of the control circuit 201. A controller is composed of the control circuit 201, the light source drive circuit 202, and the display panel drive circuit 204. As a result, the control circuit 201 controls the display panel drive circuit 204, and the transmittance of the transmissive liquid crystal display panel 71 can be reduced with a specific timing. The configuration of the present embodiment is otherwise identical to the first embodiment.

The following is a description of the operation of the display apparatus according to the present embodiment configured as described above; i.e., the method for controlling the light source apparatus according to the present embodiment. FIGS. 7A through 7H are timing charts showing the hue correction operation of the light source apparatus according to the present embodiment, wherein time is plotted on the horizontal axis of each chart, FIG. 7A has the electric current sent through the red element of the RGB-LEDs by the light source drive circuit plotted on the vertical axis, FIG. 7B has the electric current sent through the green element of the RGB-LEDs by the light source drive circuit plotted on the vertical axis, FIG. 7C has the electric current sent through the blue element of the RGB-LEDs by the light source drive circuit plotted on the vertical axis, FIG. 7D has the light emission intensity of the red element of the RGB-LEDs plotted on the vertical axis, FIG. 7E has the light emission intensity of the green element of the RGB-LEDs plotted on the vertical axis, FIG. 7F has the light emission intensity of the blue element of the RGB-LEDs plotted on the vertical axis, FIG. 7G has values of the output results of the light sensor plotted on the vertical axis, and FIG. 7H has the transmittance of the transmissive liquid crystal display panel plotted on the vertical axis.

Figures 7A, 7B, 7C, 7D, 7E, 7F, 7G, 7H:
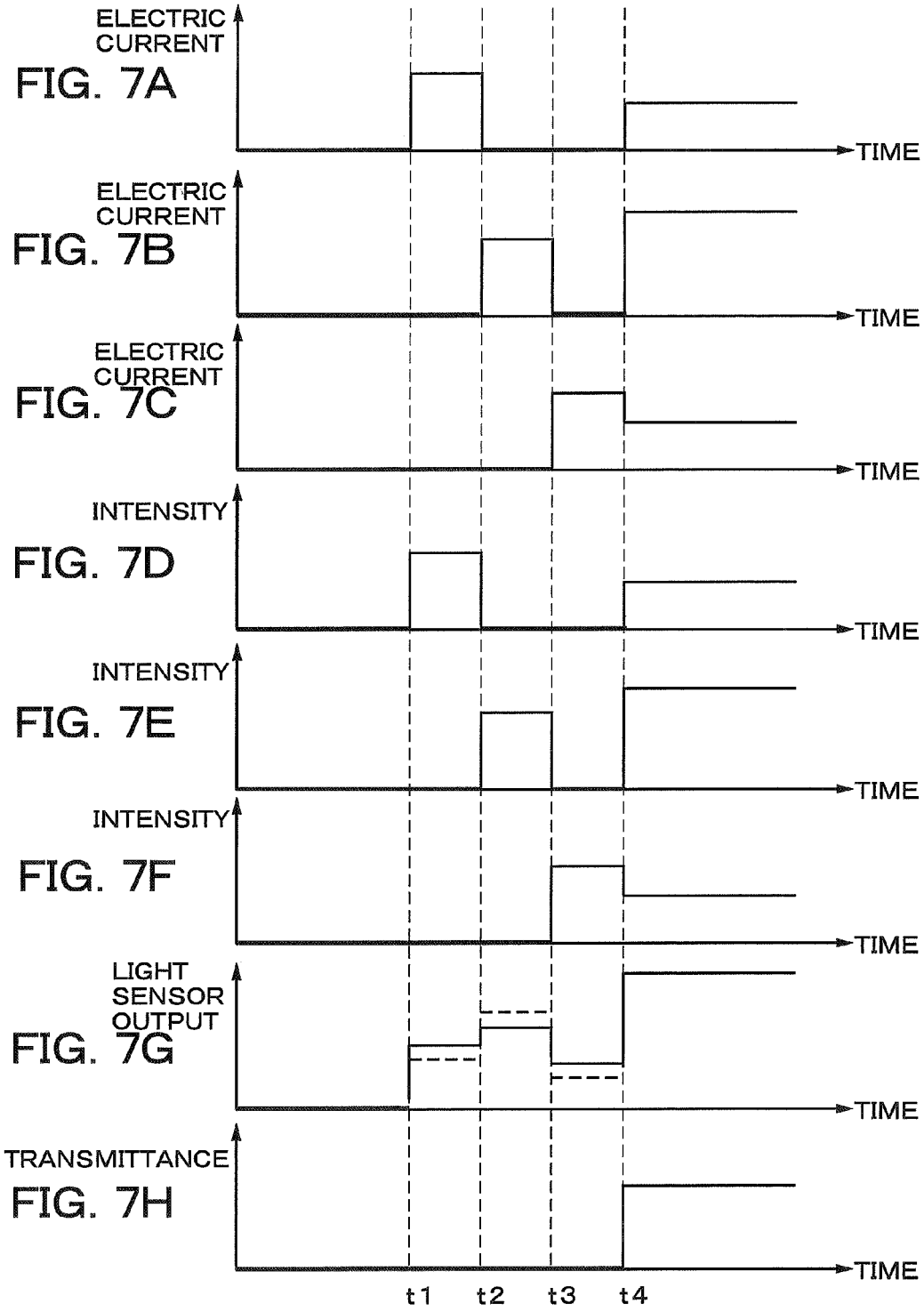
FIGS. 7A through 7H are timing charts showing the hue correction operation of the light source apparatus according to the present embodiment, wherein time is plotted on the horizontal axis of each chart, FIG. 7A has the electric current sent to the red element of the RGB-LEDs by the light source drive circuit plotted on the vertical axis, FIG. 7B has the electric current sent to the green element of the RGB-LEDs by the light source drive circuit plotted on the vertical axis, FIG. 7C has the electric current sent to the blue element of the RGB-LEDs by the light source drive circuit plotted on the vertical axis, FIG. 7D has the light emission intensity of the red element of the RGB-LEDs plotted on the vertical axis, FIG. 7E has the light emission intensity of the green element of the RGB-LEDs plotted on the vertical axis, FIG. 7F has the light emission intensity of the blue element of the RGB-LEDs plotted on the vertical axis, FIG. 7G has values of the output results of the light sensor plotted on the vertical axis, and FIG. 7H has the transmittance of the transmissive liquid crystal display panel plotted on the vertical axis.

In the present embodiment, the operation for calibrating a light source is identical to the previously described first embodiment as shown in FIGS. 7A through 7G, but the present embodiment differs in that the transmittance of the transmissive liquid crystal display panel 71 is controlled in accordance with the operation for calibrating the light source, as shown in FIG. 7H. Specifically, prior to time t1, no display is shown because both the display apparatus 21 and the transmissive liquid crystal display panel 71 are off. In particular, the transmissive liquid crystal display panel 71 operates on a vertical alignment principle in the present embodiment. Therefore, the panel is normally black with low transmittance when off. As a result, the transmittance of the transmissive liquid crystal display panel 71 is low prior to time t1. The light source apparatus 11 turns on at time t1, and the light source is calibrated at time t1 to t4 while the control circuit 201 controls the display panel drive circuit 204 so as to maintain a low transmittance in the transmissive liquid crystal display panel 71. For example, black color is displayed on the entire screen in order to maintain low transmittance. As a result, the transmittance of the transmissive liquid crystal display panel 71 at time t1 to t4 remains low in the same manner as prior to time t1. At time t4, when the operation for calibrating the light source is complete, the transmittance no longer remains low, and information is displayed.

According to the present embodiment, reducing the transmittance of the transmissive liquid crystal display panel while a light source is being calibrated makes it impossible for the user to perceive the light even when the colors are lighted in a time sequential fashion during calibration of the light source, and it is therefore possible to greatly reduce the discomfort felt by the user during calibration. Furthermore, the effects of external light can be greatly reduced because the display panel has low transmittance during calibration. Particularly, it is possible to eliminate the effects of light that passes through the display area of the display panel from the viewer's side, reaches the light guide plate, propagates through the light guide plate, and strikes the light sensor. The operation and effects of the second embodiment are otherwise the same as the first embodiment.

In the present embodiment, an example was described in which a light source was calibrated when the light source apparatus was turned on after being off, and the transmittance of the transmissive liquid crystal display panel was kept low until the calibration was complete. However, the present invention is not limited to this option alone, and another option is to keep the transmittance of the transmissive liquid crystal display panel low in cases in which the light source apparatus is on and the light source is calibrated while the light source apparatus remains on. Calibrating the light source when the light source is turned on after being off is appropriate for correcting changes in the light source over long periods of time, while calibrating the light source while the light source is on is suitable for correcting characteristic fluctuations resulting from heat generated by the light source. It is preferable to calibrate the light source while the display contents on the screen are changing. This is because if the light source is calibrated while the user is focusing on the display, the brightness of the display apparatus is reduced, causing the user to experience discomfort. Examples of such an event include switching the display screen, pulling up a menu screen, or the like. Specifically, the transmittance of the transmissive liquid crystal display panel is lowered and the light source is calibrated in synchronization with the switching of the screen, whereby the user does not perceive light emitted in a time sequential fashion during calibration, and any discomfort caused by reduced transmittance in the display apparatus can be reduced.

Another example of an event in which the display contents undergo changes involves cases in which a delivery notification for the call or email is displayed in a terminal apparatus capable of receiving calls or emails. This is because the display of the terminal apparatus can be changed by the delivery notification. This example can be appropriately applied to cases in which the display contents are discontinuous along the time axis, such as cases in which an application is selected from a menu screen or the like and the screen display is changed, or cases in which a dialog box is displayed to request user confirmation.

Yet another possible example is when a video camera starts or stops recording. Still another possible example is the photographing operation of a digital still camera or another such terminal having a function for capturing still images. In these cases, the display contents are not discontinuous along the time axis, but the calibrating operation is performed in conjunction with the user's intended photographing operation, whereby changes to the image that accompany the calibrating operation are kept within acceptable limits for the user. This is preferred because the image changes are interpreted as an explicit response to the operations of the user.

In the present embodiment, it is possible to reduce discomfort experienced by the user during calibration by reducing the transmittance of the display panel during calibration of the light sources. However, the present invention is not limited to this option alone and can also be applied to cases other than those in which the transmittance of the display panel is intentionally reduced. One possible example is a case in which the displayed image is inherently dark. Specifically, the control device is configured so as to be capable of detecting the display contents on the display panel, and the control device performs the calibrating operation in cases in which the display contents fulfill specified conditions, i.e., represent a dark scene or the like. The calibrating conditions can thereby be expanded, which makes more precise correction possible.

In addition the previously described dark scene, suitable examples of detection conditions for the display contents include cases in which there is an abrupt change in the main brightness or color information of the display, such as when there is an abrupt change in the brightness of the scene; or cases in which there is an abrupt change in the display contents of the screen.

Furthermore, in cases in which the transmittance of the display panel is reduced during the calibrating operation, liquid crystal capable of high-speed responses can be used to display complementary colors to compensate for the reduced transmittance. Specifically, when red light-emitting elements are calibrated, the transmittance of the red display of the display panel is reduced and only green and blue colors are displayed. Thus, the only pixels that are displayed are those in a color-wise complementary relation with the elements of the light sources being calibrated. The calibrating operation can thereby be made inconspicuous without making large changes to the display contents of the screen.

Furthermore, in the present embodiment, a liquid crystal display panel in a normally black mode can be appropriately used as previously described. Examples of this mode include vertical alignment modes such as MVA (Multi-domain Vertical Alignment), which has multiple domains and possesses reduced viewing-angle dependency, as well as PVA (Patterned Vertical Alignment), ASV (Advanced Super V), and the like. Also, horizontal field modes include IPS (In-Plane Switching), FFS (Fringe Field Switching), AFFS (Advanced Fringe Field Switching), and the like.

Figure 8:
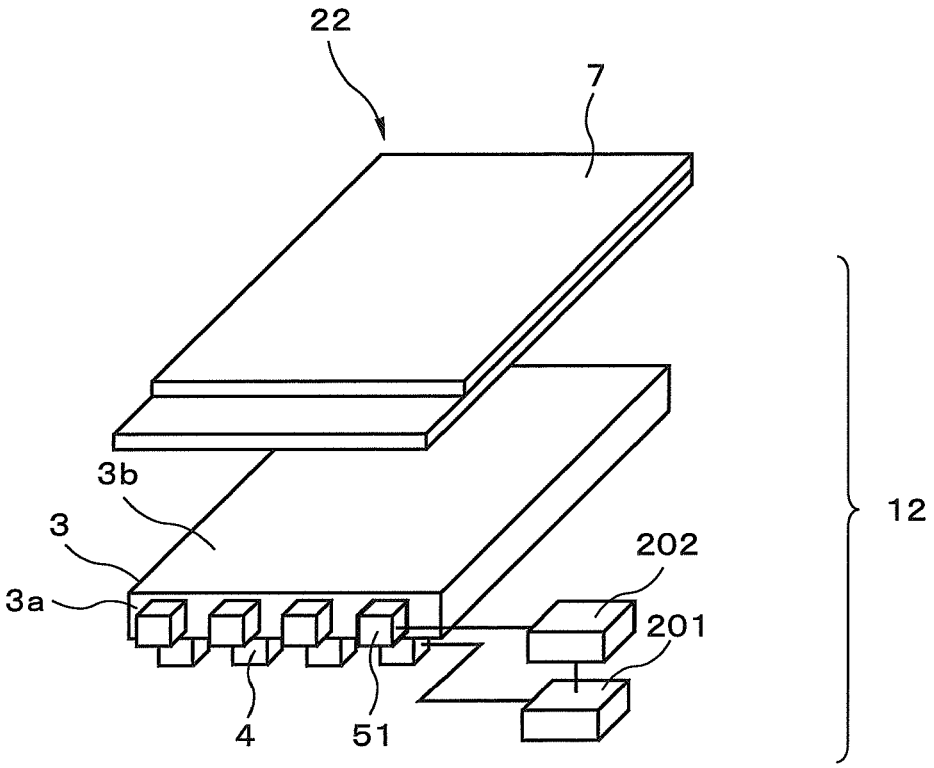
FIG. 8 is a perspective view showing the display apparatus according to the third embodiment of the present invention.

Next, a third embodiment of the present invention will be described. FIG. 8 is a perspective view showing the display apparatus according to the present embodiment. A display apparatus 22 and light source apparatus 12 according to the third embodiment have the light sensors 4 in a different position than the display apparatus 2 and light source apparatus 1 according to the first embodiment, as shown in FIG. 8. In the first embodiment, only one light sensor was placed in the middle of the surface of the light guide plate 3 opposite the light incidence surface 3*a* as described above, but in the third embodiment, a number of light sensors equal to the number of light source RGB-LEDs are disposed in proximity to the light sources on the surface of the light guide plate 3 opposite the light output surface 3*b*. The configuration of the present embodiment is otherwise identical to the first embodiment.

In the present embodiment, the light sensors 4 are disposed in proximity to the RGB-LEDs in equal numbers. The LEDs can thereby be calibrated with precision. Specifically, in the first embodiment, the light sensor 4 was disposed at a position distanced from the light sources, and although calibration was possible with each color of the RGB-LEDs constituting the light sources, it was difficult to calibrate each LED. In the present embodiment, a number of light sources equal to the number of LEDs are disposed in proximity to the LEDs, and the LEDs can therefore be calibrated even in cases in which the characteristics of the LEDs are nonuniform. Although the number of lights sensors is greater than in the first embodiment, the number of light sensors is ⅓ in comparison with a conventional case in which light sensors for each of the three colors red, blue, and green are placed for each LED, and the device can be reduced in size while costs can be lowered. The operation and effects of the third embodiment are otherwise identical to the first embodiment described above.

Figure 9:
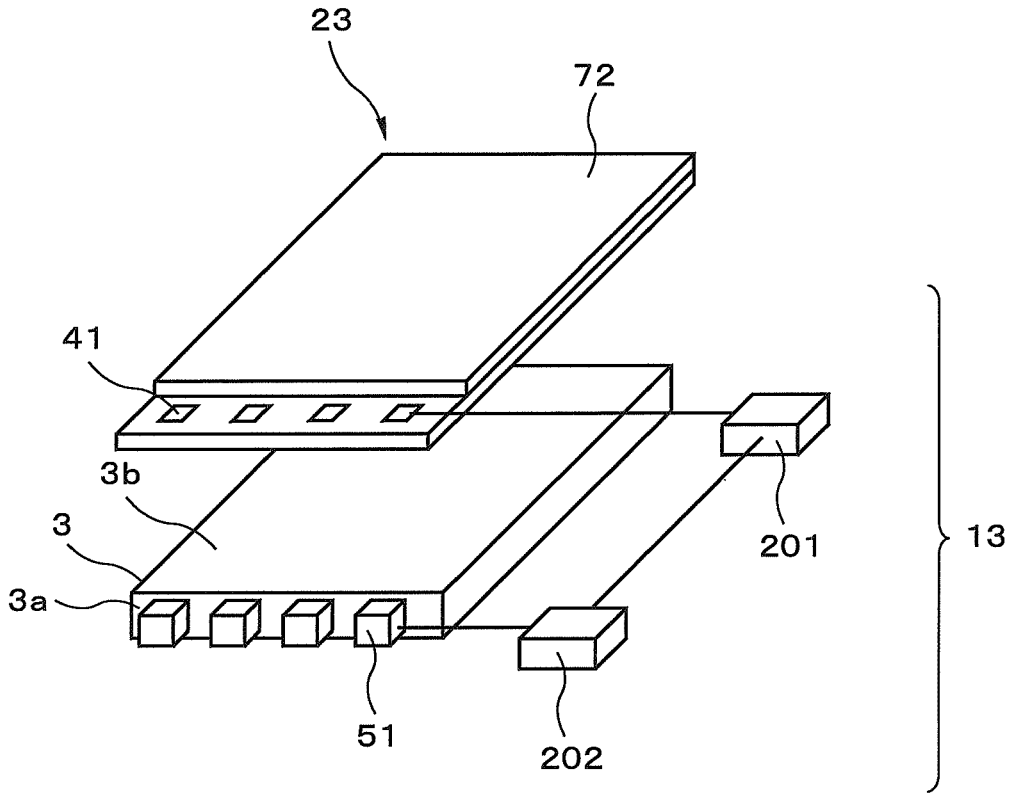
FIG. 9 is a perspective view showing the display apparatus according to the fourth embodiment of the present invention.

Next, a fourth embodiment of the present invention will be described. FIG. 9 is a perspective view showing the display apparatus according to the present invention. As shown in FIG. 9, the display apparatus 23 and light source apparatus 13 according to the present embodiment employ a transmissive liquid crystal display panel 72 instead of the transmissive liquid crystal display panel 7 used by the display apparatus 22 and light source apparatus 12 in the third embodiment, and also light sensors 41 instead of the light sensors 4. The light sensors 41 are photodiodes formed from an amorphous silicon layer used as a semiconductor layer in the thin-film transistors constituting the pixels of the transmissive liquid crystal display panel 72. Specifically, the light sensors 41 are formed on the transmissive liquid crystal display panel 72. Also, a number of light sensors 41 equal to the number of RGB-LEDs constituting a light source are disposed in proximity to the LEDs, similar to the light sensors 4 in the third embodiment. Furthermore, the light sensors 41 are disposed between the display area and the terminal part of the transmissive liquid crystal display panel 72, as shown in FIG. 9. Specifically, the RGB-LEDs are disposed in proximity to the terminal part of the transmissive liquid crystal display panel 72. The configuration of the present embodiment is otherwise identical to the previously described first embodiment.

In the present embodiment, since the light sensors 41 are formed integrally on the transmissive liquid crystal display panel 72, there is no need to provide new light sensors to an area outside the display panel, and size can be reduced while costs can be lowered. Generally, the area of the display panel having a terminal part is larger than the area having no terminals in the frame portion, which is the non-display area, by at least the size of the terminals. Therefore, providing the light sensors to the frame portion having the terminals makes it possible to dispose the light source for these light sensors on the reverse side of the terminals. As a result, the distance from the light sources to the display area can be made larger. Therefore, brightness variations in the light source apparatus can be reduced and display quality improved. Furthermore, disposing the light sensors in the frame portion having the terminals allows the output of the light sensors to be lead out from the terminals in the transmissive liquid crystal display panel. Therefore, less space is needed for the wiring of the light sensors on the transmissive liquid crystal display panel, and size can be further reduced. The operation and effects of the fourth embodiment are otherwise identical to the previously described third embodiment.

Figure 10:
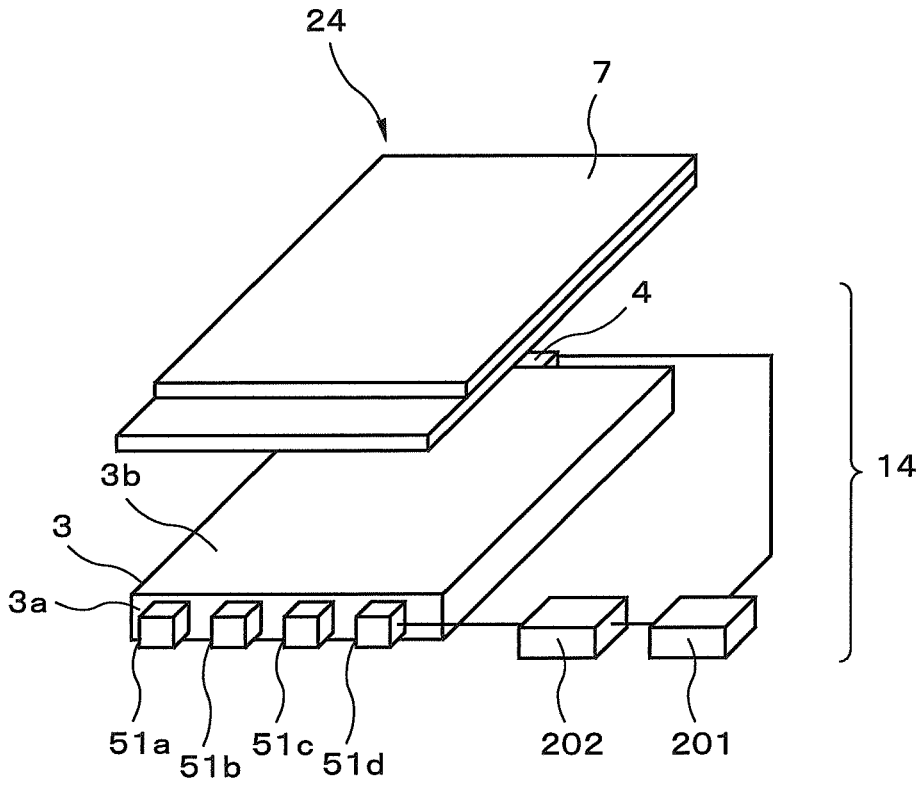
FIG. 10 is a perspective view showing the display apparatus according to the fifth embodiment of the present invention.

Next, a fifth embodiment of the present invention will be described. FIG. 10 is a perspective view showing the display apparatus according to the present embodiment. The display apparatus 24 and light source apparatus 14 according to the fifth embodiment have essentially the same configuration as the display apparatus 2 and light source apparatus 1 according to the first embodiment, as shown in FIG. 10. However, the four RGB-LEDs 51*a*, 51*b*, 51*c*, 51*d* constituting a light source 51 are configured so that the respective colors of the LEDs can be lighted and adjusted individually. The configuration of the present embodiment is otherwise identical to the previously described first embodiment.

Figures 11A, 11B, 11C, 11D, 11E, 11F, 11G, 11H, 11I, 11J, 11K, 11L, 11M:
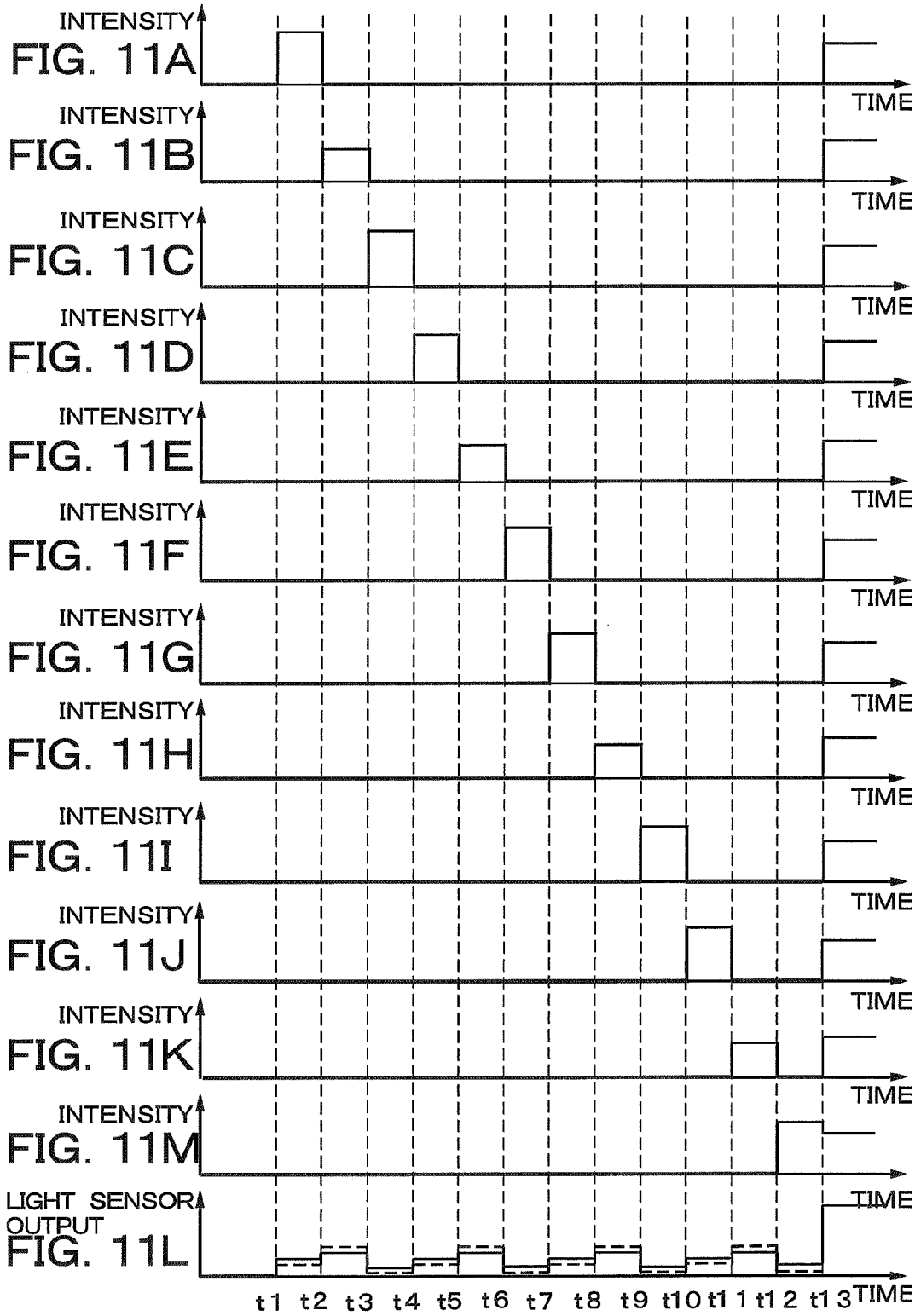
FIGS. 11A through 11M are timing charts showing the correction operation of the light source apparatus according to the present embodiment, wherein time is plotted on the horizontal axis of each chart, FIG. 11A has the light emission intensity of the red element of the RGB-LED 51*a* plotted on the vertical axis, FIG. 11B has the light emission intensity of the green element of the RGB-LED 51 plotted on the vertical axis, FIG. 11C has the light emission intensity of the blue element of the RGB-LED 51*a* plotted on the vertical axis, FIG. 11D has the light emission intensity of the red element of the RGB-LED 51*b* plotted on the vertical axis, FIG. 11E has the light emission intensity of the green element of the RGB-LED 51 plotted on the vertical axis, FIG. 11F has the light emission intensity of the blue element of the RGB-LED 51*b* plotted on the vertical axis, FIG. 11G has the light emission intensity of the red element of the RGB-LED 51*c* plotted on the vertical axis, FIG. 11H has the light emission intensity of the green element of the RGB-LED 51 plotted on the vertical axis, FIG. 11I has the light emission intensity of the blue element of the RGB-LED 51*c* plotted on the vertical axis, FIG. 11J has the light emission intensity of the red element of the RGB-LED 51*d* plotted on the vertical axis, FIG. 11K has the light emission intensity of the green element of the RGB-LED 51*d* plotted on the vertical axis, FIG. 11L has the light emission intensity of the blue element of the RGB-LED 51*d* plotted on the vertical axis, and FIG. 11M has the values of the output results of the light sensor plotted on the vertical axis.

The following is a description of the operation of the display apparatus according to the present embodiment configured as described above; i.e., the method for controlling the light source apparatus according to the present embodiment. FIGS. 11A through 11M are timing charts showing the hue correction operation of the light source apparatus according to the present embodiment, wherein time is plotted on the horizontal axis of each chart, FIG. 11A has the light emission intensity of the red element of the RGB-LED 51*a* plotted on the vertical axis, FIG. 11B has the light emission intensity of the green element of the RGB-LED 51*a* plotted on the vertical axis, FIG. 11C has the light emission intensity of the blue element of the RGB-LED 51*a* plotted on the vertical axis, FIG. 11D has the light emission intensity of the red element of the RGB-LED 51*b* plotted on the vertical axis, FIG. 11E has the light emission intensity of the green element of the RGB-LED 51*b* plotted on the vertical axis, FIG. 11F has the light emission intensity of the blue element of the RGB-LED 51*b* plotted on the vertical axis, FIG. 11G has the light emission intensity of the red element of the RGB-LED 51*c* plotted on the vertical axis, FIG. 11H has the light emission intensity of the green element of the RGB-LED 51*c* plotted on the vertical axis, FIG. 11I has the light emission intensity of the blue element of the RGB-LED 51*c* plotted on the vertical axis, FIG. 11J has the light emission intensity of the red element of the RGB-LED 51*d* plotted on the vertical axis, FIG. 11K has the light emission intensity of the green element of the RGB-LED 51*d* plotted on the vertical axis, FIG. 11L has the light emission intensity of the blue element of the RGB-LED 51*d* plotted on the vertical axis, and FIG. 11M has the values of the output results of the light sensor plotted on the vertical axis.

A feature of the present embodiment is that the light-emitting elements of each color of the RGB-LEDs 51*a*, 51*b*, 51*c*, 51*d* constituting the light source 51 are calibrated in sequence, as shown in FIGS. 11A through 11L. Specifically, in the time period from t1 to t2, the control circuit 201 controls the light source drive circuit 202 so that only the red element of the RGB-LED 51*a* is lighted. As a result, only the red element of the RGB-LED 51*a* is lighted and the light sensor 4 receives only this light emission, as shown in FIGS. 11A through 11M. Similarly, in the time period from t2 to t3, only the green element of the RGB-LED 51*a* is lighted, and in the time period from t3 to t4, only the blue element of the RGB-LED 51*a* is lighted. Next, in the time period from t4 to t5, only the red element of the RGB-LED 51*b* is lighted. Further descriptions are omitted because the calibration hereinafter proceeds in the same manner, but the light-emitting elements of each color of the RGB-LEDs 51*a*, 51*b*, 51*c*, 51*d* are lighted in sequence, and the light-emitting elements of the LEDs are calibrated individually.

According to the present embodiment, the light-emitting elements of each color of the LEDs constituting a light source can be calibrated individually with a single light sensor. The elements can thereby be calibrated at low cost with high precision, including cases in which there are nonuniformities in the initial period among the individual LEDs.

It is also effective to combine the present embodiment with the previously described second embodiment. In cases in which there is relatively latitude in terms of time for the terminal apparatus to start up in situations such as when the power source of the portable phone is turned on, the LEDs are calibrated individually as described in the present embodiment, and high-precision corrections are made that include cases in which there are nonuniformities in the initial period among the LEDs. In cases in which there is relatively little latitude in terms of time, such as when the menu is retrieved, a simple calibration is performed in which same-color elements of the LEDs are caused to emit light simultaneously, as described in the second embodiment. The reason is that it is preferable to finely adjust individual calibrations because the nonuniformities and temporal changes in the initial period among the LEDs differ with each LED, but fluctuations resulting from changes in temperature tend to be the same for the same colors. Therefore, simple calibrations are therefore still effective, and less time is required for corrections.

In the present embodiment, since the distance to the light sensor differs with each LED, it is preferable that each LED store and use reference data for calibration. The RGB-LED 51*a* and the RGB-LED 51*d* can use the same reference data because these two LEDs are equidistant from the light sensor 4, as shown in FIG. 10. Similarly, the RGB-LED 51*b* and RGB-LED 51*c* can use the same reference data because these two LEDs are equidistant from the light sensor 4. Thus, LEDs having the same relationship to the light sensor 4 can share common reference data, and the number of sets of reference data that are to be stored can be reduced, which allows costs to be lowered further. The operation and effects of the fifth embodiment are otherwise identical to the previously described first embodiment.

Figure 12:
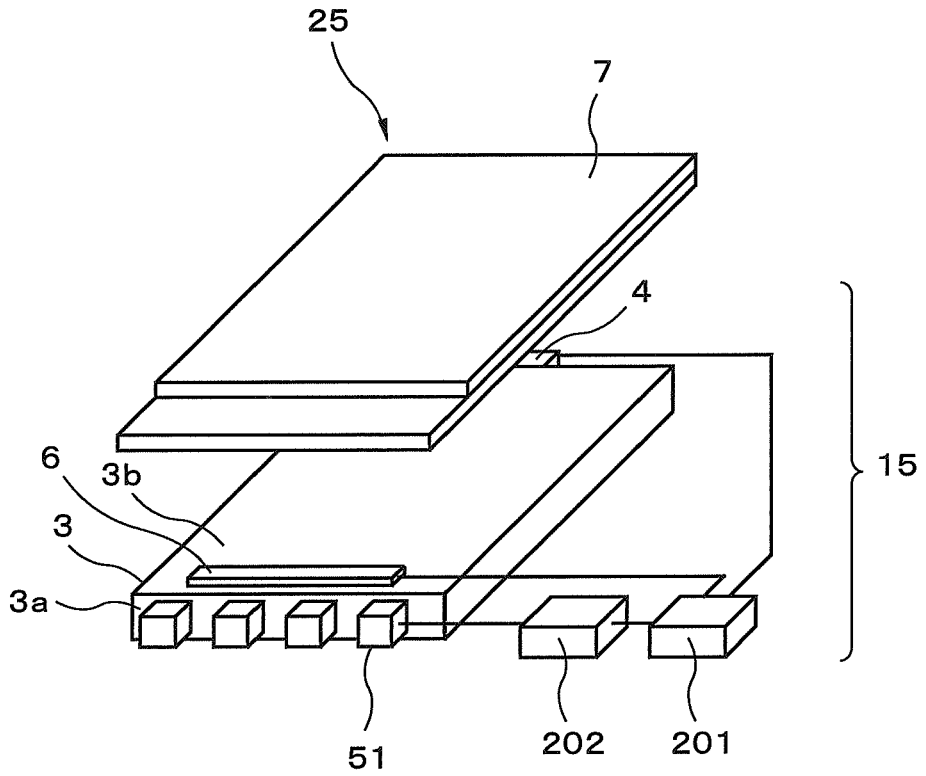
FIG. 12 is a perspective view showing the display apparatus according to the sixth embodiment of the present invention.

Next, a sixth embodiment of the present invention will be described. FIG. 12 is a perspective view showing the display apparatus according to the present embodiment. As shown in FIG. 12, unlike the display apparatus 2 and light source apparatus 1 according to the previously described first embodiment, a display apparatus 25 and light source apparatus 15 according to the sixth embodiment are provided with a temperature sensor 6 for sensing the temperature. The output of this temperature sensor 6 is connected to the control circuit 201, and the control circuit 201 can use the output information of the temperature sensor 6 to control the operation of calibrating the light source. The configuration of the present embodiment is otherwise identical to the previously described first embodiment.

The following is a description of the operation of the display apparatus according to the present embodiment configured as described above; i.e., the method for controlling the light source apparatus according to the present embodiment. FIGS. 13A through 13H are timing charts showing the hue correction operation of the light source apparatus according to the present embodiment, wherein time is plotted on the horizontal axis of each chart, FIG. 13A has the electric current supplied by the light source drive circuit to the red element of the RGB-LEDs plotted on the vertical axis, FIG. 13B has the electric current supplied by the light source drive circuit to the green element of the RGB-LEDs plotted on the vertical axis, FIG. 13C has the electric current supplied by the light source drive circuit to the blue element of the RGB-LEDs plotted on the vertical axis, FIG. 13D has the light emission intensity of the red element of the RGB-LEDs plotted on the vertical axis, FIG. 13E has the light emission intensity of the green element of the RGB-LEDs plotted on the vertical axis, FIG. 13F has the light emission intensity of the blue element of the RGB-LEDs plotted on the vertical axis, FIG. 13G has the values of the output results of the light sensor plotted on the vertical axis, and FIG. 13H has the output of the temperature sensor 6 plotted on the vertical axis.

In the present embodiment, as shown in FIGS. 13A through 13G, a regular display is maintained prior to time t1, and the control circuit 201 therefore controls the light source drive circuit 202 so that a specific electric current is supplied to the RGB-LEDs 51. As a result, the red, green, and blue light-emitting elements of the RGB-LEDs emit light with a specific intensity. The output values of the temperature sensor are within the range of the dashed lines prior to time t1 as shown in FIG. 13H, and this range is established at the beginning.

Figures 13A, 13B, 13C, 13D, 13E, 13F, 13G, 13H:
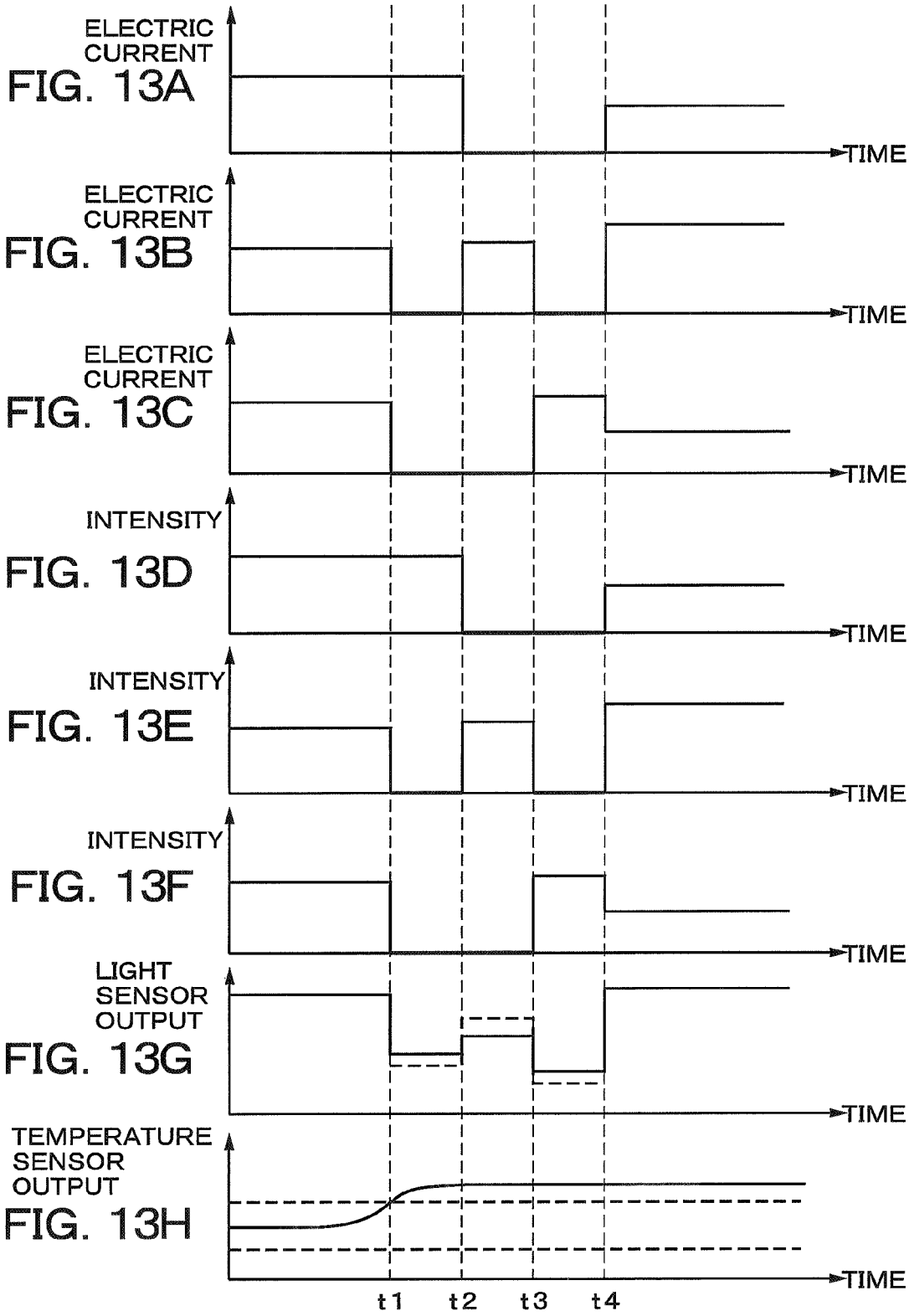
FIGS. 13A through 13H are timing charts showing the hue correction operation of the light source apparatus according to the present embodiment, wherein time is plotted on the horizontal axis of each chart, FIG. 13A has the electric current supplied by the light source drive circuit to the red element of the RGB-LEDs plotted on the vertical axis, FIG. 13B has the electric current supplied by the light source drive circuit to the green element of the RGB-LEDs plotted on the vertical axis, FIG. 13C has the electric current supplied by the light source drive circuit to the blue element of the RGB-LEDs plotted on the vertical axis, FIG. 13D has the light emission intensity of the red element of the RGB-LEDs plotted on the vertical axis, FIG. 13E has the light emission intensity of the green element of the RGB-LEDs plotted on the vertical axis, FIG. 13F has the light emission intensity of the blue element of the RGB-LEDs plotted on the vertical axis, FIG. 13G has the values of the output results of the light sensor plotted on the vertical axis, and FIG. 13H has the output of the temperature sensor 6 plotted on the vertical axis.

At time t1, when the output values of the temperature sensor exceed the pre-established upper limit, as shown in FIG. 13H, the control circuit 201 initiates calibration in accordance with the fluctuation in the output values of the temperature sensor. The operation from this point on is identical to the first embodiment. Specifically, the control circuit 201 controls the light source drive circuit 202 so that only the red light-emitting element of the RGB-LEDs 51 emits light, and a specific electric current is supplied to the red light-emitting element. As a result, only the red light-emitting element is lighted, the light sensor 4 receives this light, and the results are outputted to the control circuit 201. The control circuit 201 compares these results with the reference data of the light sensor 4 that has been preset in advance, and controls the light source drive circuit. When calibration of the red light-emitting element is completed, the control circuit 201 continues to calibrate the green and blue light-emitting elements. Thus, even if the temperature suddenly changes while the device is being used, the light-emitting elements can be maintained in a specific state, and the hue of the light emitted by the light source apparatus can be maintained in a specific state. The operation and effects of the sixth embodiment are otherwise identical to the previously described first embodiment.

An example was described in which the output values of the temperature sensor were established in the beginning with an upper limit and a lower limit, but the present invention is not limited to this option alone. More values may be established in advance, and calibration may be performed when the output changes and exceeds these values. Temperature changes can thereby be handled more precisely.

Furthermore, the temperature sensor 6 is preferably disposed in proximity to the light source of the light source apparatus. Characteristic changes caused by the heat generated by the light source can thereby be handled more precisely.

Also, an example was described in which calibration was started in the present embodiment immediately after the output values of the temperature sensor had deviated from a specific range, but the present invention is not limited to this option alone. Another option is for calibration to be performed so as to time with a specific event that takes place after such temperature sensor output deviation is detected. Specifically, a counter for checking the output state of the temperature sensor may be provided, and the control circuit may set this counter when there is a deviation in the output of the temperature sensor. Next, the control circuit may confirm the counter when the menu is retrieved or when another such specific event takes place, and calibration may be performed if the counter is in the set state. It is thereby possible to prevent calibrations to be performed in a compulsory manner together with temperature changes, and to reduce the discomfort experienced by the user.

The temperature sensor may be formed from an amorphous silicon layer used as a semiconductor layer of thin-film transistors that constitute the pixels of the transmissive liquid crystal display panel. The temperature sensor can thereby be integrated with the display panel, and not only can the device be made smaller and thinner, but costs can also be lowered because there is no need to provide a separate temperature sensor. In such cases; i.e., in cases in which a temperature sensor is formed on the transmissive liquid crystal display panel, the temperature sensor is preferably formed on the display panel in closer proximity to the light source. It is thereby possible for the temperature sensor to more accurately sense the state of the light source being controlled. The light source is also usually disposed so as to correspond to the area in which the terminals of the display panel are formed. This is because setting a large distance from the light source to the display area makes it possible to reduce nonuniformities in light quantity that result from the placement of the light source. Specifically, the temperature sensor is preferably formed on the frame of the display panel, in the area in which the terminals are disposed. This area is a portion in the display panel where there is extra space for placing circuits that have no close relationship to display, so a degree of freedom can be ensured for appropriately placing the temperature sensor. As described above, forming the temperature sensor on the frame of the display panel where the terminals are disposed makes it possible to improve the sensing performance, to reduce nonuniformities in the light source apparatus, to reduce the size and thickness of the device, and to lower costs. The temperature sensor may also be composed of an IC chip instead of being formed from a thin-film transistor. The COG (chip on glass) method is used for this IC chip, whereby the IC chip may be mounted on the frame where the terminals are disposed.

In the present embodiment, the control circuit for controlling a light source is configured so as to be capable of using the output information of a temperature sensor to control the operation of calibrating the light source, as previously described. Specifically, the characteristics of the configuration of the present embodiment are essentially that an external sensor is provided, and the information outputted by this external sensor is used to control the calibrating operation. The temperature sensor is one example of a sensor that merely illustrates one example of sensing, and other configurations can also be applied.

Other possible examples of such sensing include sensing with the use of an acceleration sensor or an impact sensor. Specifically, the control circuit is configured so that the output information of an acceleration sensor is used to control the operation of calibrating a light source. The light source is then calibrated when it is detected that the acceleration is equal to or greater than a specified acceleration. When acceleration is high, it is extremely unlikely that the user can focus on the display. For example, the display apparatus may be moving rapidly, falling, or being jostled. When the user is in circumstances involving high acceleration, it is highly unlikely that the user can focus on the display even if the position of the display apparatus in relation to the user does not change. Performing calibration in such circumstances can reduce the likelihood that the user will be aware of the calibrating operation, and it is possible to reduce calibration-induced discomfort experienced by the user. Specifically, a sensor can be appropriately applied in the same manner if the sensor detects information that makes it possible to conclude that the user is unable to focus on the device. Furthermore, a sensor that observes state changes of a specified value or greater in the terminal apparatus can also be similarly applied.

Similarly, it is effective to include a gravity sensor to detect changes in the alignment direction of the terminal apparatus. Specifically, the calibrating operation is performed in cases such as those in which the user cannot view the display in the regular direction, those in which the screen is, e.g., upside-down, and the like. Also, a sensor for detecting the placement of the display apparatus may be provided in cases in which the display apparatus can rotate or vary in direction in relation to the terminal apparatus in some other manner. For example, the display apparatus may be capable of both longitudinal and transverse rotation, and the rotation of the screen is detected and calibration performed in cases in which the user can rotate the screen in accordance with the displayed content. Discomfort can be reduced even when the calibrating operation is performed while the screen is being rotated, because the user is not focusing on the display screen. An example of a case in which the trigger is a change in the placement of the display apparatus in relation to the terminal apparatus is a folding terminal apparatus or notebook computer, referred to as a clamshell model, wherein the display screen can be opened and closed. Since a clamshell terminal apparatus is usually already provided with a sensor for detecting the folded state, an output signal from the sensor can be used as the trigger for calibration, the device can be reduced in size, and costs can be lowered. Similarly, in cases in which the display apparatus is capable of sliding in relation to the terminal apparatus, a sensor is provided for detecting this sliding action, and the sliding action detected by this sensor can be used as a trigger for the calibrating operation. Unlike a clamshell terminal apparatus, a terminal apparatus provided with this sliding mechanism allows the user to view the display screen anytime. Therefore, the brightness of the screen can be immediately reduced in response to sliding, and other timely responses to user's actions can be provided by performing calibration in synchronization with the sliding action. The interactive feel can be improved and enhanced user satisfaction can be obtained.

Other suitable examples whereby the interactive feel can be improved include vending machines, cash dispensers, kiosk terminal apparatuses, and the like, wherein the trigger is the insertion of coins or bills. Specifically, the user performs any kind of act on the terminal apparatus and the calibrating operation is performed as part of the response, whereby the user can be provided with a clear sensation that there is a response to their actions.

With a video camera or a digital still camera, the trigger can be the attachment or removal of a tape, memory, or other such storage media, or the attachment of an external lens.

Another method is to provide a pressure sensor and to make it possible to detect that the user is holding the display apparatus or terminal apparatus. Specifically, the control circuit may be configured so as to use output information from the pressure sensor to be able to control the operation of calibrating the light source. When the detection results of the pressure sensor change, the reason may be that the user is holding the device differently, and the calibrating operation is performed. The user often cannot be focusing on the display screen when holding the device differently. This is possibly because even if the user were focusing on the screen and the screen state were changed somewhat when the device is held differently, the user would think that this change is the result of the way in which the apparatus is held, and would experience less discomfort. This type of pressure sensor is preferably disposed at a location where the hand of the user comes into contact with the device when the user is holding the device, and even more preferably at a location of contact with the fingers or another such part that has a large effect on the way in which the apparatus is held. It is thereby possible to more reliably detect when the user holds the device differently, and to enhance the effects of the present invention.

Another method is to provide a sensor for detecting the presence of the user, and to make it possible to detect that the user is viewing the display screen. Specifically, the control circuit may be configured so that the output information from the user-detecting sensor is used and calibration of the light source is controlled. A suitable example of such a sensor is one that uses a camera to detect the presence of the user. In the case of a stationary device, other possibilities include a brightness sensor for detecting changes in brightness due to the user being positioned in front of the device, or a sensor for detecting that a user is sitting in a chair placed in front of the device. The calibrating operation is then performed when the user is not present or when the user begins to view the display screen. The user is thereby prevented from becoming aware of the calibrating operation, and it therefore is possible to reduce calibration-induced discomfort experienced by the user. In cases in which a camera is used as the sensor, it is preferable that the user's face be recognized, and it is even more preferable that it be possible to determine the user's line of sight to detect that the user is not focusing on the screen. Furthermore, it is preferable to detect when the user blinks and to perform the calibrating operation in synchronization with such blinking. It is thereby possible to perform the calibrating operation so that the user is not aware of the operation, and the number of times the calibrating operation is performed can therefore be dramatically increased, which improves precision.

Another possibility is to provide a sensor for detecting the state of the power source of the terminal apparatus, and to perform calibration by using the detection results. In one example, the terminal apparatus may be powered by a battery, and the calibrating operation may be performed when the terminal apparatus is switched between battery power and external power. It is possible to reduce discomfort experienced by the user because the user can be made to believe that the calibrating operation is a fluctuation in the display caused by changes in the state of the power source. Actual changes in the state of the power source cause the voltage of the power source to fluctuate somewhat, and the effects of such fluctuations can therefore be reduced to make control more precise.

An external light sensor may be provided as a device for sensing the external environment. Examples of abrupt changes in the external light include suddenly entering a bright place from a dark place, turning external lighting on or off, and the position of the sun changing due to a vehicle equipped with the device suddenly turning a corner. Thus, the human eye cannot quickly adapt to sudden changes in external light conditions, making it impossible to perceive the calibrating operation. It can thereby be made possible to prevent the user from becoming aware of the calibrating operation.

Figure 14:
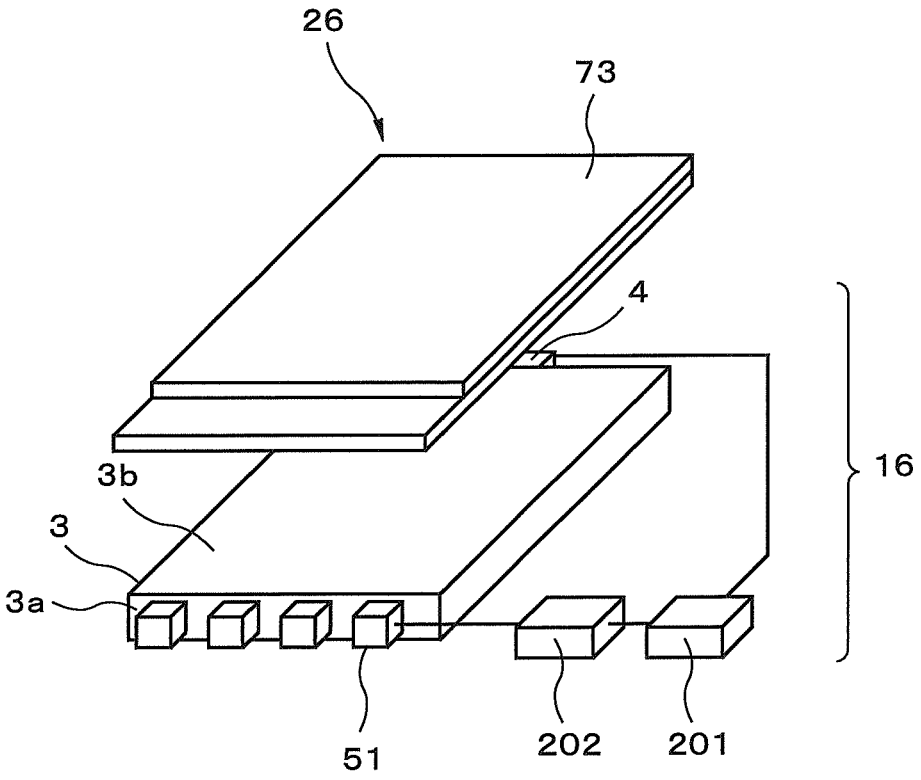
FIG. 14 is a perspective view showing the display apparatus according to the seventh embodiment of the present invention.
Figures 15A, 15B, 15C, 15D, 15E, 15F, 15G:
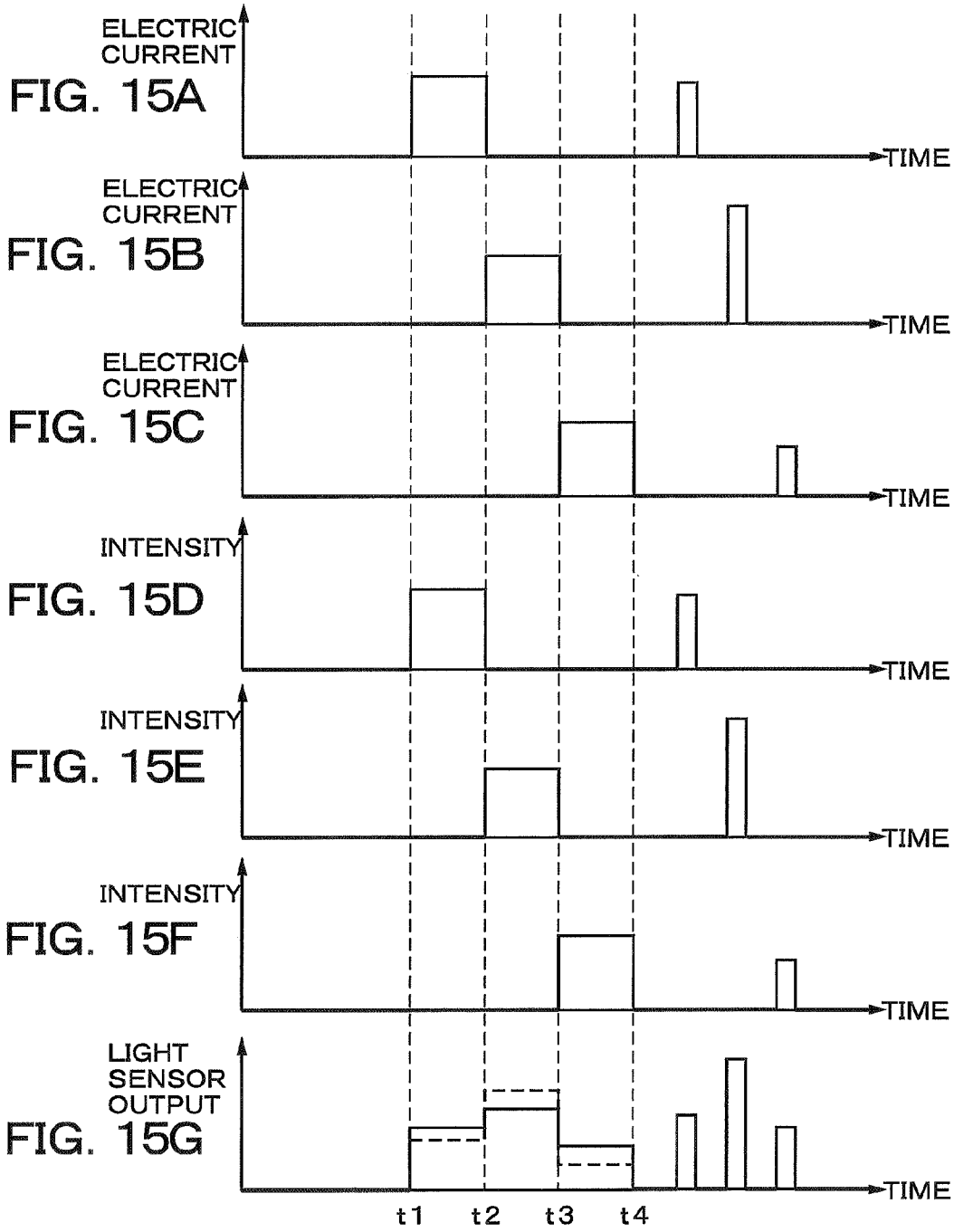
FIGS. 15A through 15G are timing charts showing the hue correction operation of the light source apparatus according to the present embodiment, wherein time is plotted on the horizontal axis of each chart, FIG. 15A has the electric current sent to the red element of the RGB-LEDs by the light source drive circuit plotted on the vertical axis, FIG. 15B has the electric current sent to the green element of the RGB-LEDs by the light source drive circuit plotted on the vertical axis, FIG. 15C has the electric current sent to the blue element of the RGB-LEDs by the light source drive circuit plotted on the vertical axis, FIG. 15D has the light emission intensity of the red element of the RGB-LEDs plotted on the vertical axis, FIG. 15E has the light emission intensity of the green element of the RGB-LEDs plotted on the vertical axis, FIG. 15F has the light emission intensity of the blue element of the RGB-LEDs plotted on the vertical axis, and FIG. 15G has values of the output results of the light sensor plotted on the vertical axis.
Figures 16A, 16B, 16C, 16D, 16E, 16F, 16G:
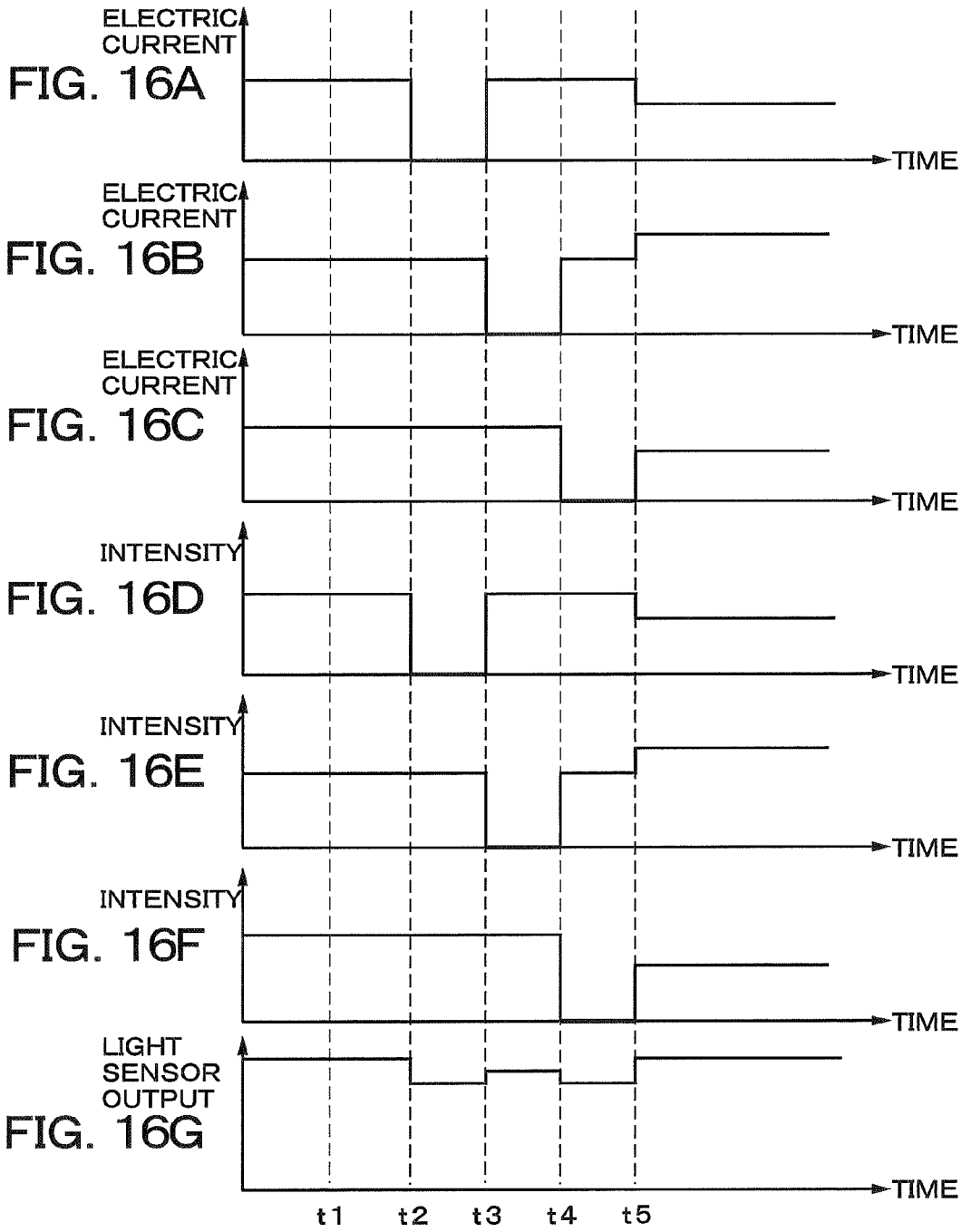
FIGS. 16A through 16G are timing charts showing the hue correction operation of the light source apparatus according to the present embodiment, wherein time is plotted on the horizontal axis of each chart, FIG. 16A has the electric current sent to the red element of the RGB-LEDs by the light source drive circuit plotted on the vertical axis, FIG. 16B has the electric current sent to the green element of the RGB-LEDs by the light source drive circuit plotted on the vertical axis, FIG. 16C has the electric current sent to the blue element of the RGB-LEDs by the light source drive circuit plotted on the vertical axis, FIG. 16D has the light emission intensity of the red element of the RGB-LEDs plotted on the vertical axis, FIG. 16E has the light emission intensity of the green element of the RGB-LEDs plotted on the vertical axis, FIG. 16F has the light emission intensity of the blue element of the RGB-LEDs plotted on the vertical axis, and FIG. 16G has values of the output results of the light sensor plotted on the vertical axis.

Next, the seventh embodiment of the present invention will be described. FIG. 14 is a perspective view showing the display apparatus according to the present embodiment. A light source apparatus 16 and display apparatus 26 according to the seventh embodiment employ a transmissive liquid crystal display panel 73 instead of the transmissive liquid crystal display panel 7 used by the display apparatus 1 and light source apparatus 2 in the third embodiment, as shown in FIG. 14. The transmissive liquid crystal display panel 73 has a color filter as a constituent element, and displays colors by synchronizing with a light source that flickers at high speed between red, green, and blue colors, and displays the image of each color component in a time sequential fashion. The configuration of the present embodiment is otherwise identical to the first embodiment described above.

Next, the operation of the display apparatus according to the present embodiment configured in the manner described above, i.e., the method for controlling the light source apparatus according to the present embodiment will be described. FIGS. 15A to 15G are timing charts showing the hue correction operation of the light source apparatus according to the present embodiment, wherein time is plotted along the horizontal axis of each chart, FIG. 15A has the electric current that the light source drive circuit has sent to the red element of the RGB-LEDs plotted on the vertical axis, FIG. 15B has the electric current that the light source drive circuit has sent to the green element of the RGB-LEDs plotted on the vertical axis, FIG. 15C has the electric current that the light source drive circuit has sent to the blue element of the RGB-LEDs plotted on the vertical axis, FIG. 15D has the light-emitting intensity of the red element of the RGB-LEDs plotted on the vertical axis, FIG. 15E has the light-emitting intensity of the green element of the RGB-LEDs plotted on the vertical axis, FIG. 15F has the light-emitting intensity of the blue element of the RGB-LEDs plotted on the vertical axis, and FIG. 15G has the values of the output results of the light sensor plotted on the vertical axis.

In the present embodiment, the light source calibration operation is the same as that of the present embodiment described above, but the operation of the light source is different at time t4 and thereafter when the calibration operation is completed, as shown in FIGS. 15A to 15G. Specifically, at time t4 and thereafter, the red, green, and blue light-emitting elements of the RGB-LED emit light in a sequence of short time periods. A configuration is featured in the present embodiment in which power is switched on or another prescribed operation is triggered, as described in the first embodiment above.

In the present embodiment, the light-emitting intensities during calibration from time t1 to t4 may be set to less than the peak intensities of the light-emitting elements during display at time t4 and thereafter. The product of the emission time and the intensity of the colors during calibration are preferably set to less than the product of the emission time and the intensity of the colors during display. Since the quantity of light during calibration can thereby be reduced, discomfort experienced by the user can be reduced during calibration. The operation and effects of the seventh embodiment are otherwise identical to the first embodiment previously described.

Next, the eighth embodiment of the present invention will be described. The configuration of the light source apparatus and display apparatus of the eighth embodiment is identical to the light source apparatus 1 and display apparatus 2 of the first embodiment described above. However, the operation of the display apparatus, i.e., the method for controlling the light source apparatus according to the present embodiment is different. FIGS. 16A to 16G are timing charts showing the hue correction operation of the light source apparatus according to the present embodiment, wherein time is plotted along the horizontal axis of each chart, FIG. 16A has the electric current that the light source drive circuit has sent to the red element of the RGB-LEDs plotted on the vertical axis, FIG. 16B has the electric current that the light source drive circuit has sent to the green element of the RGB-LEDs plotted on the vertical axis, FIG. 16C has the electric current that the light source drive circuit has sent to the blue element of the RGB-LEDs plotted on the vertical axis, FIG. 16D has the light-emitting intensity of the red element of the RGB-LEDs plotted on the vertical axis, FIG. 16E has the light-emitting intensity of the green element of the RGB-LEDs plotted on the vertical axis, FIG. 16F has the light-emitting intensity of the blue element of the RGB-LEDs plotted on the vertical axis, and FIG. 16G has the values of the output results of the light sensor plotted on the vertical axis.

In the first embodiment described above, the calibration operation individually corrects the light-emitting elements in the sequence of red, green, and blue colors of the RGB-LED, whereas in the present embodiment, the light-emitting elements of each color are caused to emit light in unison to carry out calibration. Display is constantly carried out prior to time t1, as shown in FIGS. 16A to 16G, and the red, green, and blue light-emitting elements are constantly emitting light. When the calibration operation is started at time t1, the light-emitting elements of each color emit light in the time period between times t1 and t2 in the same state as prior to time t1, and the quantity of light during this time period is sensed by a light sensor. This sensor result is held in the control circuit. Next, the green and blue light-emitting elements are turned on and the red light-emitting element is turned off in the time period from t2 to t3. The light sensor senses the quantity of light in this time period and calculates the difference from the value sensed in the time period from t1 to t2. Since this value is the quantity of light emitted by the red light-emitting element, the control circuit compares the value of this difference and a reference value to control the light source drive circuit. In a similar manner, the red and blue light-emitting elements are turned on and the green light-emitting element is turned off in the time period from t3 to t4. The sensor result of the light sensor in this time period is subtracted from the sensor result in the time period from t1 to t2, whereby the quantity of light of the green light-emitting element can be calculated. The red and green light-emitting elements are turned on and the blue light-emitting element is turned off in the time period from t4 to t5, and the quantity of light of the green light-emitting element is computed from the sensor result.

In the present embodiment, the sensor result of the light sensor when the light-emitting element to be corrected is turned off is calculated from the sensor result of the light sensor when light is being emitted normally, and the effect of external light can therefore be removed. In other words, with the sensor result of the light sensor when light is being emitted normally and the sensor result of the light sensor when the light-emitting element to be corrected is turned off, the equivalent effect of external light can be considered and the effect of external light can be removed by subtracting both of these results. Furthermore, since only the light-emitting element to be corrected is turned off, discomfort experienced by the user in accompaniment with the calibration operation can be reduced because calibration can be performed in a state that is very approximate to that which occurs during display. Also, the effect of a higher level of noise can be reduced by reducing the quantity of light of the light source because the number of times that the light source is turned off is reduced during calibration. The operation and effects of the eighth embodiment are otherwise the same as in the first embodiment described above.

Figure 17:
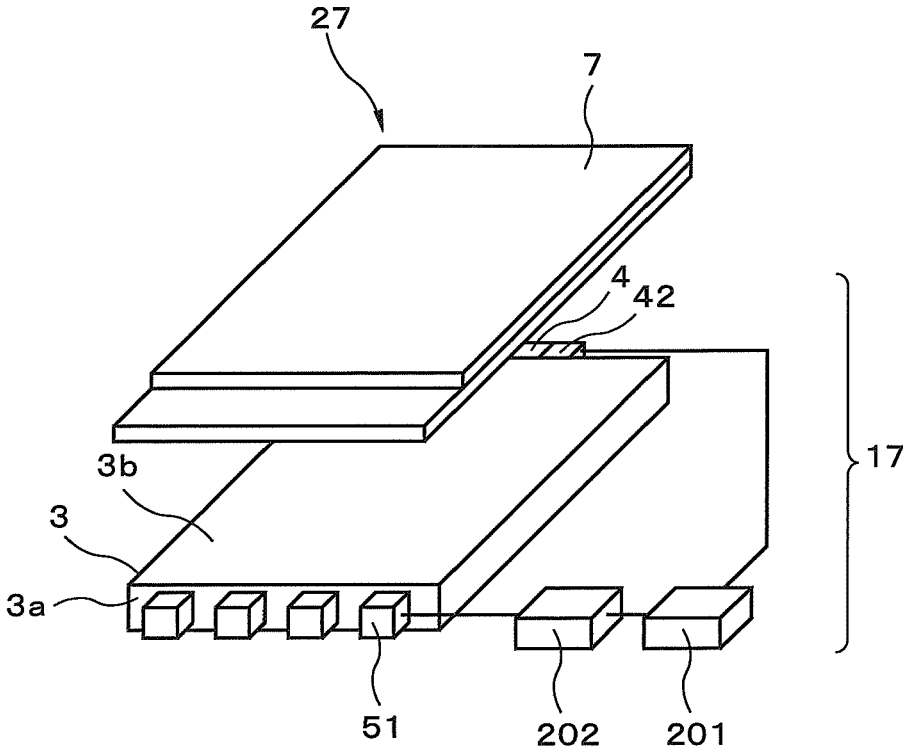
FIG. 17 is a perspective view showing the display apparatus according to the ninth embodiment of the present invention.

Next, the ninth embodiment of the present invention will be described. FIG. 17 is a perspective view showing a display apparatus according to the present embodiment. A light source apparatus 17 and display apparatus 27 according to the ninth embodiment differ from the display apparatus 2 and light source apparatus 1 according to the first embodiment described above in that a light sensor 42 is employed in addition to the light sensor 4, as shown in FIG. 17. The light sensor 4 used in the first embodiment of the present invention, as described above, can be applied to red, green, and blue wavelength bands in correspondence with a single type of spectrum of an RGB-LED as a light source. In view of this fact, in the present embodiment, the light sensor 4 will be referred to as a white light sensor for the sake of convenience. In contrast, light sensor 42 is a light sensor configured so as to have sensitivity only in the wavelength band of red light. The light sensor 42 will be referred to as a red light sensor. The red light sensor 42 can be applied, e.g., by disposing a red filter that transmits light in the wavelength band of red light in front of the white light sensor. A single white light sensor 4 and a single red light sensor 42 are disposed in the center area of the surface relative to the light incidence surface 3*a* of the light guide plate 3. The output information of the light sensors 4 and 42 is inputted to the control circuit 201. Specifically, the control circuit 201 uses the output information of the white light sensor 4 and the red light sensor 42 to calibrate the light source. The configuration of the present embodiment is otherwise identical to the first embodiment described above.

Next, the operation of the display apparatus according to the present embodiment configured in the manner described above, i.e., the light source apparatus according to the present embodiment will be described. FIGS. 18A to 18H are timing charts showing the hue correction operation of the light source apparatus according to the present embodiment, wherein time is plotted along the horizontal axis of each chart, FIG. 18A has the electric current that the light source drive circuit has sent to the red element of the RGB-LEDs plotted on the vertical axis, FIG. 18B has the electric current that the light source drive circuit has sent to the green element of the RGB-LEDs plotted on the vertical axis, FIG. 18C has the electric current that the light source drive circuit has sent to the blue element of the RGB-LEDs plotted on the vertical axis, FIG. 18D has the light-emitting intensity of the red element of the RGB-LEDs plotted on the vertical axis, FIG. 18E has the light-emitting intensity of the green element of the RGB-LEDs plotted on the vertical axis, FIG. 18F has the light-emitting intensity of the blue element of the RGB-LEDs plotted on the vertical axis, FIG. 18G has the values of the output results of the red light sensor plotted on the vertical axis, and FIG. 18H has the values of the output results of the white light sensor plotted on the vertical axis.

Figures 18A, 18B, 18C, 18D, 18E, 18F, 18G, 18H:
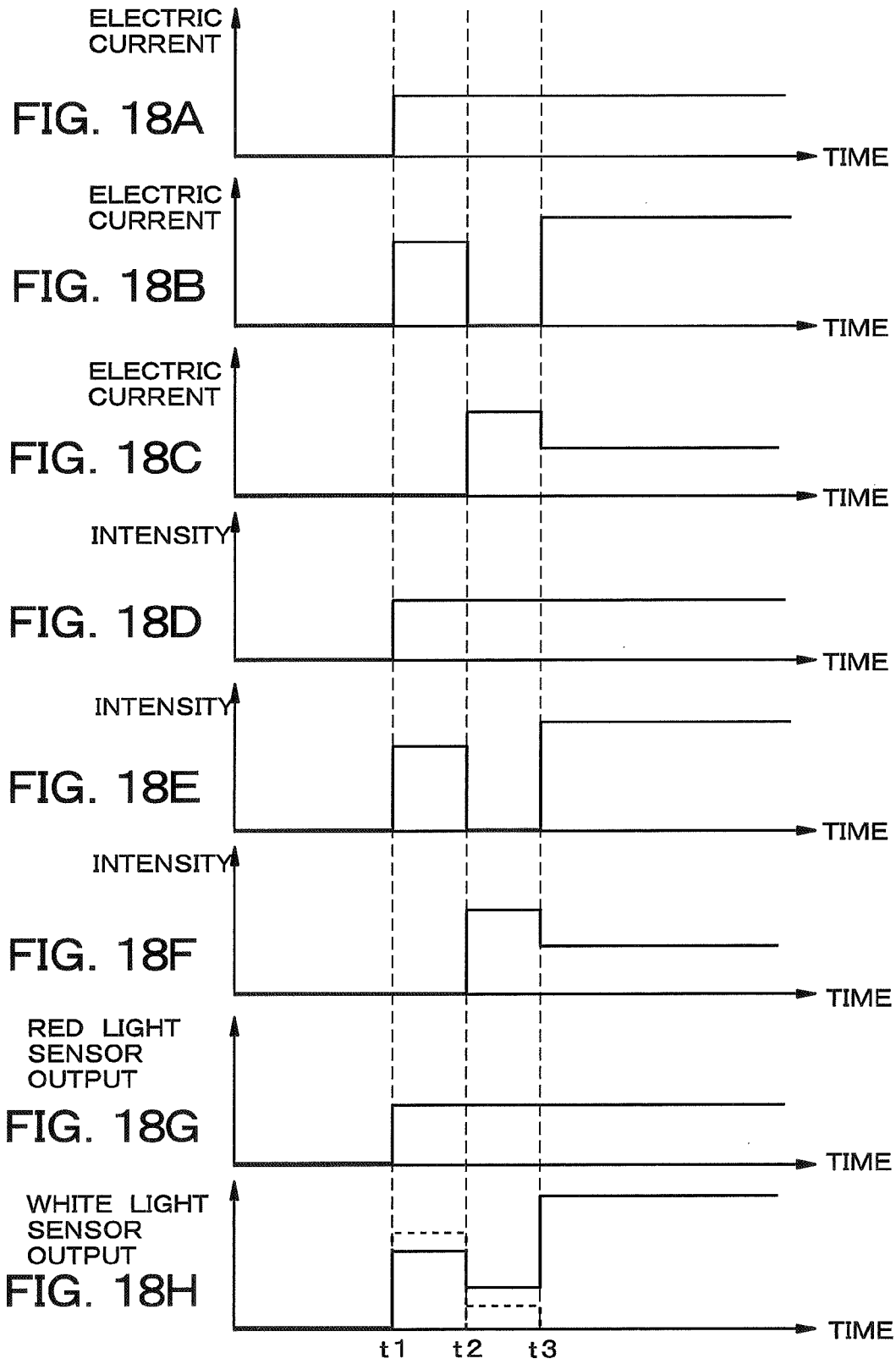
FIGS. 18A through 18H are timing charts showing the hue correction operation of the light source apparatus according to the present embodiment, wherein time is plotted on the horizontal axis of each chart, FIG. 18A has the electric current sent to the red element of the RGB-LEDs by the light source drive circuit plotted on the vertical axis, FIG. 18B has the electric current sent to the green element of the RGB-LEDs by the light source drive circuit plotted on the vertical axis, FIG. 18C has the electric current sent to the blue element of the RGB-LEDs by the light source drive circuit plotted on the vertical axis, FIG. 18D has the light emission intensity of the red element of the RGB-LEDs plotted on the vertical axis, FIG. 18E has the light emission intensity of the green element of the RGB-LEDs plotted on the vertical axis, FIG. 18F has the light emission intensity of the blue element of the RGB-LEDs plotted on the vertical axis, FIG. 18G has values of the output results of a red light sensor plotted on the vertical axis, and FIG. 18H has values of the output results of a white light sensor plotted on the vertical axis.

In the ninth embodiment, the light source apparatus is off prior to time t1, and the RGB-LED is turned off, as shown in FIG. 18. As a result, the output result of the light sensor is also substantially 0, as shown in FIGS. 18G and 18H. The light source is turned on at time t1. Specifically, when the control circuit 201 receives a command to change to an on state, the control circuit 201 simultaneously turns on the red and green light-emitting elements of the RBG-LED 51, as shown in FIGS. 18A to 18C. This time period is the time period from t1 to t2, and the initial value of the electric current is set in advance in the control circuit 201. This prescribed electric current flows to the red and green light-emitting elements, whereby the red and green light-emitting elements are turned on, as shown in FIGS. 18D to 18F. The red light sensor 42 receives the light of the red light-emitting element, as shown in FIG. 18G, and the results are outputted to the control circuit 201. The white light sensor 4 receives the light of the red and green light-emitting elements, as shown in FIG. 18H, and the results are outputted to the control circuit 201. The control circuit 201 uses the input from the red light sensor 42 to adjust the electric current that flows to the red element so that the red light-emitting element emits light that has a prescribed quantity of light. The red element is controlled by a constant feedback system that uses constant output from the red light sensor 42. At the same time, the control circuit 201 computes, e.g., the input from the red light sensor 42 and the white light sensor 4 to obtain the difference between the two to calculate the quantity of light of the green light-emitting element. The broken line shows the reference data of the light sensor 4 set in advance in the control circuit 201, i.e., the data indicating that the light sensor 4 should output when the green light-emitting element is turned on at an ideal intensity in the time period from t1 to t2. When the solid and broken lines diverge, the control circuit 201 determines that the light-emitting state of the green light-emitting element of the RBG-LED 51 has deviated from the reference state. Specifically, the control circuit 201 checks the result sensed by the light sensor 4 against the reference data, controls the light source drive circuit 202 so as to restrict the emission intensity when the sensor result is greater than the reference data, and controls the light source drive circuit 202 so that the emission intensity is increased when the output result is less than the reference data. When the sensor result is equal to the reference data, the light source drive circuit 202 is controlled so that the emission intensity is maintained at the current level. The emission intensity of the green light-emitting element is thereby calibrated to a reference state.

Next, when the calibration of the green light-emitting element is completed in time t2, the control circuit 201 sets the electric current that flows to the green light-emitting element to 0 and allows a prescribed electric current to flow to the blue light-emitting element. Only the blue light-emitting element is thereby turned on, and the blue light-emitting element is calibrated in the same manner as the green light-emitting element. This time period is from t2 to t3.

When the calibration of the RBG-LED 51 is completed in the time period from t1 to t3, the green and blue light-emitting elements are simultaneously turned on at time t3. In the present embodiment, the red light-emitting element is in a lighted state even in the time period from t1 to t3. The calibration results of the time period from t1 to t3 are used in the driving conditions of the light-emitting elements at time t3, as shown in FIGS. 18A to 18F. The hue of the light emitted by the light source apparatus can thereby be kept in a prescribed state because the light-emitting elements can be kept in a prescribed state.

In the present embodiment, two types of light sensors are used with three types of light-emitting elements, and two types of light-emitting elements are caused to flicker in a time sequential fashion, whereby the calibration operation of the light source is carried out. Since the types of light sensors can thereby be made fewer than the types of light sources, the cost and size of the light source apparatus can be reduced in comparison with a case in which the same number of types of light sources and light sensors are used. The time period in which the light source emits light in a time sequential fashion can be reduced by ⅔ in comparison with the first embodiment described above, and brightness can be reduced during sensing because two types of light sources are simultaneously caused to emit light. The user is thereby less likely to discern the calibration operation, and any discomfort that accompanies the calibration operation can be reduced. One of the two types of light sensors is used especially for one of the three types of light-emitting elements, and the red light-emitting element is selected. Generally, the green and blue light-emitting elements tend to have similar characteristics because these light-emitting elements can be composed of similar components. In contrast, since the red light-emitting element is composed of completely different components, the characteristics greatly differ, and in particular, the red light-emitting element loses stability more easily that the green or blue light-emitting element. In view of this situation, the red light-emitting element, which has significantly different characteristics, is subjected to constant feedback control, whereby the red light-emitting element can be controlled with high precision. The green and red light-emitting element can more stably operate than the red light-emitting element, and fluctuations in the characteristics of the two are similar. Therefore, a simple calibration operation can be used instead of constant feedback control. In this manner, high-performance control operations can be achieved together with reducing size and cost.

In the present embodiment, it was described that the red light-emitting element remains constantly lighted during the calibration operation of the green and blue light-emitting elements, but the present invention is not limited to this configuration, and the red light-emitting element may be turned off. In this case, the calibration operation is carried out by individual emission of green and blue colors. Therefore, the quantity of light is preferably increased and emitted in a greater amount than during ordinary operation. The calculations for controlling the green and blue light-emitting elements are not required because the red light-emitting element is not required. Therefore, the control circuit can be configured in a simpler manner. The operation and effects of the ninth embodiment are otherwise the same as in the first embodiment described above.

Figure 19:
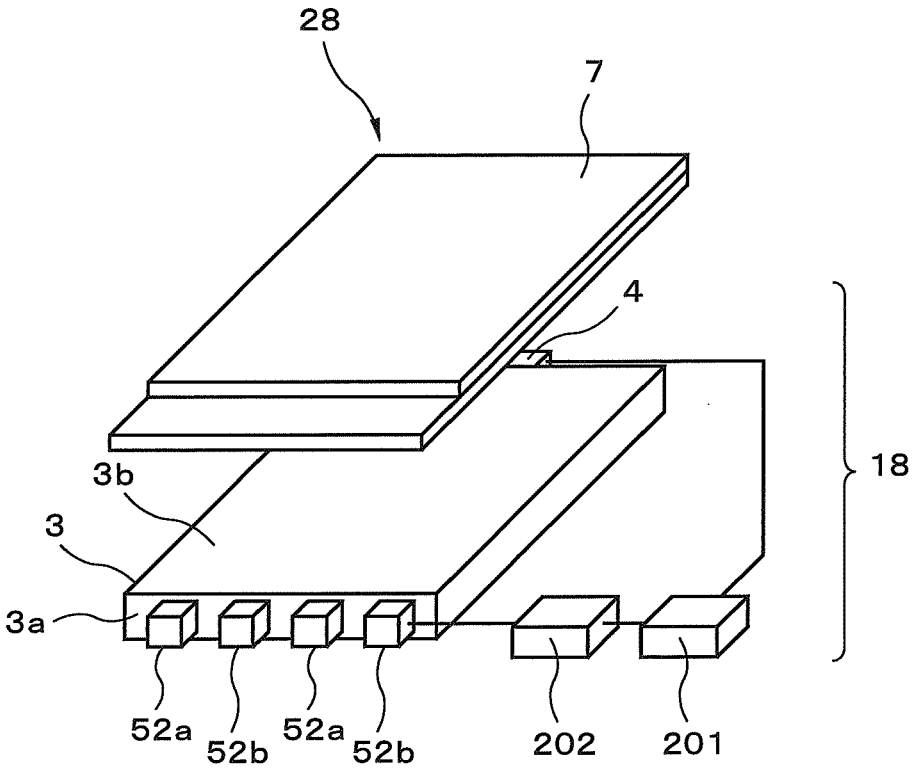
FIG. 19 is a perspective view showing the display apparatus according to the tenth embodiment of the present invention.

The tenth embodiment of the present invention is described next. FIG. 19 is a perspective view showing a display apparatus according to the present embodiment. A light source apparatus 18 and display apparatus 28 according to the tenth embodiment employ a different type of light source than the light source apparatus 1 and display apparatus 2 in the first embodiment described above, as shown in FIG. 19. Specifically, in the first embodiment described above, a RBG-LED having three colors, i.e., red, green, and blue light-emitting elements was used as the light source, but the present embodiment is different in that a BY-LED is used. A BY-LED is an LED composed of a blue light-emitting element and a yellow fluorescent body that emits yellow light using the blue light emitted by the blue light-emitting element, and that emits white light by using the blue and yellow light. This white LED has a slightly different hue even though it is a white light, because of the intensity of the yellow light emitted by the yellow fluorescent body and the luminosity of the blue light-emitting element. Specifically, when the blue light emitted by the blue light-emitting element and the yellow light emitted by the yellow fluorescent body are balanced, a white light is emitted. When the blue light emitted by the blue light-emitting element is more intense than the yellow light emitted by the yellow fluorescent body, a bluish-white light is emitted. In the present embodiment, two types of BY-LED having different hues are used. One type is a BY-LED 52*a* that emits a white light, and the other type is a BY-LED 52*b* that emits a bluish-white light. For example, the chromaticity coordinates of the xy color diagram of the white BY-LED 52*a* and the bluish-white BY-LED 52*b* are (x, y)=(0.32, 0.32) and (0.26 and 0.26), respectively. In other words, the BY-LED 52*a* is a white color having a slightly yellow hue. A plurality of these two types of BY-LEDs is disposed along the light incidence surface 3*a* of the light guide plate 3, and the number is two white BY-LEDs 52*a* and two blue BY-LED 52*b*, for example. The two types of BY-LEDs are alternately disposed so that different types are disposed next to each other. The light source drive circuit 202 is configured to be capable of independently driving the two types of BY-LEDs. The configuration of the present embodiment is otherwise identical to the first embodiment described above.

The following is a description of the operation of the display apparatus relating to the present embodiment configured as described above; i.e., the method for controlling the light source apparatus according to the present embodiment. FIGS. 20A through 20E are timing charts showing the hue correction operation of the light source apparatus according to the present embodiment, wherein time is plotted on the horizontal axis of each chart, FIG. 20A has the electric current that the light source drive circuit has sent to the white BY-LED plotted on the vertical axis, FIG. 20B has the electric current that the light source drive circuit has sent to the bluish-white BY-LED plotted on the vertical axis, FIG. 20C has the light-emitting intensity of the white BY-LED plotted on the vertical axis, FIG. 20D has the light-emitting intensity of the bluish-white BY-LED plotted on the vertical axis, and FIG. 20E has the values of the output results of the light sensor plotted on the vertical axis.

Figures 20A, 20B, 20C, 20D, 20E:
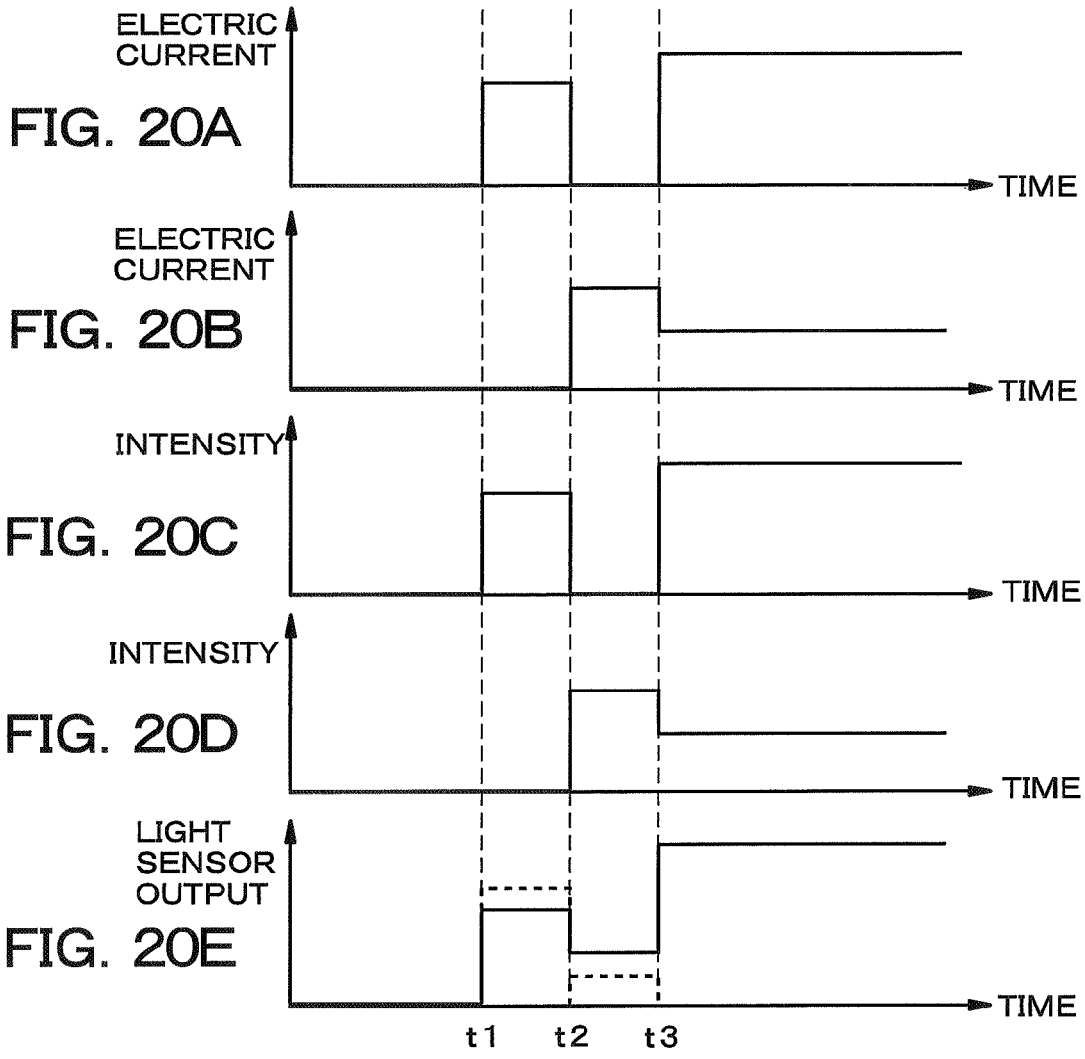
FIGS. 20A through 20E are timing charts showing the hue correction operation of the light source apparatus according to the present embodiment, wherein time is plotted on the horizontal axis of each chart, FIG. 20A has the electric current sent to the white BY-LED by the light source drive circuit plotted on the vertical axis, FIG. 20B has the electric current sent to the blue BY-LED by the light source drive circuit plotted on the vertical axis, FIG. 20C has the light emission intensity of the white BY-LED plotted on the vertical axis, FIG. 20D has the light emission intensity of the blue BY-LED plotted on the vertical axis, and FIG. 20E has values of the output results of the light sensor plotted on the vertical axis.
Figures 21A, 21B, 21C, 21D, 21E, 21F, 21G:
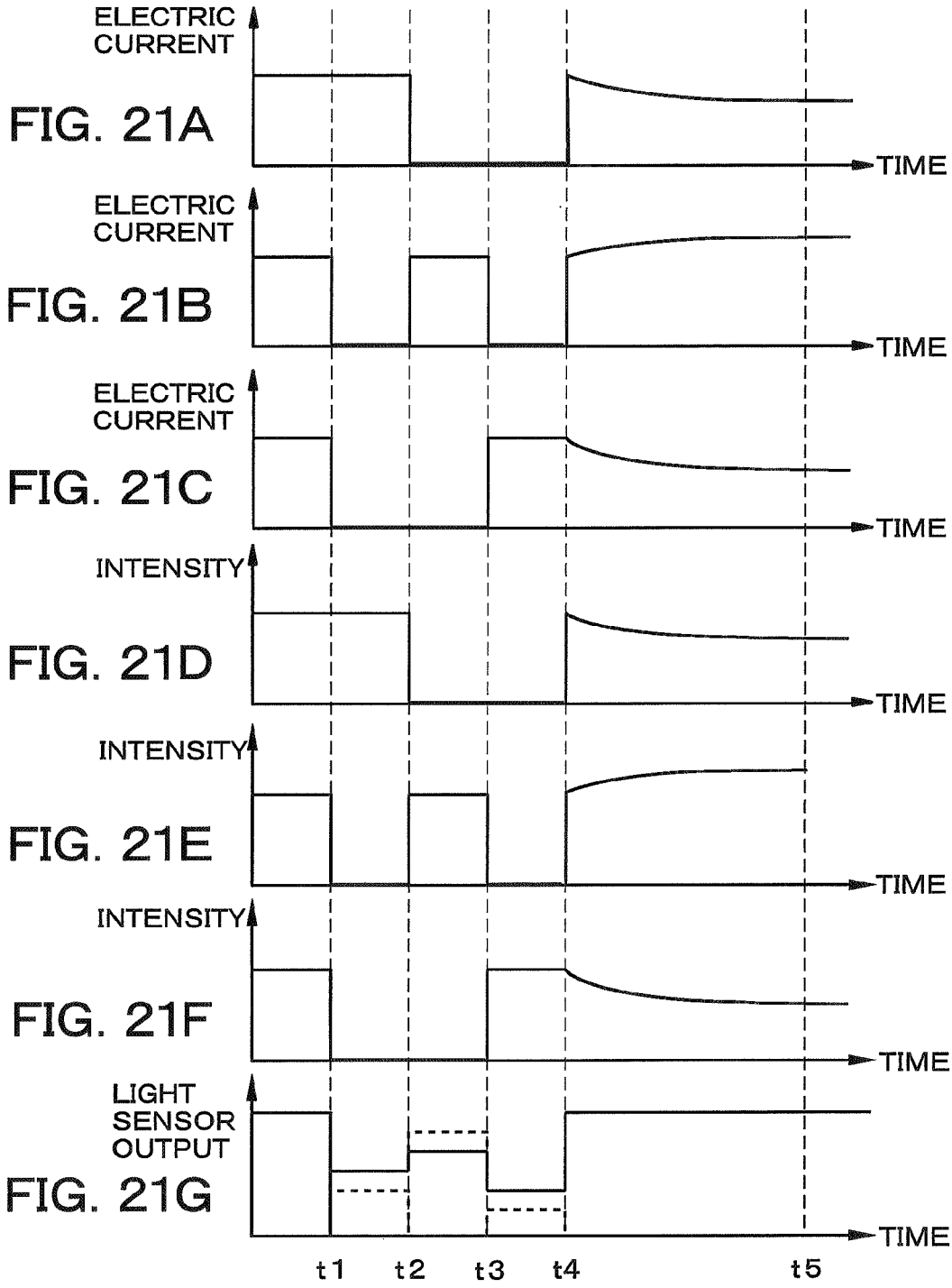
FIGS. 21A through 21G are timing charts showing the hue correction operation of the light source apparatus according to the present embodiment, wherein time is plotted on the horizontal axis of each chart, FIG. 21A has the electric current sent to the red element of the RGB-LEDs by the light source drive circuit plotted on the vertical axis, FIG. 21B has the electric current sent to the green element of the RGB-LEDs by the light source drive circuit plotted on the vertical axis, FIG. 21C has the electric current sent to the blue element of the RGB-LEDs by the light source drive circuit plotted on the vertical axis, FIG. 21D has the light emission intensity of the red element of the RGB-LEDs plotted on the vertical axis, FIG. 21E has the light emission intensity of the green element of the RGB-LEDs plotted on the vertical axis, FIG. 21F has the light emission intensity of the blue element of the RGB-LEDs plotted on the vertical axis, and FIG. 21G has values of the output results of the light sensor plotted on the vertical axis.

In the tenth embodiment, the light source apparatus is off prior to time t1, and the BYB-LED is turned off, as shown in FIG. 20. As a result, the output result of the light sensor is also substantially 0, as shown in FIG. 20E. The control circuit 201 turns on the white BY-LED 52*a* when the light source is turned on at time t1, as shown in FIGS. 20A and 20B. This time period is from t1 to t2, and the initial value of the electric current is set in advance in the control circuit 201. This prescribed electric current flows to the white BY-LED 52*a*, whereby the white BY-LED 52*a* is turned on, as shown in FIGS. 20C to 20D. The light sensor 4 receives the light of the white BY-LED 52*a*, as shown in FIG. 20E, and the results are outputted to the control circuit 201. The broken line shows the reference data of the light sensor 4 set in advance in the control circuit 201, i.e., the data indicating that the light sensor 4 should output when the white BY-LED 52*a* is lighted at an ideal intensity in the time period from t1 to t2. When the solid and broken lines diverge, the control circuit 201 determines that the light-emitting state of the white BY-LED 52*a* has deviated from the reference state. Specifically, the control circuit 201 checks the result sensed by the light sensor 4 against the reference data, controls the light source drive circuit 202 so as to restrict the emission intensity when the sensor result is greater than the reference data, and controls the light source drive circuit 202 so that the emission intensity is increased when the output result is less than the reference data. When the sensor result is equal to the reference data, the light source drive circuit 202 is controlled so that the emission intensity is maintained at the current level. The emission intensity of the white BY-LED 52*a* is thereby calibrated to a reference state.

Next, when the calibration of the white BY-LED 52*a* is completed in time t2, the control circuit 201 sets the electric current that flows to the white BY-LED 52*a* to 0, and allows a prescribed electric current to flow to the bluish-white BY-LED 52*b*. Only the bluish-white BY-LED 52*b* is thereby turned on, and the calibration of the bluish-white BY-LED 52*b* is calibrated in the same manner as the white BY-LED 52*a*. This time period is from t2 to t3.

When the calibration of the white BY-LED 52*a* and bluish-white BY-LED 52*b* is completed in the time period from t1 to t3, the white BY-LED 52*a* and bluish-white BY-LED 52*b* are simultaneously turned on at time t3. The calibration results of the time period from t1 to t3 are used in the driving conditions of the light-emitting elements at time t3, as shown in FIGS. 20A to 20E. The hue of the light emitted by the light source apparatus can thereby be kept in a prescribed state because the light-emitting elements can be kept in a prescribed state.

Featured in the present embodiment are two types of LED that have relatively similar spectra. In this manner, high precision calibration cannot be achieved using a method that uses a conventional color filter with a light source having a similar spectrum. This is due to the fact that the emission spectrum cannot be sufficiently separated by the color filter. In contrast, in the present invention, time sequential light emission is used, making high precision control possible even when light sources are used that have similar emission spectra. A possible case in which such high precision control would be required is one in which white hue is slightly adjusted in accordance with the service situation. With a fluorescent lamp that has a bluish-white light and a light bulb that has a yellow hue, for example, a user will notice a different hue even when the display apparatus displays the same white color. This is because the eye of the user has adapted to the surrounding lighting. In view of this situation, a bluish-white BY-LED is caused to emit light more intensely under fluorescent lighting to achieve a bluish-white display, and white BY-LED is caused to emit light more intensely under the lighting of a light bulb to achieve a white display having a yellow hue. The user can thereby discern that the same white color is being displayed. Another example of a need for high precision control is to respond to changes in a light source over time. In a BY-LED that uses a blue light-emitting element and a yellow fluorescent body, the emitted light develops a yellow hue when the BY-LED is used over a long period of time because the blue light-emitting element changes more significantly over time than the yellow fluorescent body does. In view of this situation, the same white light can be constantly displayed by changing the emission ratio together with changes over time.

The chromaticity coordinates of the LED in the present embodiment are merely an example, and an LED having other chromaticity coordinates may be used. Also, an LED was described in which a blue light-emitting element and a yellow fluorescent body were combined as a light source, but the present invention is not limited to this configuration. A cold-cathode tube can be used, for example. Application can also be made to a white LED of a type in which a blue light-emitting element and green and yellow fluorescent bodies are combined in an LED, and to a white LED of a type obtained by combining an ultraviolet light-emitting element and blue, green, and red fluorescent bodies. The emitted color of the LED is not limited to white, and application can also be made in the same manner to LEDs such as those in which a blue light-emitting element and a red fluorescent body are combined. Advantageous application can also be made to cases in which the BY-LED in the present embodiment and the RGB-LED in the first embodiment described above are combined. In general, a BY-LED has better power efficiency than an RGB-LED, and a lower power display that uses a BY-LED and a display having a wide chromatic range that uses an RGB-LED can therefore be switched and used in accordance with conditions. The operation and effects of the tenth embodiment are otherwise the same as in the first embodiment described above.

Next, the eleventh embodiment of the present invention will be described. The configuration of the light source apparatus and display apparatus of the eleventh embodiment is identical to the light source apparatus 1 and display apparatus 2 of the first embodiment described above. However, the method for controlling the light source apparatus is different. In view of the above, a description of the configuration of the eleventh embodiment is omitted and the operation of the display apparatus of the present embodiment, i.e., the method for controlling the light source of the present embodiment will be described. FIGS. 21A to 21G are timing charts showing the hue correction operation of the light source apparatus according to the present embodiment, wherein time is plotted along the horizontal axis of each chart, FIG. 21A has the electric current that the light source drive circuit has sent to the red element of the RGB-LEDs plotted on the vertical axis, FIG. 21B has the electric current that the light source drive circuit has sent to the green element of the RGB-LEDs plotted on the vertical axis, FIG. 21C has the electric current that the light source drive circuit has sent to the blue element of the RGB-LEDs plotted on the vertical axis, FIG. 21D has the light-emitting intensity of the red element of the RGB-LEDs plotted on the vertical axis, FIG. 21E has the light-emitting intensity of the green element of the RGB-LEDs plotted on the vertical axis, FIG. 21F has the light-emitting intensity of the blue element of the RGB-LEDs plotted on the vertical axis, and FIG. 21G has the values of the output results of the light sensor plotted on the vertical axis.

In the eleventh embodiment, the light source apparatus is off prior to time t1, an operation to sense the state of the light source is carried out in time period t1 to t4, and correction is carried out between times t4 and t5, as shown in FIG. 21. The detection operation in the time period from t1 to t4 is the same as in the first embodiment described above, and a description is therefore omitted. A feature of the present embodiment is that correction that is carried out in the period from t4 to t5. In the first embodiment described above, correction was carried out using the sensor results immediately after sensing was executed. Such control can be used at discontinuous points on the time axis, e.g., when the light source changes from an off state to an on state. However, when the control method of the first embodiment is used in cases in which the display content does not vary, the hue of the screen rapidly changes due to correction, and the user experiences discomfort. In view of this situation, a prescribed time constant is provided and correction operations are carried out so as to reduce discomfort experienced by the user caused by hue variation of the screen during correction operations. For example, the time period from t1 to t2, during which part of the detection operation is executed, is set to 16 ms, and the time period from t4 to t5, during which the correction operation is executed, is set to 10 seconds. Humans sensitively respond to rapid variations on the time axis, but are relatively insensitive to slow variations. In the present embodiment, since hue corrections are carried out over a long period of time, i.e., 10 seconds, the user does not notice correction operation, and discomfort caused by executing the control of the present invention can be reduced.

In order to reduce the discomfort caused by the control of the present invention, it is effective to temporally separate and execute the detection operation and the correction operations as an object of the present embodiment. Specifically, in the first embodiment described above and in the eleventh embodiment, correction was carried out using the sensor results immediately after the detection operation was executed in the time period from t1 to t4. However, in the present embodiment, for example, the state that existed prior to time t1 is applied for a period of time after the detection operation of the time period t1 to t4 has been completed. It is effective to execute the correction operation after a prescribed period of time has elapsed. The operation and effects of the eleventh embodiment are otherwise identical to the first embodiment described above.

Next, the twelfth embodiment of the present invention will be described. The configuration of the light source apparatus and display apparatus of the twelfth embodiment is identical to the light source apparatus 1 and display apparatus 2 of the eleventh embodiment described above. However, the method for controlling the light source apparatus is different. In view of the above, a description of the configuration of the twelfth embodiment is omitted and the operation of the display apparatus of the present embodiment, i.e., the method for controlling the light source of the present embodiment will be described. FIGS. 22A to 22G are timing charts showing the hue correction operation of the light source apparatus according to the present embodiment, wherein time is plotted along the horizontal axis of each chart, FIG. 22A has the electric current that the light source drive circuit has sent to the red element of the RGB-LEDs plotted on the vertical axis, FIG. 22B has the electric current that the light source drive circuit has sent to the green element of the RGB-LEDs plotted on the vertical axis, FIG. 22C has the electric current that the light source drive circuit has sent to the blue element of the RGB-LEDs plotted on the vertical axis, FIG. 22D has the light-emitting intensity of the red element of the RGB-LEDs plotted on the vertical axis, FIG. 22E has the light-emitting intensity of the green element of the RGB-LEDs plotted on the vertical axis, FIG. 22F has the light-emitting intensity of the blue element of the RGB-LEDs plotted on the vertical axis, and FIG. 22G has the values of the output results of the light sensor plotted on the vertical axis.

Figures 22A, 22B, 22C, 22D, 22E, 22F, 22G:
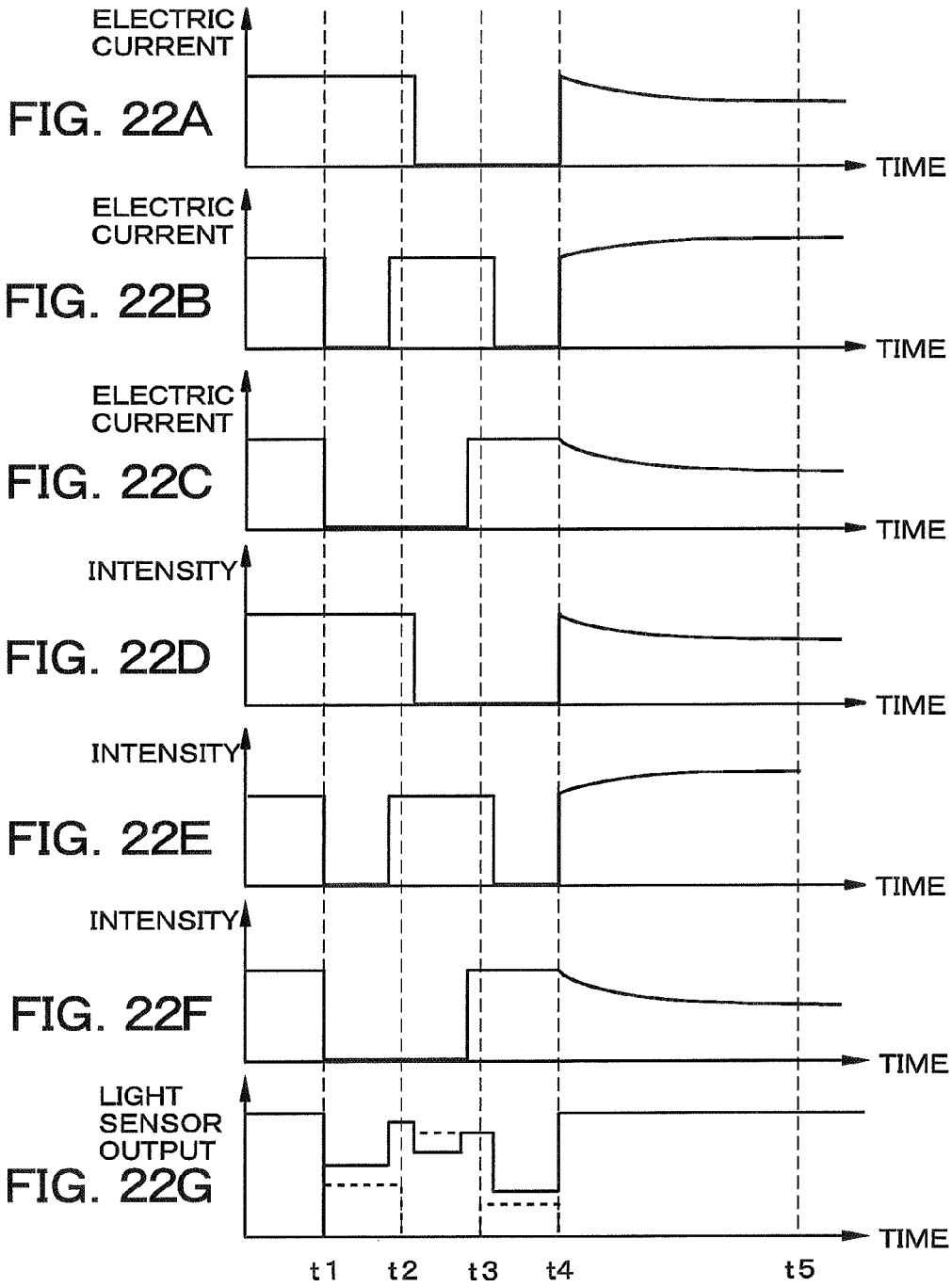
FIGS. 22A through 22G are timing charts showing the hue correction operation of the light source apparatus according to the present embodiment, wherein time is plotted on the horizontal axis of each chart, FIG. 22A has the electric current sent to the red element of the RGB-LEDs by the light source drive circuit plotted on the vertical axis, FIG. 22B has the electric current sent to the green element of the RGB-LEDs by the light source drive circuit plotted on the vertical axis, FIG. 22C has the electric current sent to the blue element of the RGB-LEDs by the light source drive circuit plotted on the vertical axis, FIG. 22D has the light emission intensity of the red element of the RGB-LEDs plotted on the vertical axis, FIG. 22E has the light emission intensity of the green element of the RGB-LEDs plotted on the vertical axis, FIG. 22F has the light emission intensity of the blue element of the RGB-LEDs plotted on the vertical axis, and FIG. 22G has values of the output results of the light sensor plotted on the vertical axis.
Figures 23A, 23B, 23C, 23D, 23E, 23F, 23G:
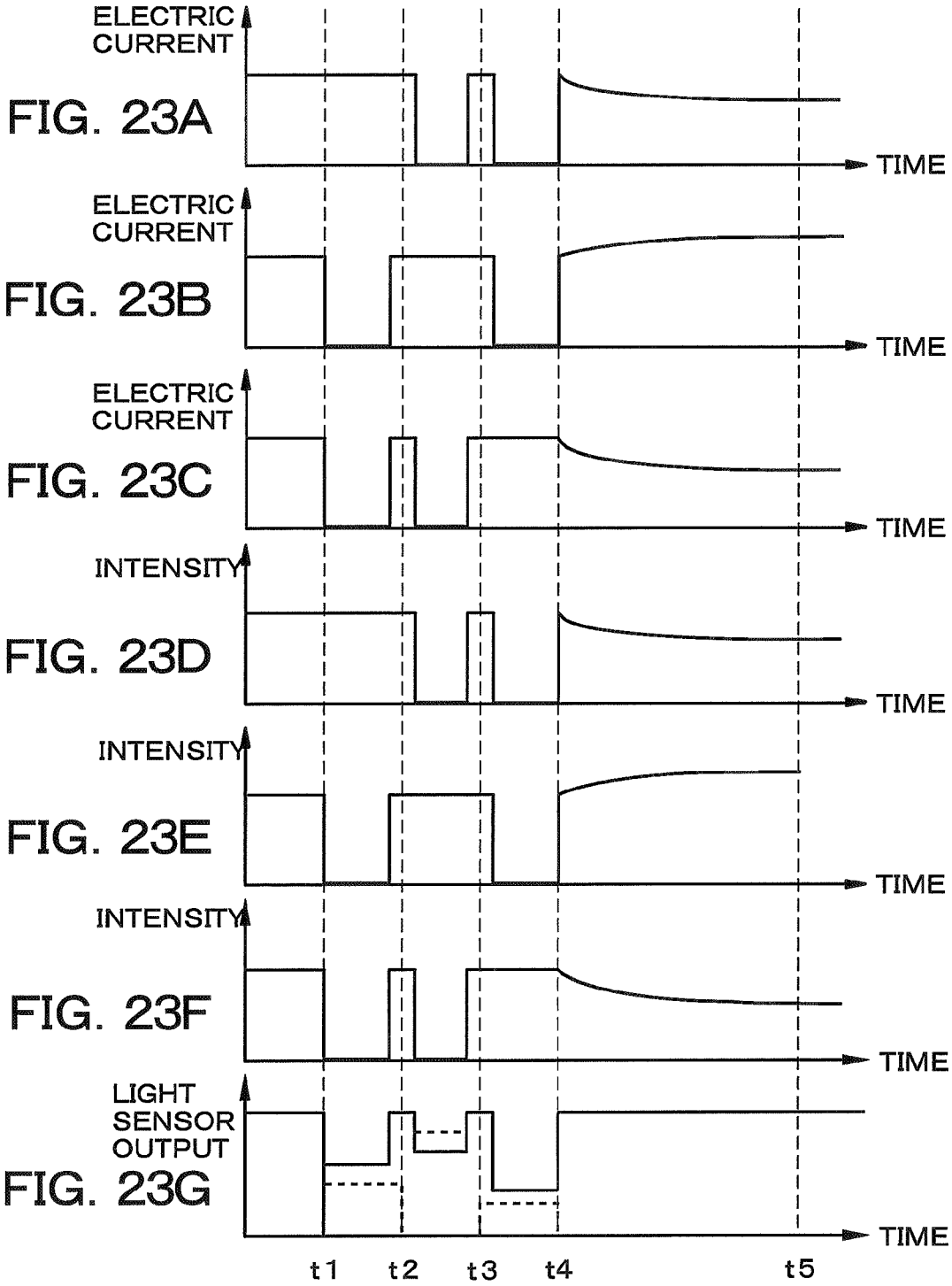
FIGS. 23A through 23G are timing charts showing the hue correction operation of the light source apparatus according to the present embodiment, wherein time is plotted on the horizontal axis of each chart, FIG. 23A has the electric current sent to the red element of the RGB-LEDs by the light source drive circuit plotted on the vertical axis, FIG. 23B has the electric current sent to the green element of the RGB-LEDs by the light source drive circuit plotted on the vertical axis, FIG. 23C has the electric current sent to the blue element of the RGB-LEDs by the light source drive circuit plotted on the vertical axis, FIG. 23D has the light emission intensity of the red element of the RGB-LEDs plotted on the vertical axis, FIG. 23E has the light emission intensity of the green element of the RGB-LEDs plotted on the vertical axis, FIG. 23F has the light emission intensity of the blue element of the RGB-LEDs plotted on the vertical axis, and FIG. 23G has values of the output results of the light sensor plotted on the vertical axis.
Figures 24A, 24B, 24C, 24D, 24E, 24F, 24G:
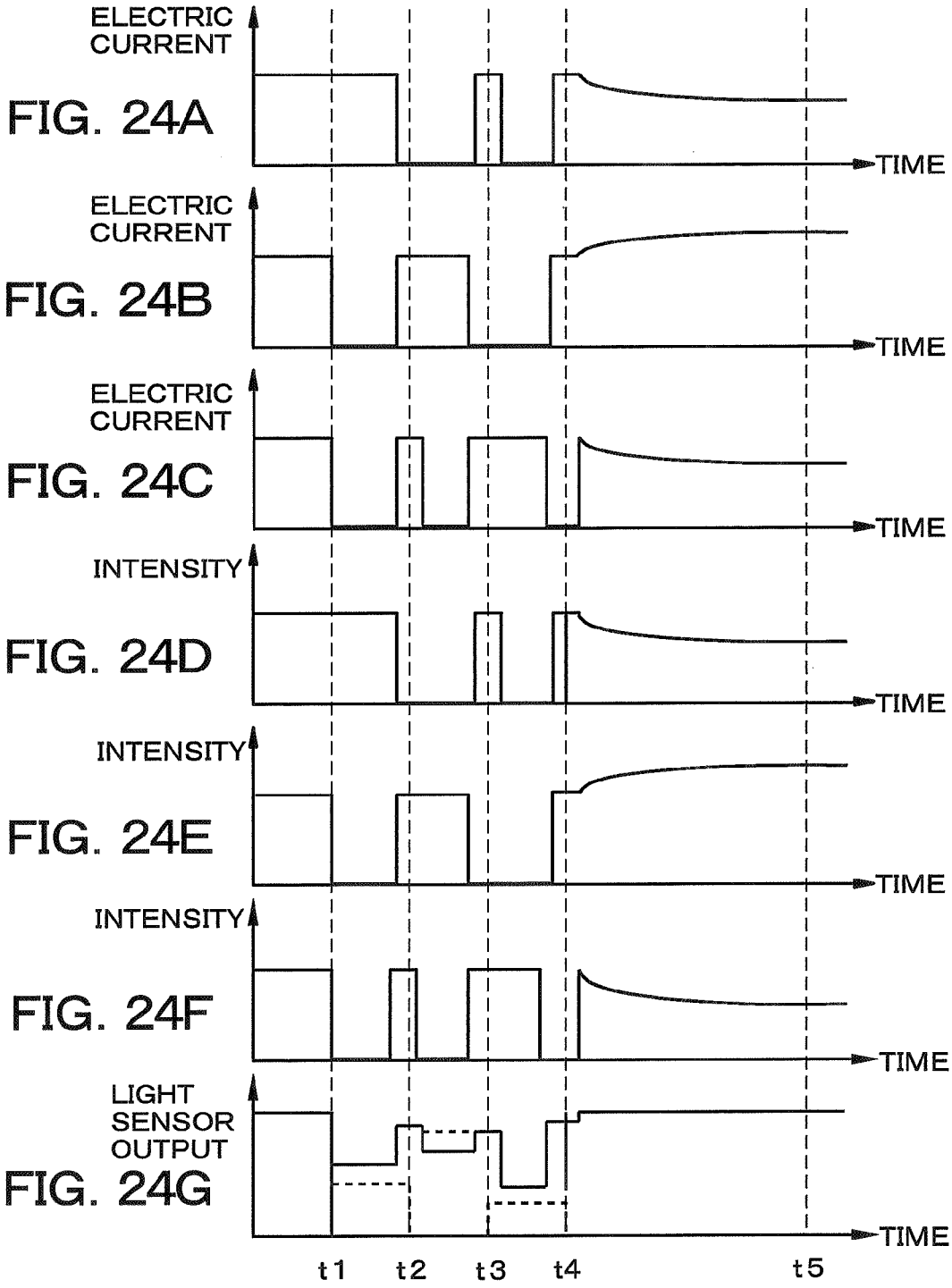
FIGS. 24A through 24G are timing charts showing the hue correction operation of the light source apparatus according to the present embodiment, wherein time is plotted on the horizontal axis of each chart, FIG. 24A has the electric current sent to the red element of the RGB-LEDs by the light source drive circuit plotted on the vertical axis, FIG. 24B has the electric current sent to the green element of the RGB-LEDs by the light source drive circuit plotted on the vertical axis, FIG. 24C has the electric current sent to the blue element of the RGB-LEDs by the light source drive circuit plotted on the vertical axis, FIG. 24D has the light emission intensity of the red element of the RGB-LEDs plotted on the vertical axis, FIG. 24E has the light emission intensity of the green element of the RGB-LEDs plotted on the vertical axis, FIG. 24F has the light emission intensity of the blue element of the RGB-LEDs plotted on the vertical axis, and FIG. 24G has values of the output results of the light sensor plotted on the vertical axis.
Figures 25A, 25B, 25C, 25D, 25E, 25F, 25G:
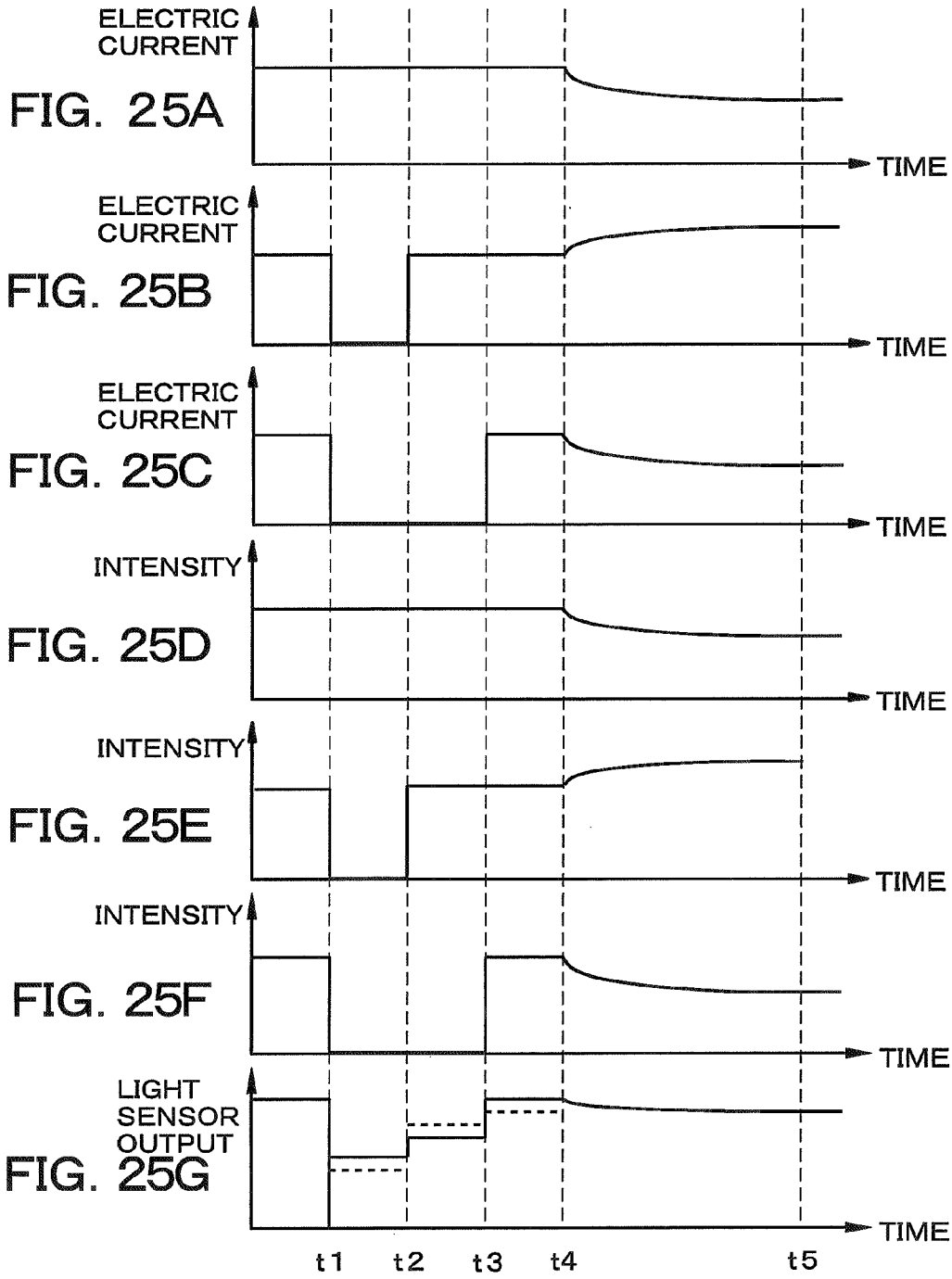
FIGS. 25A through 25G are timing charts showing the hue correction operation of the light source apparatus according to the present embodiment, wherein time is plotted on the horizontal axis of each chart, FIG. 25A has the electric current sent to the red element of the RGB-LEDs by the light source drive circuit plotted on the vertical axis, FIG. 25B has the electric current sent to the green element of the RGB-LEDs by the light source drive circuit plotted on the vertical axis, FIG. 25C has the electric current sent to the blue element of the RGB-LEDs by the light source drive circuit plotted on the vertical axis, FIG. 25D has the light emission intensity of the red element of the RGB-LEDs plotted on the vertical axis, FIG. 25E has the light emission intensity of the green element of the RGB-LEDs plotted on the vertical axis, FIG. 25F has the light emission intensity of the blue element of the RGB-LEDs plotted on the vertical axis, and FIG. 25G has values of the output results of the light sensor plotted on the vertical axis.
Figures 26A, 26B, 26C, 26D, 26E, 26F, 26G:
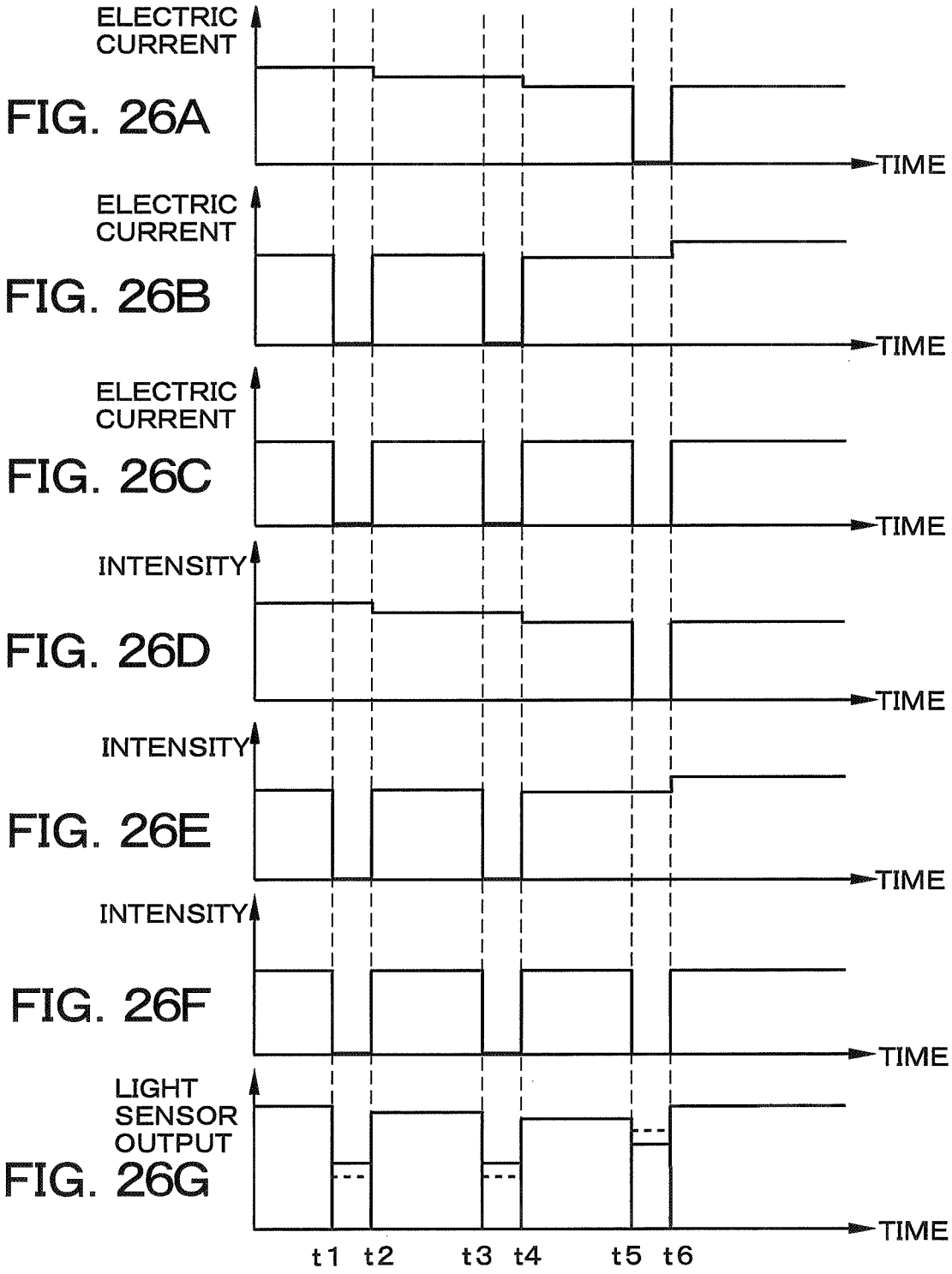
FIGS. 26A through 26G are timing charts showing the hue correction operation of the light source apparatus according to the present embodiment, wherein time is plotted on the horizontal axis of each chart, FIG. 26A has the electric current sent to the red element of the RGB-LEDs by the light source drive circuit plotted on the vertical axis, FIG. 26B has the electric current sent to the green element of the RGB-LEDs by the light source drive circuit plotted on the vertical axis, FIG. 26C has the electric current sent to the blue element of the RGB-LEDs by the light source drive circuit plotted on the vertical axis, FIG. 26D has the light emission intensity of the red element of the RGB-LEDs plotted on the vertical axis, FIG. 26E has the light emission intensity of the green element of the RGB-LEDs plotted on the vertical axis, FIG. 26F has the light emission intensity of the blue element of the RGB-LEDs plotted on the vertical axis, and FIG. 26G has values of the output results of the light sensor plotted on the vertical axis.
Figures 27A, 27B, 27C, 27D, 27E, 27F, 27G:
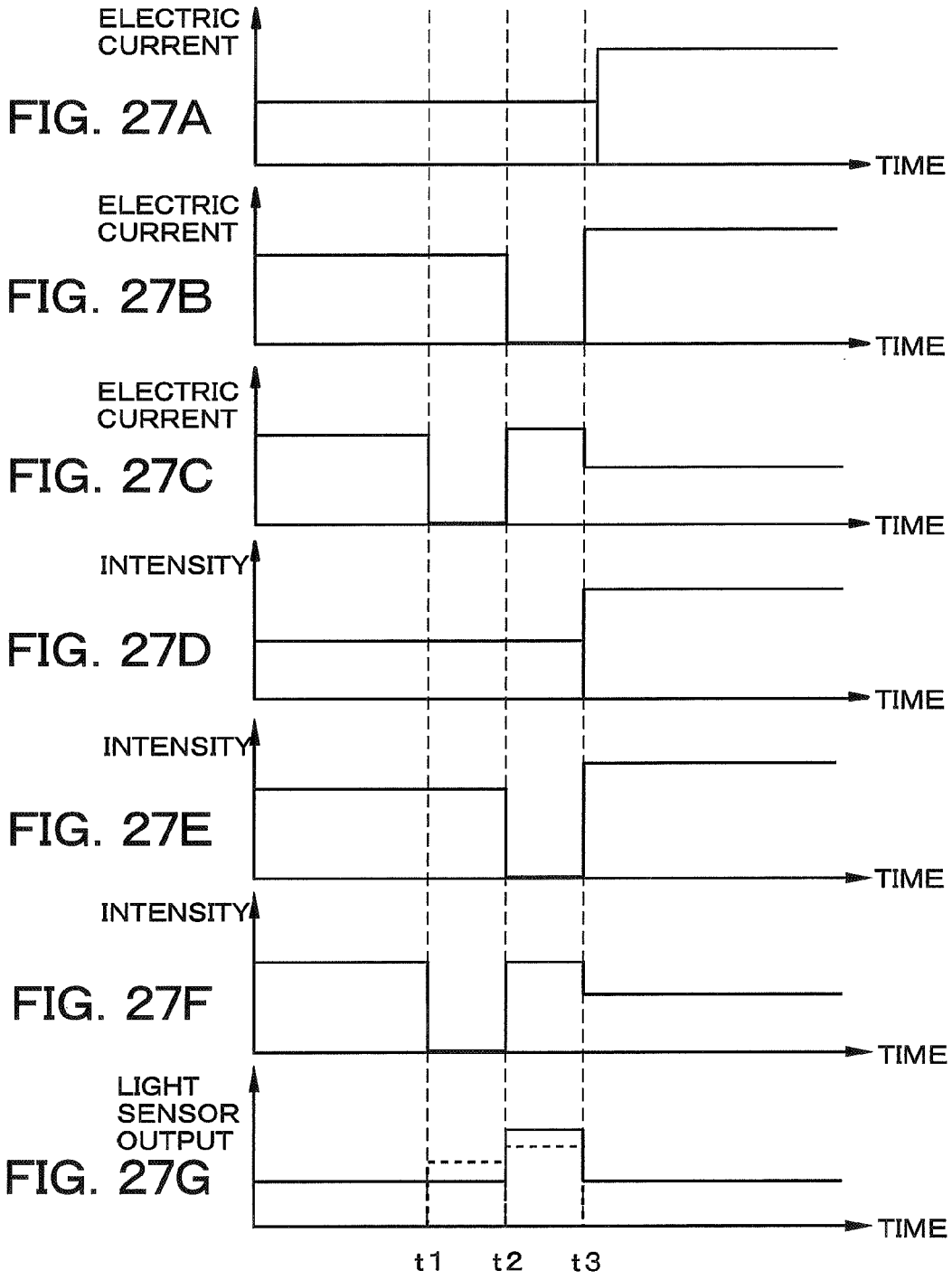
FIGS. 27A through 27G are timing charts showing the hue correction operation of the light source apparatus according to the present embodiment, wherein time is plotted on the horizontal axis of each chart, FIG. 27A has the electric current sent to the red element of the RGB-LEDs by the light source drive circuit plotted on the vertical axis, FIG. 27B has the electric current sent to the green element of the RGB-LEDs by the light source drive circuit plotted on the vertical axis, FIG. 27C has the electric current sent to the blue element of the RGB-LEDs by the light source drive circuit plotted on the vertical axis, FIG. 27D has the light emission intensity of the red element of the RGB-LEDs plotted on the vertical axis, FIG. 27E has the light emission intensity of the green element of the RGB-LEDs plotted on the vertical axis, FIG. 27F has the light emission intensity of the blue element of the RGB-LEDs plotted on the vertical axis, and FIG. 27G has values of the output results of the light sensor plotted on the vertical axis.
Figures 28A, 28B, 28C, 28D, 28E, 28F, 28G:
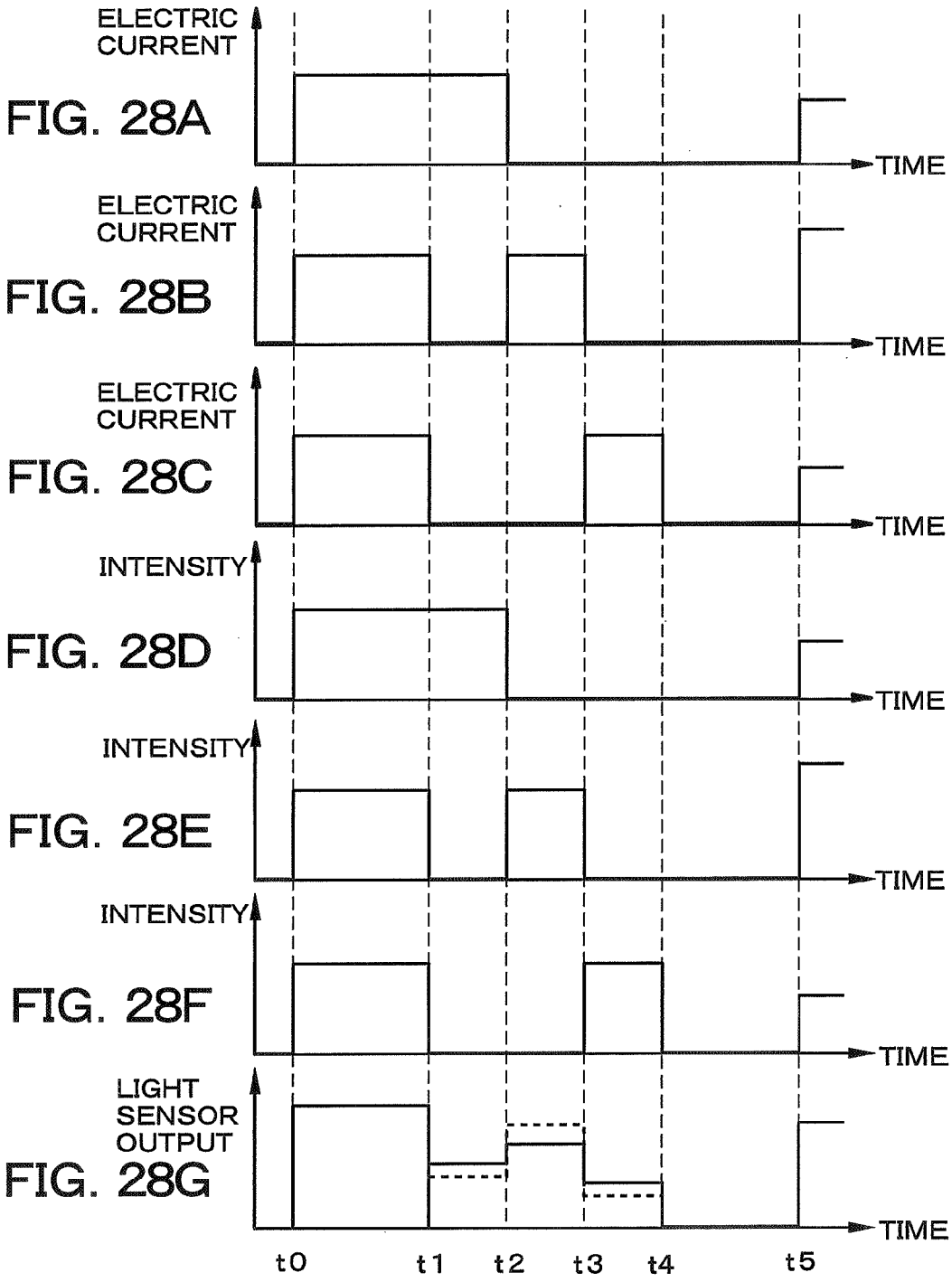
FIGS. 28A through 28G are timing charts showing the hue correction operation of the light source apparatus according to the present embodiment, wherein time is plotted on the horizontal axis of each chart, FIG. 28A has the electric current sent to the red element of the RGB-LEDs by the light source drive circuit plotted on the vertical axis, FIG. 28B has the electric current sent to the green element of the RGB-LEDs by the light source drive circuit plotted on the vertical axis, FIG. 28C has the electric current sent to the blue element of the RGB-LEDs by the light source drive circuit plotted on the vertical axis, FIG. 28D has the light emission intensity of the red element of the RGB-LEDs plotted on the vertical axis, FIG. 28E has the light emission intensity of the green element of the RGB-LEDs plotted on the vertical axis, FIG. 28F has the light emission intensity of the blue element of the RGB-LEDs plotted on the vertical axis, and FIG. 28G has values of the output results of the light sensor plotted on the vertical axis.
Figures 29A, 29B, 29C, 29D, 29E, 29F, 29G:
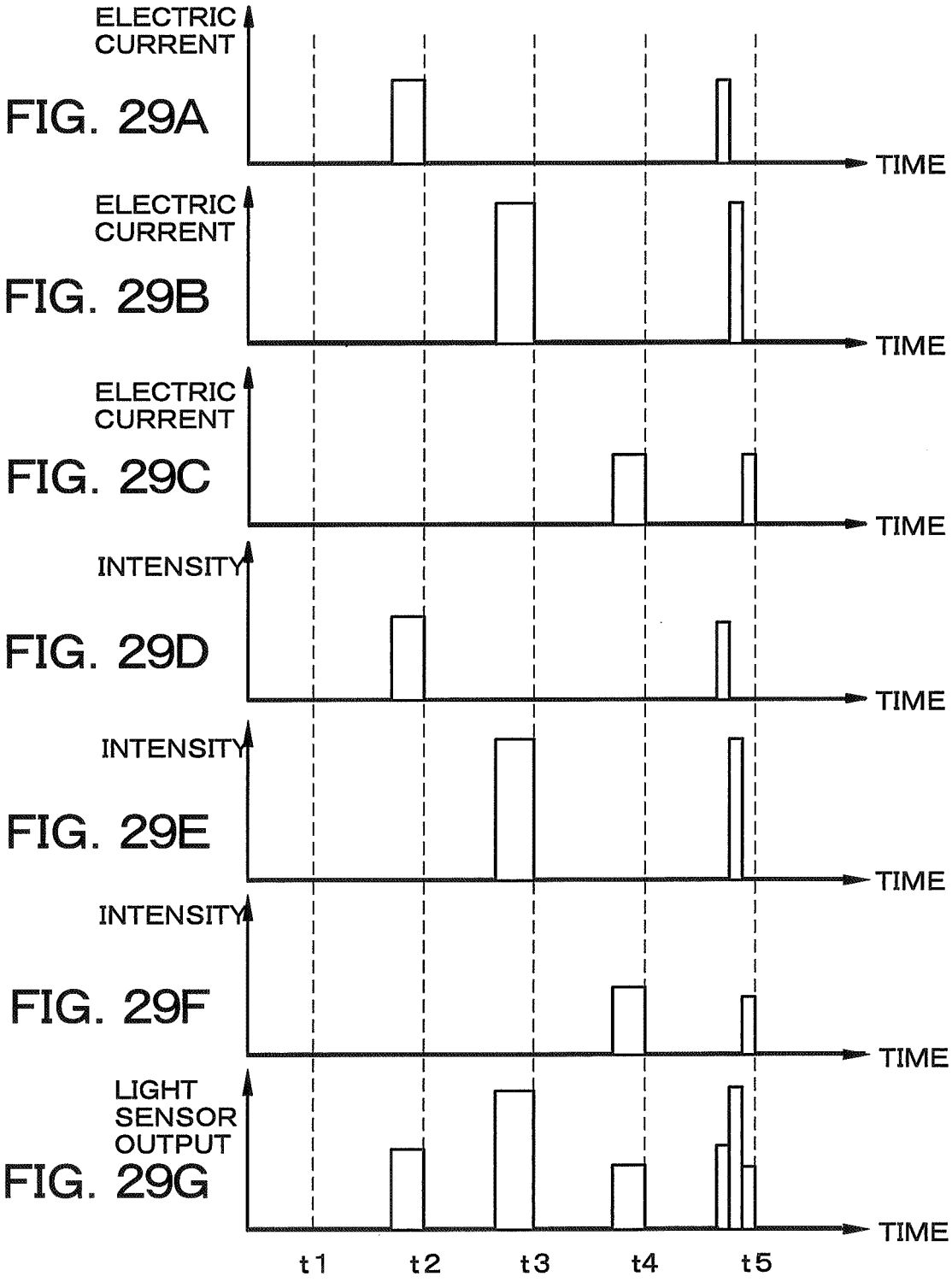
FIGS. 29A through 29G are timing charts showing the hue correction operation of the light source apparatus according to the present embodiment, wherein time is plotted on the horizontal axis of each chart, FIG. 29A has the electric current sent to the red element of the RGB-LEDs by the light source drive circuit plotted on the vertical axis, FIG. 29B has the electric current sent to the green element of the RGB-LEDs by the light source drive circuit plotted on the vertical axis, FIG. 29C has the electric current sent to the blue element of the RGB-LEDs by the light source drive circuit plotted on the vertical axis, FIG. 29D has the light emission intensity of the red element of the RGB-LEDs plotted on the vertical axis, FIG. 29E has the light emission intensity of the green element of the RGB-LEDs plotted on the vertical axis, FIG. 29F has the light emission intensity of the blue element of the RGB-LEDs plotted on the vertical axis, and FIG. 29G has values of the output results of the light sensor plotted on the vertical axis.
Figures 30A, 30B, 30C, 30D, 30E, 30F, 30G:
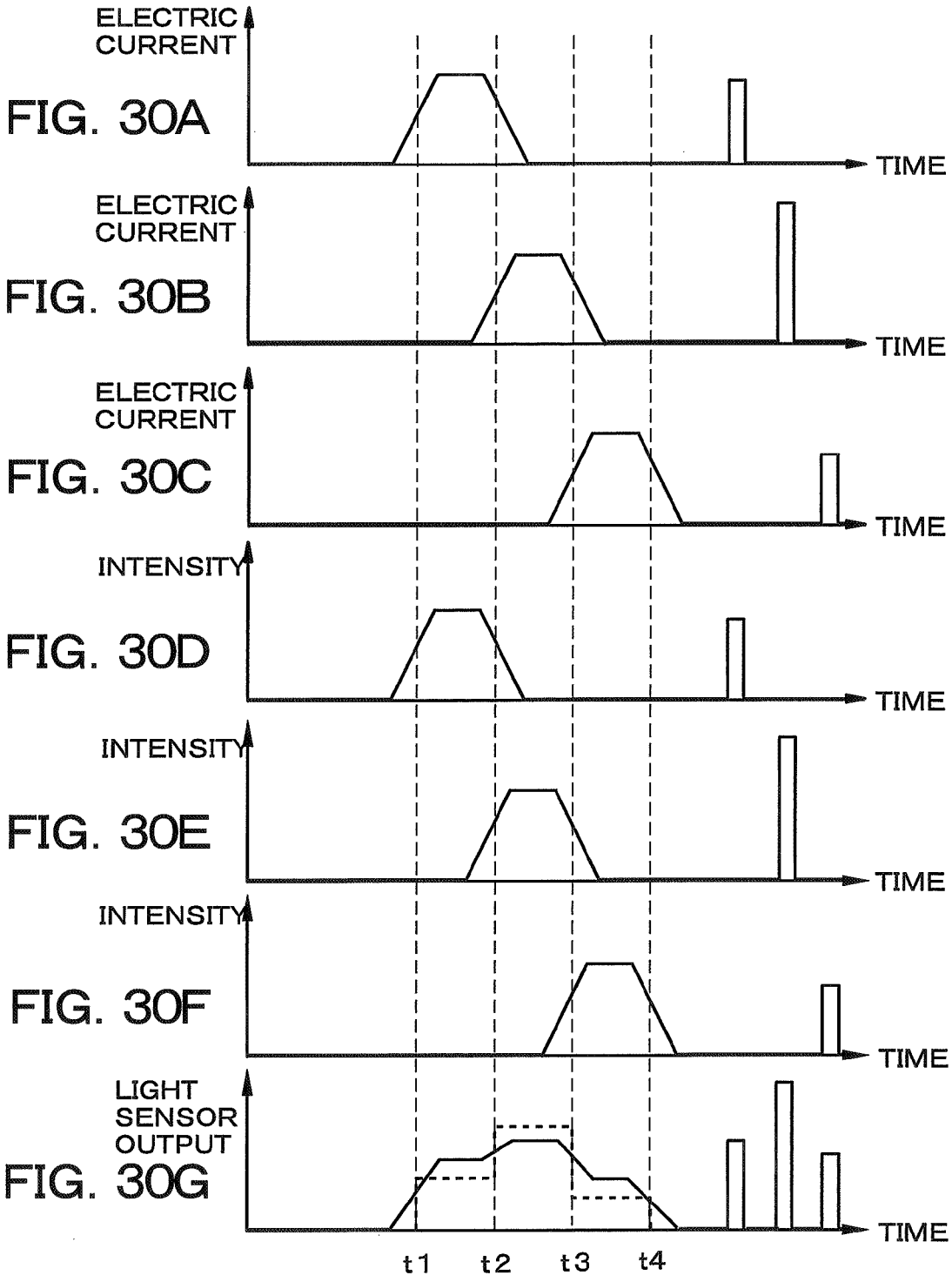
FIGS. 30A through 30G are timing charts showing the hue correction operation of the light source apparatus according to the present embodiment, wherein time is plotted on the horizontal axis of each chart, FIG. 30A has the electric current sent to the red element of the RGB-LEDs by the light source drive circuit plotted on the vertical axis, FIG. 30B has the electric current sent to the green element of the RGB-LEDs by the light source drive circuit plotted on the vertical axis, FIG. 30C has the electric current sent to the blue element of the RGB-LEDs by the light source drive circuit plotted on the vertical axis, FIG. 30D has the light emission intensity of the red element of the RGB-LEDs plotted on the vertical axis, FIG. 30E has the light emission intensity of the green element of the RGB-LEDs plotted on the vertical axis, FIG. 30F has the light emission intensity of the blue element of the RGB-LEDs plotted on the vertical axis, and FIG. 30G has values of the output results of the light sensor plotted on the vertical axis.
Figures 31A, 31B, 31C, 31D, 31E, 31F, 31G, 31H:
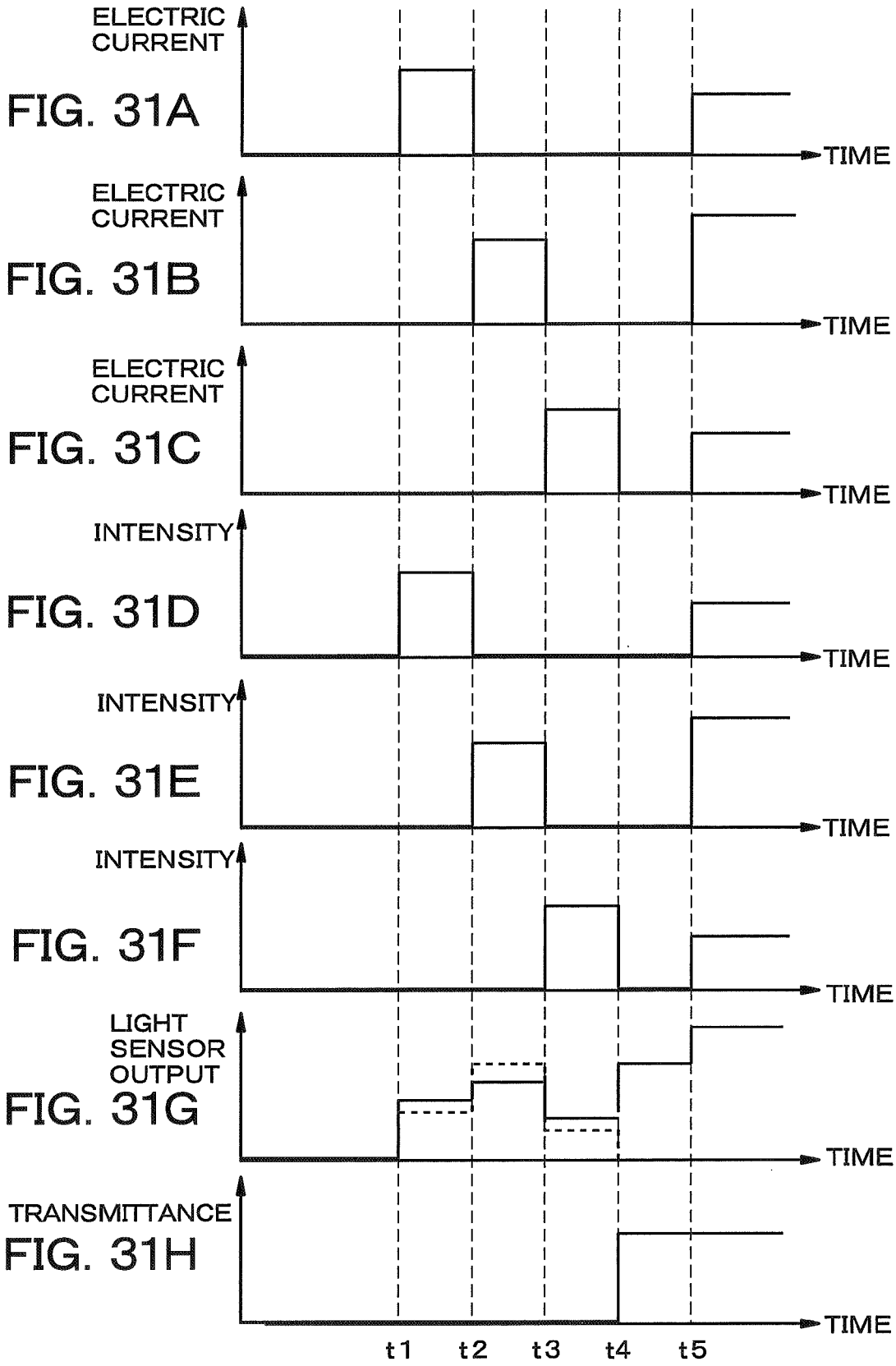
FIGS. 31A through 31G are timing charts showing the hue correction operation of the light source apparatus according to the present embodiment, wherein time is plotted on the horizontal axis of each chart, FIG. 31A has the electric current sent to the red element of the RGB-LEDs by the light source drive circuit plotted on the vertical axis, FIG. 31B has the electric current sent to the green element of the RGB-LEDs by the light source drive circuit plotted on the vertical axis, FIG. 31C has the electric current sent to the blue element of the RGB-LEDs by the light source drive circuit plotted on the vertical axis, FIG. 31D has the light emission intensity of the red element of the RGB-LEDs plotted on the vertical axis, FIG. 31E has the light emission intensity of the green element of the RGB-LEDs plotted on the vertical axis, FIG. 31F has the light emission intensity of the blue element of the RGB-LEDs plotted on the vertical axis, FIG. 31G has values of the output results of the light sensor plotted on the vertical axis, and FIG. 31H has the transmittance of the transmissive liquid crystal display panel plotted on the vertical axis.

In the twelfth embodiment, the control of the light source in the time periods preceding and following times t2 and t3 is different that that of the eleventh embodiment described above, as shown in FIG. 22. Specifically, in the eleventh embodiment described above, the red light-emitting element was turned off and the green light-emitting element was turned on at time t2, but in the twelfth embodiment, the red and green light-emitting elements are turned on simultaneously, as shown in FIGS. 22A and 22B, or in FIGS. 22D and 22E. This is due to the fact that the green light-emitting element is turned on prior to time t2, the red light-emitting element is turned off after time t2 has passed, and, as a result, a time period is provided in which the red and green light-emitting elements continue to be lighted at the same time before and after time t2. The output of the light source is the result of sensing a large output during the time period preceding and following time t2 in which the red and green light-emitting elements continue to be simultaneously lighted, as shown in FIG. 22G. This indicates that a bright state is being achieved as a result of simultaneously lighting the red and green light-emitting elements. Similarly, a time period is provided at time t3 in which the green and blue light-emitting elements are simultaneously lighted in time periods before and after time t3. The quantity of light is detected at times other than when at least two types of light-emitting elements are lighted.

In the present embodiment, a time period is provided in which at least two or more light-emitting elements are lighted at the same time, in the time period in which the quantity of light produced by the light source is sensed. The quantity of light of the light source during detection is temporarily reduced, and the problem in which the user experiences discomfort can be solved. This due to the fact that human eyes are subject to residual image effects and that a temporary reduction in the quantity of light cannot be perceived by shortening the time period in which the quantity of light of the light source is reduced. The time during which humans temporarily cannot notice a reduction in the quantity of light varies depending on the display brightness and various other conditions. It is apparent, however, that the time period in which the quantity of light is temporarily reduced in association with the detection operation is preferably set so as to be imperceptible to the user. In the present embodiment, the detection operations of the light-emitting elements are set so as to not be continuous, whereby the time period in which the quantity of light is reduced can be set to a shorter time period than in the case in which the light-emitting elements of each color are continuously involved in the detection operation, and the discomfort of the user can be reduced.

In the present embodiment, the light-emitting elements whose quantity of light is detected over a period of time were made to simultaneously emit light, but the present invention is not limited to this configuration. For example, the blue light-emitting element may be turned on in the time period in which the red and green light-emitting elements are being detected. Also, a time period may be provided in which all of the light-emitting elements are lighted at the same time. In this case, the quantity of light is preferably increased and the lighting time reduced so that fluctuations in the quantity of light over time are also reduced. Even more preferably, the quantity of light of the light-emitting elements of each color is made to be uniform over time in the period from t1 to t4. The detection operation can thereby be carried out while retaining the same hue as well as quantity of light as existed prior to time t1, and the discomfort experienced by the user can be considerably reduced. The operation and effects of the twelfth embodiment are otherwise the same as in the eleventh embodiment described above.

Next, the thirteenth embodiment of the present invention will be described. The configuration of the light source apparatus and display apparatus of the thirteenth embodiment is identical to the light source apparatus 1 and display apparatus 2 of the eleventh embodiment described above. However, the method for controlling the light source apparatus is different. In view of the above, a description of the configuration of the thirteenth embodiment is omitted and the operation of the display apparatus of the present embodiment, i.e., the method for controlling the light source of the present embodiment will be described. FIGS. 23A to 23G are timing charts showing the hue correction operation of the light source apparatus according to the present embodiment, wherein time is plotted along the horizontal axis of each chart, FIG. 23A has the electric current that the light source drive circuit has sent to the red element of the RGB-LEDs plotted on the vertical axis, FIG. 23B has the electric current that the light source drive circuit has sent to the green element of the RGB-LEDs plotted on the vertical axis, FIG. 23C has the electric current that the light source drive circuit has sent to the blue element of the RGB-LEDs plotted on the vertical axis, FIG. 23D has the light-emitting intensity of the red element of the RGB-LEDs plotted on the vertical axis, FIG. 23E has the light-emitting intensity of the green element of the RGB-LEDs plotted on the vertical axis, FIG. 23F has the light-emitting intensity of the blue element of the RGB-LEDs plotted on the vertical axis, and FIG. 23G has the values of the output results of the light sensor plotted on the vertical axis.

In the thirteenth embodiment, control of a light source in the time periods before and after time t2 and time t3 is different than that of the eleventh embodiment described above, as shown in FIG. 23. Specifically, in the thirteenth embodiment, a time period for reproducing the state that existed prior to time t1 is provided before and after time t2. Similarly, a time period for reproducing the state that existed prior to time t1 is also provided before and after time t3. The state prior to time t1 is the state that existed prior to the start of the operation for detecting the state of the light source. In other words, the main point of the present embodiment is that the light-emitting state that existed prior to the start of testing is introduced between the test time periods of the light-emitting elements of each color. The detection operation of the light-emitting elements of each color is carried out only in the time period in which the each of the light-emitting elements is turned on.

When the calibration operation of the light source is started at time t1, only the red light-emitting element is turned on first, and the light-emitting state of the red light-emitting element is detected, as shown in FIG. 23. The light-emitting elements of all colors are turned on prior to time t2, only the green light-emitting element is lighted after time t2 has passed, and the light-emitting state of the green light-emitting element is detected. Similarly, the light-emitting elements of all colors are turned on prior to time t3, only the blue light-emitting element is lighted after time t3 has passed, and the light-emitting state of the blue light-emitting element is detected. In this manner, a time period for reproducing the state of the light source that existed prior to time t1 is provided during the detection operation of the light-emitting element of all the colors.

In the present embodiment, a time period for reproducing the light-emitting state of the light source that existed prior to the execution of the detection operation is provided during the time period for detecting the quantity of light emitted by the light source. The state of the light source changes due to the detection operation, and the problem of the user experiencing discomfort can thereby be solved. Since the light-emitting elements of each color can be tested in a state that is proximate to the state that existed prior to the detection operation, an effect can also be demonstrated in which the detection accuracy is improved.

No particular limitations are imposed on the length of the time period which is provided during the testing time period of each color and in which the state of the light source that existed prior to the detection operation is reproduced, but the frequency of reductions in the quantity of light can be decreased by extending this time period, and such a situation is preferred. However, if the time period is too long, the frequency of the testing is reduced. Therefore, the length of the time period is set to a suitable value. The control circuit is configured so that the length of the time period can be set. In cases in which temperature variation is pronounced or the like, the length may be set so that testing is repeated several times in a short time period. The operation and effects of the thirteenth embodiment are otherwise identical to the eleventh embodiment described above.

Next, the fourteenth embodiment of the present invention will be described. The configuration of the light source apparatus and display apparatus of the fourteenth embodiment is identical to the light source apparatus 1 and display apparatus 2 of the eleventh embodiment described above. However, the method for controlling the light source apparatus is different. In view of the above, a description of the configuration of the fourteenth embodiment is omitted and the operation of the display apparatus of the present embodiment, i.e., the method for controlling the light source of the present embodiment will be described. FIGS. 24A to 24G are timing charts showing the hue correction operation of the light source apparatus according to the present embodiment, wherein time is plotted along the horizontal axis of each chart, FIG. 24A has the electric current that the light source drive circuit has sent to the red element of the RGB-LEDs plotted on the vertical axis, FIG. 24B has the electric current that the light source drive circuit has sent to the green element of the RGB-LEDs plotted on the vertical axis, FIG. 24C has the electric current that the light source drive circuit has sent to the blue element of the RGB-LEDs plotted on the vertical axis, FIG. 24D has the light-emitting intensity of the red element of the RGB-LEDs plotted on the vertical axis, FIG. 24E has the light-emitting intensity of the green element of the RGB-LEDs plotted on the vertical axis, FIG. 24F has the light-emitting intensity of the blue element of the RGB-LEDs plotted on the vertical axis, and FIG. 24G has the values of the output results of the light sensor plotted on the vertical axis.

In the fourteenth embodiment, control of the light source in the time periods provided before and after time t2 and time t3 is different than that of the eleventh embodiment described above, as shown in FIG. 24. Specifically, in the fourteenth embodiment, a time period in which the green and blue light-emitting elements emit light is provided before and after time t2, and these colors are complimentary colors of the red light-emitting element for which the detection operation was performed in the time period from t1 to t2. Similarly, a time period in which the light-emitting elements emit light is provided before and after time t3, and these light-emitting elements are in a complementary relationship with the light-emitting elements for which the detection operation was performed in the time period from t2 to t3. A time period in which the light-emitting elements emit light is provided before and after time t4, and these light-emitting elements are in a complementary relationship with the light-emitting elements for which the detection operation was performed in the time period from t3 to t4. In other words, a feature of the present embodiment is an operation in which light-emitting elements for which the detecting operation is to be performed are first lighted, and light-emitting elements that are in a complimentary relationship with the above light-emitting elements are then lighted.

When the calibration operation is started at time t1, only the red light-emitting element is turned on first, and the light-emitting state of the red light-emitting element is detected, as shown in FIG. 24. The green and blue light-emitting elements are lighted prior to time t2, only the green light-emitting element is lighted after time t2 has passed, and the light-emitting state of the green light-emitting element is detected. Similarly, the light-emitting elements of the red and green light-emitting elements are turned on prior to time t3, only the blue light-emitting element is lighted after time t3 has passed, and the light-emitting state of the blue light-emitting element is detected. The red and green light-emitting elements are turned on prior to time t4. In this manner, a time period in which the light-emitting elements as complimentary colors are lighted is provided during the detection operation of each of the light-emitting elements. The detection operation is carried out in the time period in which the light-emitting elements of each color are independently lighted.

In the present embodiment, a time period in which the light-emitting elements that are in complimentary color relationship with the light-emitting elements being detected is provided in the time period in which the quantity of light emitted by the light source is detected. Generally, when the light source is switched at high speed, the user can notice the time average of the light-emitting state, but the average color of the detection time period can be made proximate to a white color by lighting the complimentary-colored light-emitting elements, as shown in the present embodiment. In the first embodiment described above, the times t1 to t4 were averaged to obtain a white color, but in the present embodiment, the time period before and after the times t1 to t2 is averaged to obtain a white color, and the white color state can therefore be obtained in a shorter period of time. As a result, the danger of the user perceiving time sequential light emission can be reduced. In the particular case that a portable terminal apparatus or the like is operated at high speed in view of the user, the time sequential light emission is spatially divided, and the danger of the used perceiving the time sequential light emission is therefore increased. In contrast, in the present embodiment, such a danger can be reduced because averaging can be performed in a shorter period of time.

The light emission of the complementary colors is preferably a balance in the quantity of light in which time-averaging is used to obtain a white color. For example, when lighting of the green and blue light-emitting elements during and after the detection of the red light-emitting element is considered, the quantity of light of the red color and the quantity of light of the green and blue colors are preferably set so that the balance is a white color. The danger of the user perceiving time sequential light emission can thereby be considerably reduced.

In the present embodiment, the light-emitting elements for which detection operation will be carried out are lighted, and the light-emitting elements of the complimentary colors are then turned on, but the present invention is not limited to this configuration, and the light-emitting elements of the complimentary colors may be turned on earlier, or only the light-emitting elements of the complimentary colors may be turned on during the detection time period. The operation and effects of the fourteenth embodiment are otherwise identical to the eleventh embodiment described above.

Next, the fifteenth embodiment of the present invention will be described. The configuration of the light source apparatus and display apparatus of the fifteenth embodiment is identical to the light source apparatus 1 and display apparatus 2 of the eleventh embodiment described above. However, the method for controlling the light source apparatus is different. In view of the above, a description of the configuration of the fifteenth embodiment is omitted and the operation of the display apparatus of the present embodiment, i.e., the method for controlling the light source of the present embodiment will be described. FIGS. 25A to 25G are timing charts showing the hue correction operation of the light source apparatus according to the present embodiment, wherein time is plotted along the horizontal axis of each chart, FIG. 25A has the electric current that the light source drive circuit has sent to the red element of the RGB-LEDs plotted on the vertical axis, FIG. 25B has the electric current that the light source drive circuit has sent to the green element of the RGB-LEDs plotted on the vertical axis, FIG. 25C has the electric current that the light source drive circuit has sent to the blue element of the RGB-LEDs plotted on the vertical axis, FIG. 25D has the light-emitting intensity of the red element of the RGB-LEDs plotted on the vertical axis, FIG. 25E has the light-emitting intensity of the green element of the RGB-LEDs plotted on the vertical axis, FIG. 25F has the light-emitting intensity of the blue element of the RGB-LEDs plotted on the vertical axis, and FIG. 25G has the values of the output results of the light sensor plotted on the vertical axis.

In the fifteenth embodiment, the method for controlling light emissions in the time period for detecting the state of the light source is different than in other embodiments, as shown in FIG. 25. Specifically, in the fifteenth embodiment, the state of red light-emitting element is detected, the green light-emitting element is turned on without turning off the red light-emitting element, and the states of the red and green light-emitting elements are detected together. Next, the red, green, and blue light-emitting elements are turned on and this state is detected in combination. The ideal output data of the light source when the red light-emitting element is turned on is preset in the control circuit as reference data. The ideal data of the light source when the red and green light-emitting elements are turned on is preset in the same manner, as is the ideal data of the light source when all of the light-emitting elements are turned on. The control circuit compares the preset data and the detection results produced by the control method described above, and controls the light-emitting elements.

The detection operation of the red light-emitting element is carried out in the time period from t1 to t2, as shown in FIG. 25. Similarly, the detection operation of the red and green light-emitting elements is carried out in the time period from t2 to t3, and the detection operation of all of the light-emitting elements, i.e., the red, green, and blue light-emitting elements is carried out in the time period from t3 to t4.

In the present embodiment, the calibration operation is carried out in a state in which at least one type of light-emitting element is constantly on. Depending on the state and type of the light-emitting element, there are light-emitting elements whose characteristics fluctuate somewhat in comparison with the constantly on state when the on/off operation is executed in order to perform the detection operation. In the present embodiment, high controllability in particular can be achieved by constantly lighting the light-emitting elements that have such unstable characteristics. As described in the other embodiments, the red light-emitting element tends to have larger fluctuations in the characteristics in comparison with the green and blue light-emitting elements. In view of this fact, controllability can be improved by constantly lighting the red light-emitting elements, as described in the present embodiment. When compared with the first embodiment described above, the danger of the user perceiving the calibration operation can be reduced because the ratio in which the light source is turned off is reduced in the present embodiment.

In the present embodiment, the number of light-emitting elements was increased from a single light-emitting element color to two and three light-emitting element colors in sequence, and the detection operation was carried out, but the present invention is not limited to this configuration, and the number of light-emitting elements may be decreased from three light-emitting element colors to two and one light-emitting element colors in sequence, and the detection operation may then be carried out. The detection accuracy can thereby be improved because a state in which the light source is continuously lighted can be created, and the order in which the color changes are made can also be modified from a single color to three and two colors in sequence.

When variability is not observed in the characteristics of the light-emitting elements that server as a light source, the green light-emitting element is preferably kept constantly lighted. Humans are generally sensitive to green color, and discomfort can therefore be reduced even when the green color is kept constantly lighted.

Three types of data that are preset in the control circuit were described in the present embodiment, i.e., those preset when the red element emits light, when the red and green elements emit light, and when the elements of all colors emit light, but the present invention is not limited to this configuration. For example, data can be preset when red, green, and blue elements are emitting light, respectively, and reference data for the detection results of the present embodiment can be computed and generated using these data. Providing such computing ability leads to more complex control circuitry, but electronic circuitry continues to progress in terms of higher performance and lower costs, and maximizing the use of computing capacity is another method to be considered. Operations can be switched in accordance with the type of calibration, and calibration operations can be carried out with higher performance by providing the control circuit with the various preset calibration operations described in reference to the embodiments of the present invention. The operation and effects of the fifteenth embodiment are otherwise identical to the first embodiment described above.

Next, the sixteenth embodiment of the present invention will be described. The configuration of the light source apparatus and display apparatus of the sixteenth embodiment is identical to the light source apparatus 1 and display apparatus 2 of the first embodiment described above. However, the method for controlling the light source apparatus is different. In view of the above, a description of the configuration of the sixteenth embodiment is omitted and the operation of the display apparatus of the present embodiment, i.e., the method for controlling the light source of the present embodiment will be described. FIGS. 26A to 26G are timing charts showing the hue correction operation of the light source apparatus according to the present embodiment, wherein time is plotted along the horizontal axis of each chart, FIG. 26A has the electric current that the light source drive circuit has sent to the red element of the RGB-LEDs plotted on the vertical axis, FIG. 26B has the electric current that the light source drive circuit has sent to the green element of the RGB-LEDs plotted on the vertical axis, FIG. 26C has the electric current that the light source drive circuit has sent to the blue element of the RGB-LEDs plotted on the vertical axis, FIG. 26D has the light-emitting intensity of the red element of the RGB-LEDs plotted on the vertical axis, FIG. 26E has the light-emitting intensity of the green element of the RGB-LEDs plotted on the vertical axis, FIG. 26F has the light-emitting intensity of the blue element of the RGB-LEDs plotted on the vertical axis, and FIG. 26G has the values of the output results of the light sensor plotted on the vertical axis.

In the sixteenth embodiment, the method for controlling light emissions in the time period for detecting the state of the light source is different than in other embodiments, as shown in FIG. 26. Specifically, in the other embodiments, a plurality of light-emitting elements constituting the light source formed a set, and the calibration operation was carried out. In the sixteenth embodiment, however, only one type of light-emitting element is subjected to detection and correction operations in a single calibration operation. The detection and correction operations are not executed in the order of the light-emitting elements of each color, and may, e.g., be executed for the red color, then again for the red color, and subsequently for the green color. In the same manner as the eleventh embodiment described above, the description in the present embodiment presumes that the state in which the light source is lighted is the prescribed state that existed prior to time t1.

The detection operation of the red light-emitting element is carried out in the time period between times t1 and t2, as shown in FIG. 26, and one example of this time period is 16 ms. The detection result is reflected at time t2, the quantity of light of the red light-emitting element is modified, and normal display is carried out thereafter. This time period is the time period from t2 to t3 and is set to 60 seconds, for example.

Similarly, the detection operation of the red light-emitting element is carried out again in the time period between times t3 and t4, the result is reflected at time t4, and normal display is carried out. The time period from t4 to t5 is similarly set to 60 seconds. In the time period from t5 to t6, the detection operation of the green light-emitting element is carried out, the detection result is reflected at time t6, and normal display is carried out. In this manner, the detection and correction operations are carried out in the present embodiment twice for the red light-emitting element and a single time for the red light-emitting element. When this phase is repeated three times, the detection and correction operations for the blue light-emitting element are executed a single time. In other words, the ratio of the number of times the detection and correction operations are carried out for the red, green, and blue light-emitting elements is 6:3:1, respectively.

In the present embodiment, the detection operation is carried out for only one type of light-emitting element in a single calibration. Therefore, the time required for the detection operation can be reduced and the discomfort experienced by the user in association with the calibration operation can be reduced. The detection and correction operations can be weighted in accordance with the type of light-emitting element, and calibration can be carried out for only a specific color that changes markedly in particular. For example, in an LED that has the three colors RGB, the red light-emitting element is composed of an element system that is different that than of the blue or green light-emitting elements, and the characteristics are often different. Therefore, the present invention can be more effectively applied by placing more emphasis on the calibration of the red light-emitting element. When power is switched on, all of the colors may be calibrated, only red or a portion of the colors may be recalibrated after a prescribed period of time has elapsed, or a combination of these may be used. The precision of the calibration can thereby be improved while reducing the effect on the user. The effect of the fluctuations of the blue light-emitting element is less than the effect of the fluctuations of the green light-emitting element. Therefore, the frequency of the detection and correction operations for the red light-emitting element can be reduced, and the frequency of the calibration operation can be reduced, or resources can then be allotted to correction of the other colors.

In the present embodiment, a configuration was described in which the detection operation was carried out for only one type of light-emitting element in a single calibration, but the present invention is not limited to this configuration, and the detection operation may be carried out for two types of light-emitting elements in a single calibration. The order and frequency of the calibration operations of the light-emitting elements are not limited to the description of the present embodiment and can be suitably modified in accordance with conditions. For example, only the frequency of the calibration of the light-emitting elements of each color may be determined, and randomness may be introduced to the actual execution, e.g., the sequence, the time period between calibrations, or other parameters, whereby discomfort can be reduced because non-predictability can be achieved even assuming that the conditions are such that the calibration operation is perceived by the user. The operation and effects of the sixteenth embodiment are otherwise identical to the first embodiment described above.

Next, the seventeenth embodiment of the present invention will be described. The configuration of the light source apparatus and display apparatus of the seventeenth embodiment is identical to the light source apparatus 1 and display apparatus 2 of the first embodiment described above. However, the method for controlling the light source apparatus is different. In view of the above, a description of the configuration of the seventeenth embodiment is omitted and the operation of the display apparatus of the present embodiment, i.e., the method for controlling the light source of the present embodiment will be described. FIGS. 27A to 27G are timing charts showing the hue correction operation of the light source apparatus according to the present embodiment, wherein time is plotted along the horizontal axis of each chart, FIG. 27A has the electric current that the light source drive circuit has sent to the red element of the RGB-LEDs plotted on the vertical axis, FIG. 27B has the electric current that the light source drive circuit has sent to the green element of the RGB-LEDs plotted on the vertical axis, FIG. 27C has the electric current that the light source drive circuit has sent to the blue element of the RGB-LEDs plotted on the vertical axis, FIG. 27D has the light-emitting intensity of the red element of the RGB-LEDs plotted on the vertical axis, FIG. 27E has the light-emitting intensity of the green element of the RGB-LEDs plotted on the vertical axis, FIG. 27F has the light-emitting intensity of the blue element of the RGB-LEDs plotted on the vertical axis, and FIG. 27G has the values of the output results of the light sensor plotted on the vertical axis.

In the seventeenth embodiment, the fact that the light-emitting elements of each color are not caused to independently emit light is similar to the eighth embodiment of the present invention described above, as shown in FIG. 27. However, in the present embodiment, the fact that the detection results of the constant state in which all of the colors emit light are used for calibration is very different from the eighth embodiment described above, and the control circuit can be simplified. The calibration time can also be made shorter than that of the eighth embodiment described above.

The light source is turned on in a prescribed state prior to time t1, as shown in FIG. 27. Specifically, all types of light-emitting element are turned on, but the quantity of light is detected by the light sensor and control is constantly carried out so that a match is established with the prescribed reference data stored in the control circuit. The control method prior to time t1 is the same control method that is used at time t3 and thereafter. The control method will therefore be described later. At time t1, the blue light-emitting element is turned off and the red and green light-emitting elements are turned on. The detection operation is carried out using the light sensor, and since the results are lower than the reference data, the quantity of light of the green light-emitting element is increased. The quantity of light of the red light-emitting element at this time is kept constant. Next, at time t2, the red and blue light-emitting elements are turned on. The detection operation is carried out using the light sensor, and since the results are higher than the reference data, the quantity of light of the blue light-emitting element is reduced. Lastly, at time t3, all of the light-emitting elements are turned on. At this point, the detection results of times t1 to t3 are used to turn on the green and blue light-emitting elements, wherein the quantity of light of the green light-emitting element is increased and the quantity of light of the blue light-emitting element is reduced. The entire quantity of light is then detected, and if the result is lower than the reference data, the quantity of light of the red light-emitting element is increased. At time t3 and thereafter, the state in which all of the light-emitting elements are turned on is detected, and when fluctuations are produced, the red light-emitting element is controlled.

In the present embodiment, the necessary calibration time can be reduced using the detection results of the constant state in which all of the light-emitting elements are turned on, and since the elements are not caused to emit light independently, the danger that the user will perceive the detection operation is reduced. In the particular case that the fluctuations in the characteristics of the green and blue light-emitting elements are low, the red light-emitting element, which has relatively large fluctuations in its characteristics, can be constantly corrected using feedback control which uses one type of light sensor, and higher performance can therefore be achieved. The control circuit can be simplified because control entails correcting only one type of light-emitting element in a single detection operation despite the fact that a plurality of light-emitting elements is simultaneously lighted during the detection operation. In a similar manner to the embodiments described above, the light-emitting element that is constantly lighted in the present embodiment was described as being the red light-emitting element, but the present invention is not limited to this configuration. The operation and effects of the seventeenth embodiment are otherwise identical to the first embodiment described above.

Next, the eighteenth embodiment of the present invention will be described. The configuration of the light source apparatus and display apparatus of the eighteenth embodiment is identical to the light source apparatus 1 and display apparatus 2 of the first embodiment described above. However, the method for controlling the light source apparatus is different. In view of the above, a description of the configuration of the eighteenth embodiment is omitted and the operation of the display apparatus of the present embodiment, i.e., the method for controlling the light source of the present embodiment will be described. FIGS. 28A to 28G are timing charts showing the hue correction operation of the light source apparatus according to the present embodiment, wherein time is plotted along the horizontal axis of each chart, FIG. 28A has the electric current that the light source drive circuit has sent to the red element of the RGB-LEDs plotted on the vertical axis, FIG. 28B has the electric current that the light source drive circuit has sent to the green element of the RGB-LEDs plotted on the vertical axis, FIG. 28C has the electric current that the light source drive circuit has sent to the blue element of the RGB-LEDs plotted on the vertical axis, FIG. 28D has the light-emitting intensity of the red element of the RGB-LEDs plotted on the vertical axis, FIG. 28E has the light-emitting intensity of the green element of the RGB-LEDs plotted on the vertical axis, FIG. 28F has the light-emitting intensity of the blue element of the RGB-LEDs plotted on the vertical axis, and FIG. 28G has the values of the output results of the light sensor plotted on the vertical axis.

Featured in the eighteenth embodiment is the constantly repeated execution of the detection and correction operations, as shown in FIG. 28. Stable high-performance control can thereby be achieved.

The display of a display panel is ordinarily updated about every 16 ms. In some high-performance display apparatuses, there are update times that are twice the normal rate, i.e., 8 ms, but in the present embodiment, the case of 16 ms used as an example in the description.

Liquid crystal display apparatuses are generally classified as hold-type display apparatuses. A hold-type display apparatus refers to a type in which the display is updated and the display is then held until the next update is performed. In contrast to this type, CRTs and the like are classified as impulse-type display apparatuses. An impulse-type display apparatus refers to a type in which the display is updated and the display is then carried out for that moment only. The reason that CRTs are an impulse-type is that an electron beam scans the fluorescent body of arbitrary pixels, light is emitted only for an instant, and the scanned pixels do not light up when the electron beam is irradiating other pixels. It is generally held that the impulse-type has superior video viewability than the hold-type. Also, liquid crystal display apparatuses, which are typical hold-type display apparatuses, demonstrate impulse-type performance by momentarily turning off the backlight to achieve higher video display performance. A feature of the present embodiment is that an operation for momentarily turning off the backlight is adopted, all of the light-emitting elements are caused to emit light in a time sequential fashion at the moment when the elements are switched from on to off, and detection and correction operations are then performed.

All the light-emitting elements are simultaneously turned on at time t0, as shown in FIG. 28. The time period from t0 to t1 is used for ordinary display. This time period is set to 10 ms, for example. The detection operation for the red light-emitting element is carried out in the time period from t1 to t2, the detection operation for the green light-emitting element is similarly carried out in the time period t2 to t3, and the detection operation for the blue light-emitting element is carried out in the time period t3 to t4. These detection operations are the same as those in the first embodiment described above, but the time periods are each set to 1 ms. The time period from t4 to t5 is the time period in which all of the light sources are turned off, and this time period is set to 3 ms. All of the light sources are turned on at time t5 and thereafter, and the results of the detection operation of the time period from t1 to t4 are used at this time. The time period from t0 to t5 is 16 ms. By repeatedly executing this time period, the detection and correction operations of the present invention can be executed at the same time that the backlight is switched off for a portion of the time period.

In the present embodiment, higher performance can be achieved because the detection and correction operations can be constantly and repeatedly carried out in a short period of time. Advantageous application can be made to professional equipment, high-quality liquid crystal televisions, and other products that require higher performance in particular. Since correction based on the detection results can be carried out in short cycles, the user does not perceive the detection and correction operations, and the same results as those obtained by the methods described in the prior art can be achieved with fewer types of light sensors. However, the light sensors can be corrected by providing a time period in which the light source is turned off. Specifically, higher-precision corrections can be made by detecting dark current or light from an element other than the light source.

In the present embodiment, a configuration is described in which a time period is provided in which the light source is turned off, but this is not an essential requirement of the present invention. A time period in which the light source is turned off does not need to be provided at all, and a time period in which the quantity of light is temporarily reduced may be provided. In other words, the essence of the present embodiment is the execution of the detection and correction operations for the light source in synchronization with the update of the display in a display panel. However, the updating of the display and the detection and correction operations for the light source are not necessarily required to have a one-to-one correspondence. For example, the detection and correction operations for the light source may be carried out a plurality of times each time the display is updated, and this ratio may be randomly set. Also, there may be a delay between the timing of the start of display updating and the timing of the start of the detection and correction operations for the light source. In other words, it is important to have a fixed relationship between the cycle of the detection and correction operations for the light source and the cycle of updating the display or the refresh rate, which is the horizontal scanning frequency, of the display panel.

In the present embodiment, the case in which the red, green, and blue light-emitting elements are sequentially turned on and detected was described as the calibration operation, but the present invention is not limited to this configuration, and a method may be used in which a plurality of types of light-emitting element is simultaneously turned on as described in the other embodiments. As described above, the present embodiment has a high probability of providing a high-quality display apparatus in which a calibration operation is not sensed. There is therefore a particular need for control in which the user does not perceive the time sequential lighting of the light-emitting elements. Therefore, it is preferable to use a combination of the method described above in the seventeenth embodiment, i.e., the method for reducing the detection time by using the detection results of the state in which all colors are lighted, and the method described above in the sixteenth embodiment, i.e., the method for modifying the illumination order in each calibration. The effect of the calibration operation can thereby be reduced and a higher-quality display can be achieved. The operation and effects of the eighteenth embodiment are otherwise identical to the first embodiment described above.

Next, the nineteenth embodiment of the present invention will be described. The configuration of the light source apparatus and display apparatus of the nineteenth embodiment is identical to the light source apparatus 16 and display apparatus 26 of the seventh embodiment described above. However, the method for controlling the light source apparatus is different. In view of the above, a description of the configuration of the nineteenth embodiment is omitted and the operation of the display apparatus of the present embodiment, i.e., the method for controlling the light source of the present embodiment will be described. FIGS. 29A to 29G are timing charts showing the hue correction operation of the light source apparatus according to the present embodiment, wherein time is plotted along the horizontal axis of each chart, FIG. 29A has the electric current that the light source drive circuit has sent to the red element of the RGB-LEDs plotted on the vertical axis, FIG. 29B has the electric current that the light source drive circuit has sent to the green element of the RGB-LEDs plotted on the vertical axis, FIG. 29C has the electric current that the light source drive circuit has sent to the blue element of the RGB-LEDs plotted on the vertical axis, FIG. 29D has the light-emitting intensity of the red element of the RGB-LEDs plotted on the vertical axis, FIG. 29E has the light-emitting intensity of the green element of the RGB-LEDs plotted on the vertical axis, FIG. 29F has the light-emitting intensity of the blue element of the RGB-LEDs plotted on the vertical axis, and FIG. 29G has the values of the output results of the light sensor plotted on the vertical axis.

A feature of the nineteenth embodiment is, in particular, the addition of a white display image in connection with the method for driving the field sequential-type liquid crystal display panel in the seventh embodiment described above, as shown in FIG. 29. Specifically, in the seventh embodiment described above, colors are displayed by displaying in a time sequential fashion an image composed of the color components red, green, and blue in synchronization with a light source that rapidly flickers red, green, and blue colors. However, in the nineteenth embodiment, colors are displayed by displaying in a time sequential fashion an image composed of the color components red, green, and blue in synchronization with a light source that rapidly flickers red, green, blue, and white colors. In this manner, power can be reduced while improving the brightness of the display image by adding the image display of the white color component. The color break phenomenon in which the colors are observed to separate can be reduced.

In the case that the image of the white color component is to be displayed, the light source causes the green and blue light-emitting elements to light up in a chronological sequence, and the light source is corrected using the detection results of the light sensor at this time. This is a significant feature of the present embodiment.

The time period from t1 to t2 is a period for displaying the image of the red color component, and the time is set to 4 ms. The image of the red color component is displayed on the display panel, and when the display has been completed, the red light-emitting elements are turned on. The time period from t2 to t3 is a period for displaying the image of the green color component. The image of the green color component is displayed on the display panel, and when the display has been completed, the green light-emitting elements are turned on. The time period from t3 to t4 is a period for displaying the image of the blue color component. The image of the blue color component is displayed on the display panel, and when the display has been completed, the blue light-emitting elements are turned on. Each of the time periods is set to 4 ms. In the present embodiment, the detection operation for the light source is not executed in the time period from t1 to t4.

Next, the time period from t4 to t5 is a time period for displaying the image of the white color component. The image of the white color component is displayed on the display panel, and when the display has been completed, all of the light-emitting elements are turned on, producing white illumination. At this time, white illumination is emitted by the red, green, and blue light-emitting elements lighting up continuously in a time sequential fashion. The light sources are then corrected using the detection results of the light sensor for this emission, and the correction is reflected in display operation starting at time t5. The operations of the time periods t1 to t5 are repeated to achieve a field sequential-type color display.

In the present embodiment, in contrast to the seventh embodiment described above, higher performance can be achieved because the detection and correction operations can be constantly and repeatedly carried out in a short period of time, utilizing the display of the white color component. Advantageous application can be made in particular to professional equipment, high-quality liquid crystal televisions, and other products that require higher performance. Since correction based on the detection results can be carried out in short cycles, the user does not perceive the detection and correction operations, and the same results can be achieved as those obtained via the methods described in the prior art, but using fewer types of light sensors.

In common with the seventh embodiment described above, in a display apparatus of field sequential type, colors can be displayed without the use of a color filter. Thus, not only is it possible to reduce reduction of light from the light sources caused by the color filter, but it is also possible to reduce the number of processes, to improve yield, and to attain lower cost. Moreover, since color display can be achieved using ⅓ the number of pixels as compared to where a color filter is used, the aperture ratio can be improved. As described above, in the present invention, high controllability with a smaller number of light sensors can be achieved through emission of light in a time sequential fashion, but since the field sequential format reduces flickering of the light sources, there is high potential for application of the invention.

Furthermore, in the present embodiment, the light-emitting elements of all colors light up at the same time during display of the white color component, and it is possible to carry out detection and correction operations for individual colors and all colors. It is moreover possible to carry out detection and correction operations during display not just of white, but of other colors as well. The configuration of the nineteenth embodiment is otherwise identical to the seventh embodiment described above.

Next, the twentieth embodiment of the present invention will be described. The configurations of the display apparatus and the light source apparatus of the twentieth embodiment are identical to the display apparatus 26 and the light source apparatus 16 of the seventh embodiment described above; only the control method of the light source apparatus is different. In view of the above, a description of the configuration of the twentieth embodiment is omitted and the operation of the display apparatus of the present embodiment, i.e., the method for controlling the light source apparatus of the present embodiment will be described. FIGS. 30A to 30G are timing charts showing the hue correction operation of the light source apparatus according to the present embodiment, wherein time is plotted along the horizontal axis of each chart and wherein FIG. 30A has the electric current that the light source drive circuit has sent to the red element of the RGB-LEDs plotted on the vertical axis, FIG. 30B has the electric current that the light source drive circuit has sent to the green element of the RGB-LEDs plotted on the vertical axis, FIG. 30C has the electric current that the light source drive circuit has sent to the blue element of the RGB-LEDs plotted on the vertical axis, FIG. 30D has the light-emitting intensity of the red element of the RGB-LEDs plotted on the vertical axis, FIG. 30E has the light-emitting intensity of the green element of the RGB-LEDs plotted on the vertical axis, FIG. 30F has the light-emitting intensity of the blue element of the RGB-LEDs plotted on the vertical axis, and FIG. 30G has the values of the output results of the light sensor plotted on the vertical axis.

As shown in FIG. 30, the twentieth embodiment relates to the method of driving a liquid crystal display panel of field sequential type in the seventh embodiment described above, and in particular features explicitly carrying out the light source calibration operation, so as to be clearly perceivable to the user. Specifically, in the twentieth embodiment, the light source calibration operation differs in comparison with the seventh embodiment described above, and in particular makes it easier for the user to perceive the light source detection operation, whereby a longer detection time period can be established, and the light emission pattern of the light sources can be perceived and enjoyed by the user.

As shown in FIG. 30, the detection operation of the light source condition is initiated at a point in time just prior to time t1. First, the red light-emitting element is lighted; however, rather than lighting it suddenly, the quantity of the light is increased gradually from the turned off condition.

When a prescribed condition has been reached, an operation to detect the conditions of the light sources is carried out. Next, at a point in time just prior to time t2, the operation to turn off the red light-emitting element is initiated, with the quantity of the light being decreased gradually. Then, the quantity of the light of the green light-emitting element is increased gradually.

Approximately when time t2 has passed, the red light-emitting element will have been completely turned off and the green light-emitting element will have reached the prescribed state, whereupon an operation to detect the light source condition is carried out. The time period from t1 to t2 is set to about 10 seconds, and flickering of the light sources is repeated irregardless of the field-sequential display content. Then, a similar detection operation is carried out for the blue light-emitting element as well. When the display returns to normal starting at time t4, correction of the light source drive conditions to reflect the detection results is carried out, and field sequential-type color display is achieved. Optionally, the time period from t1 to t4 can be repeated multiple times while carrying out detection and correction operations. The trigger signal for restoring normal display may be inputted to the control circuit.

A significant difference of the present embodiment from the conventional detection operation is that the detection operation is designed to actively appeal to the user. For this reason, a longer detection time period is established, and the light emitting pattern of the light sources incorporates decorative light emission over and above that strictly necessary for the detection operation. By so doing, consistent detection operations are possible, and high picture quality is possible as well. Furthermore, since a highly decorative impression can be achieved, it is possible to provide visual enjoyment to the user. Moreover, since the detection operation is carried out explicitly, it is possible to provide reassurance that calibration is being carried out properly.

A personal computer is one example of a terminal apparatus in which the present embodiment may be implemented. Personal computers are typically provided with a screensaver function for the purpose of preventing screen burn-in, and a highly decorative screen saver can be achieved by concomitantly employing the detection operation of the present embodiment together with such a screensaver. Similarly, the present embodiment may be installed in a cash dispenser, automatic vending machine, or other terminal apparatus targeting unspecified number of users, and in the event that no user is currently present, the highly decorative appearance can be utilized for enhanced advertising effect to appeal to potential users. For this purpose, it is important to modify the light emission pattern in the light source correction operation so as to obtain a more decorative pattern, for which purpose effective to employ a light emission pattern that is coordinated with the display content of the display panel. The trigger signal for returning from screensaver operation to normal operation can be utilized to return from the calibration operation to normal display.

In this way, the display apparatus of the present embodiment can be implemented not only in a terminal apparatus equipped with a simple display function, but also in an apparatus for which decorative appearance is considered important. A favorable application in a personal terminal apparatus would be a sub-display provided on the exterior of a clamshell type cell phone, with the phone folded closed.

In the present embodiment, there is described the case of a backlight that changes in rainbow color fashion, by means of slowly repeatedly flickering the light sources of three colors. However, this is merely exemplary, and the present invention is not limited to this configuration. It is possible to implement more highly decorative patterns. Additionally, by imparting decorative appearance while allowing the light source to flicker in short cycles, it is possible to carry out the light source detection operation under conditions approximating those during use in a field sequential display. Higher accuracy is attained thereby. The operation and effects of the twentieth embodiment are otherwise the same as the seventh embodiment.

Next, the twenty-first embodiment of the present invention will be described. The configurations of the display apparatus and the light source apparatus of the twenty-first embodiment are identical to the display apparatus 21 and the light source apparatus 11 of the second embodiment described above;

only the control method of the light source apparatus is different. In view of the above, a description of the configuration of the twenty-first embodiment is omitted and the operation of the display apparatus of the present embodiment, i.e., the method for controlling the light source apparatus of the present embodiment will be described. FIGS. 31A to 31H are timing charts showing the hue correction operation of the light source apparatus according to the present embodiment, wherein time is plotted along the horizontal axis of each chart and wherein FIG. 31A has the electric current that the light source drive circuit has sent to the red element of the RGB-LEDs plotted on the vertical axis, FIG. 31B has the electric current that the light source drive circuit has sent to the green element of the RGB-LEDs plotted on the vertical axis, FIG. 31C has the electric current that the light source drive circuit has sent to the blue element of the RGB-LEDs plotted on the vertical axis, FIG. 31D has the light-emitting intensity of the red element of the RGB-LEDs plotted on the vertical axis, FIG. 31E has the light-emitting intensity of the green element of the RGB-LEDs plotted on the vertical axis, FIG. 31F has the light-emitting intensity of the blue element of the RGB-LEDs plotted on the vertical axis, FIG. 31G has the values of the output results of the light sensor plotted on the vertical axis, and FIG. 31H has the transmittance of the transmissive liquid crystal display panel plotted on the vertical axis.

As shown in FIG. 31, as compared to the second embodiment, the twenty-first embodiment features providing a time period in which the light sources are turned off so that that light sensors can detect outside light, and the transmittance of the display panel is brought to a high level. By so doing, the condition of outside illumination can be detected using the light sensors that detect the conditions of the light sources, and the light source settings can be modified depending on ambient brightness without providing a separate sensor for outside light.

As shown in FIG. 31, up to time t4, the light source calibration operation is the same as in the second embodiment described above. In the present embodiment, at time t4, all of the light-emitting elements making up the light sources are extinguished. Then, in order to bring the display panel to a state of high transmittance, a white image is displayed, for example. Thereupon, outside light is transmitted through the display panel and is propagated through the light guide plate, becoming incident on the light sensors. As a result, the light sensors can detect the quantity of outside light transmitted through the display panel. Operation of the light sources starting at time t5 is corrected to reflect the results of detection of outside light and the results of detection of the conditions of the light sources prior to time t4. Specifically, in the event that the detected result of outside light is a small value, ambient conditions are determined to be low light conditions, and the quantity of light of the light sources is decreased so that the user need not view an excessively bright display screen. On the other hand, in the event that the detected result of outside light is a large value, ambient conditions are determined to be bright, and the quantity of light of the light sources is increased in order to improve visibility to the user.

In the present embodiment, by furnishing a time period for detecting outside light during control of the light sources and the display panel, it is possible to produce a display appropriate for the service environment, without the need to provide a light sensor for sensing conditions of outside light. The present embodiment is particularly effective in the case of portable terminal apparatus, for which the environment is highly likely to vary with the user.

In the present embodiment there was described display of a white image in order to increase the transmittance of the display panel during the time period of detecting outside light. Since the transmittance of a display panel is typically limited, it is preferable to produce a white display over the entire screen in order to increase the quantity of light that is transmitted through the display panel, that is propagated through the light guide plate, and that strikes the light sensors. Also, while the outside light detection operation was described as being carried out after the light source detection operation, the present invention is not limited to this configuration, and it is possible for the light source detection operation to be carried out after the outside light detection operation. In this case, by employing a normally white type of display panel having high transmittance in the off state, the display panel is easily controlled during the outside light detection operation. The operation and effects of the twenty-first embodiment are otherwise the same as the second embodiment.

Figure 32:
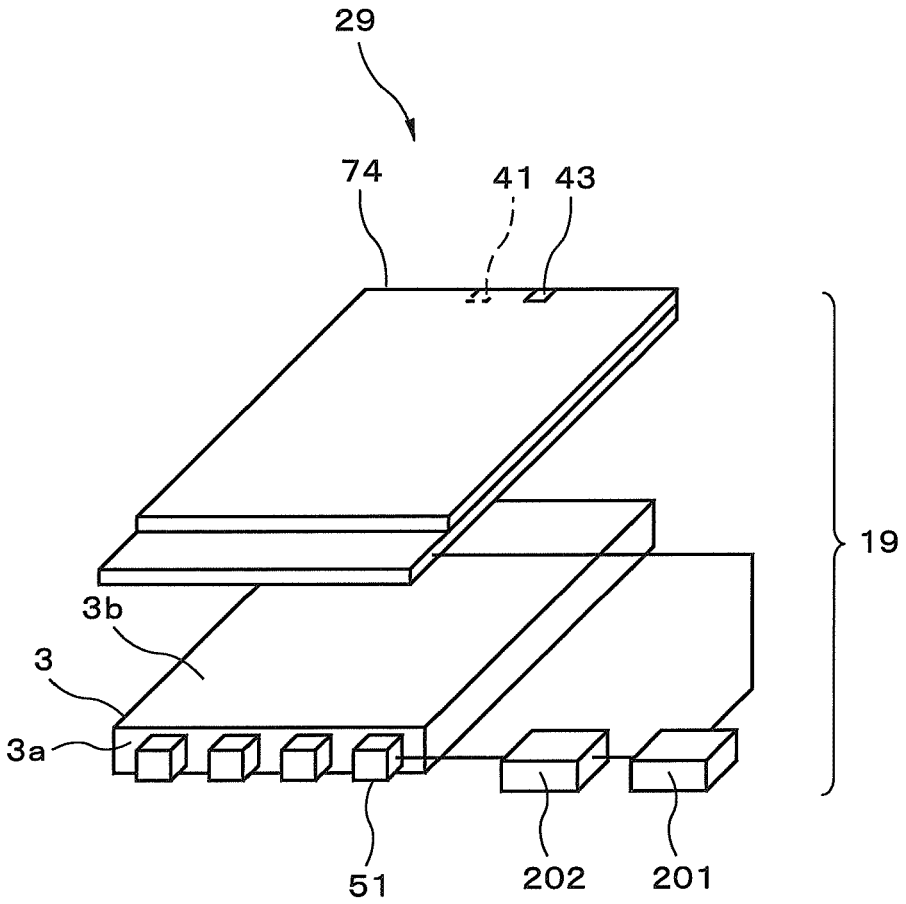
FIG. 32 is a perspective view showing the display apparatus according to the twenty-second embodiment of the present invention.

Next, the twenty-second embodiment of the present invention will be described. FIG. 32 is a perspective view showing the display apparatus according to the present embodiment. As shown in FIG. 32, the configurations of the display apparatus and the light source apparatus of the twenty-second embodiment differ appreciably from the display apparatus 2 and the light source apparatus 1 of the first embodiment described above, in that a light sensor 43 for detecting outside light conditions is provided in addition to the light sensor 41 for detecting the light emission conditions of the light sources. These two types of light sensors 41, 43 are both formed on a transmissive liquid crystal display panel 74, and are formed using thin film transistors on the display panel. The light sensor 41 for the light sources has a light-blocking layer that faces the user. Outside light is blocked thereby, and the light emitted by the light sources can be detected. Since this light source light sensor 41 is not visible from the user side because of the light-blocking layer, in FIG. 32 it is depicted by broken lines. In a typical display panel, the substrate on which the thin film transistors are formed will be disposed towards the light sources, while the other substrate is provided with a light-blocking layer, forming a black matrix for blocking pixel boundary regions. Accordingly, the light-blocking layer for blocking outside light can be formed at the same time as the black matrix, making it possible to reduce the number of processes. The substrate with the light-blocking layer also has a color filter formed thereon for producing color display. Accordingly, by using this color filter, the light sensor 43 for detecting outside light can be composed of three types of sensors, i.e., for red, green, and blue use. It is therefore possible for the light sensor to perform spectral detection of outside light. However, as with the light source light sensor 41, no light-blocking layer is formed on the side of the light sensor 43 lying towards the light sources. Consequently, the outside light sensor 43 is of a construction that is highly affected by light emitted by the light sources. The two types of light sensors 41, 43 are connected to the control circuit 201 by wiring formed on the transmissive liquid crystal display panel 74. The configuration of the present embodiment is otherwise identical to the first embodiment described above.

Next, the operation of the display apparatus of the present embodiment constituted in the above manner, i.e., the method for controlling the light source apparatus of the present embodiment will be described. FIGS. 33A to 33H are timing charts showing the hue correction operation of the light source apparatus according to the present embodiment, wherein time is plotted along the horizontal axis of each chart and wherein FIG. 33A has the electric current that the light source drive circuit has sent to the red element of the RGB-LEDs plotted on the vertical axis, FIG. 33B has the electric current that the light source drive circuit has sent to the green element of the RGB-LEDs plotted on the vertical axis, FIG. 33C has the electric current that the light source drive circuit has sent to the blue element of the RGB-LEDs plotted on the vertical axis, FIG. 33D has the light-emitting intensity of the red element of the RGB-LEDs plotted on the vertical axis, FIG. 33E has the light-emitting intensity of the green element of the RGB-LEDs plotted on the vertical axis, FIG. 33F has the light-emitting intensity of the blue element of the RGB-LEDs plotted on the vertical axis, FIG. 33G has the values of the output results of the light source light sensor plotted on the vertical axis, and FIG. 33H has the output results of the outside light sensor plotted on the vertical axis.

As shown in FIG. 33, in the present embodiment, the control method is based on that described in the eighteenth embodiment of the invention described above. Specifically, there is provided a time period in which all of the light sources are turned off, and during this time period, outside light conditions are detected using the light sensor 43 for outside light. By providing the time period in which all of the light sources are turned off, there is no need to position the light sensor 43 for outside light on the side of a light-blocking layer that faces light sources, making possible simpler construction.

As shown in FIG. 33, at time t0 all of the types of light-emitting elements are simultaneously turned on. The time period from t0 to t1 is a time period used for normal display. Next, a detection operation of the red light-emitting element is carried out in the time period from t1 to t2; similarly a detection operation of the green light-emitting element is carried out in the time period from t2 to t3; and similarly a detection operation of the blue light-emitting element is carried out in the time period from t3 to t4. These detection operations are carried out using the light source light sensor 41, but since the light sensor 41 has a construction that blocks the effects of outside light, the conditions of the light sources can be detected free from the effects of outside light.

Figures 33A, 33B, 33C, 33D, 33E, 33F, 33G, 33H:
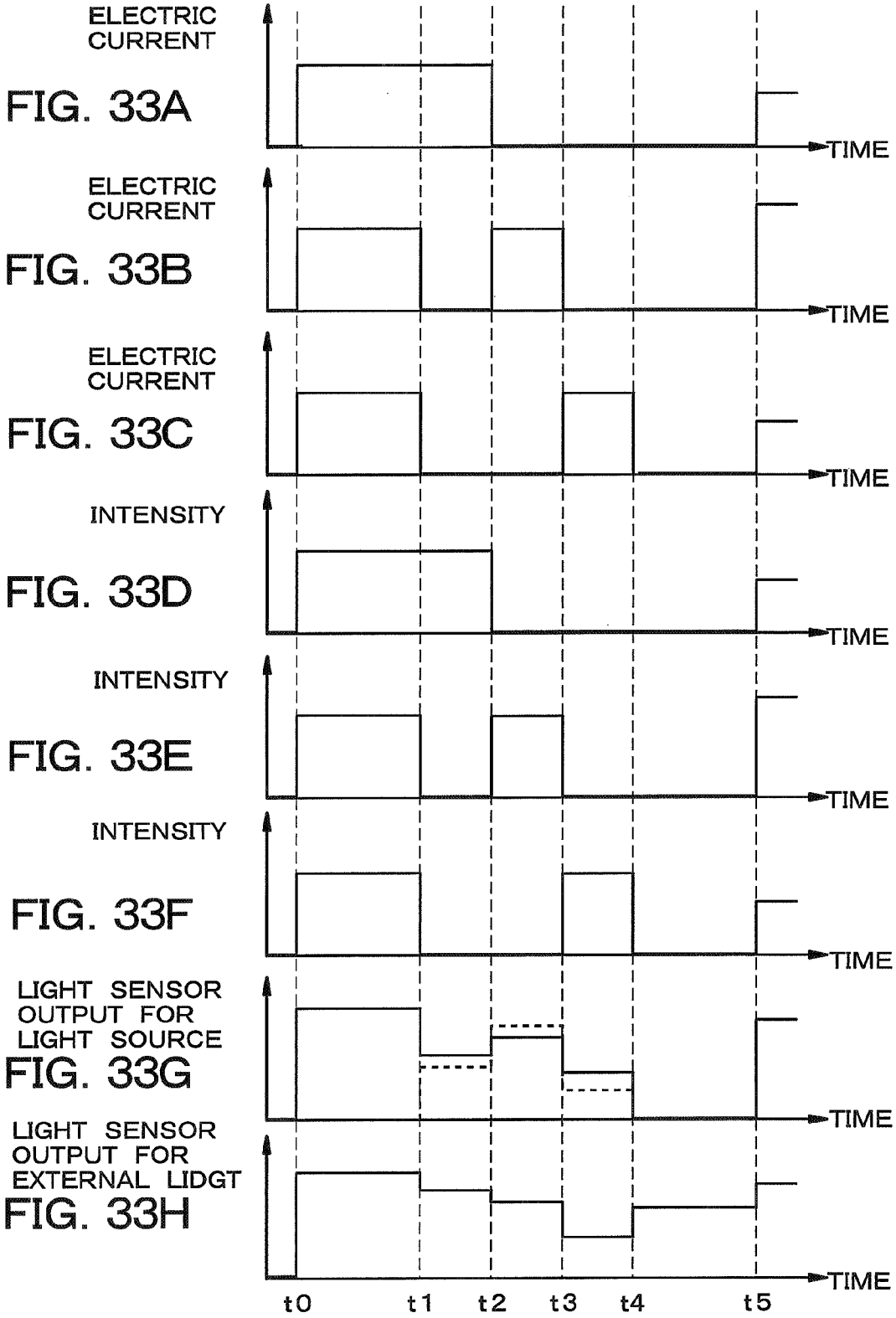
FIGS. 33A through 33G are timing charts showing the hue correction operation of the light source apparatus according to the present embodiment, wherein time is plotted on the horizontal axis of each chart, FIG. 33A has the electric current sent to the red element of the RGB-LEDs by the light source drive circuit plotted on the vertical axis, FIG. 33B has the electric current sent to the green element of the RGB-LEDs by the light source drive circuit plotted on the vertical axis, FIG. 33C has the electric current sent to the blue element of the RGB-LEDs by the light source drive circuit plotted on the vertical axis, FIG. 33D has the light emission intensity of the red element of the RGB-LEDs plotted on the vertical axis, FIG. 33E has the light emission intensity of the green element of the RGB-LEDs plotted on the vertical axis, FIG. 33F has the light emission intensity of the blue element of the RGB-LEDs plotted on the vertical axis, FIG. 33G has values of the output results of the light sensor for the light source plotted on the vertical axis, and FIG. 33H has values of the output results of the light sensor for external light plotted on the vertical axis.

The time period from t4 to t5 is a time period in which all of the light sources are turned off; during this time period, outside light is detected using the outside light sensor 43. An example of the output results of the outside light sensor 43 is shown in FIG. 33H. The drawing depicts the output of the sensor where, of the three types of color sensors constituting the light sensor 43, the red color filter is provided in particular. As mentioned above, since the light sensor 43 lacks a structure for blocking light from the light sources, during the time period from t1 to t4 the sensor will be affected by the light source, but since the light sources are turned off during the time period from t4 to t5, it will be possible to detect purely outside light. In the present embodiment, since green and blue light sensors are furnished in addition to the red light sensor for the purpose of detecting outside light conditions, outside light can be spectrally divided in order to determine hue.

Starting at time t5, correction of the light sources is carried out so as to reflect the results of detecting light source conditions during the time period from t1 to t4, and the results of detecting outside light conditions during the time period from t4 to t5. One possible method for reflecting outside light conditions is to detect outside brightness and, in the event of low light, decrease the quantity of light of the light sources so that the user does not perceive excessive brightness or, in the event of high brightness, increase the quantity of light of the light sources so that the display is sharply visible. In particular, since spectral detection of outside light is possible in the present embodiment, in a warm color environment it would be possible to suppress the blue light-emitting element of the light source in order to give a warmer hue. Since the human eye adjusts to the surrounding environment, for the same given white color, the white color will be perceived as being yellowish if the ambient light is bluish, whereas the white color will be perceived as being bluish if the ambient illumination is yellowish, producing a sense of discomfort. In the present embodiment, since it is possible to adjust color tone depending on the surrounding environment, it is thus possible to reduce discomfort on the part of the user. The operations of time t0 to t5 are executed repeatedly.

Specifically, in the present embodiment, by means of a simple design, correction may be carried out in a manner reflecting the effects of outside light, making it possible to achieve both high capability and low cost.

Furthermore, control with a higher degree of accuracy is possible through adaptation of the outside light condition detection operation during the time period from t4 to t5. Commercial power supplies typically have frequencies on the order of 50 to 60 Hz, and fluorescent lights connected to such commercial power supplies will repeatedly flicker at this frequency. Typically, in most cases the frame frequency of display panels is set to about 60 Hz as well. This is because the limit frequency at which the human eye ceases to perceive flicker of light is close to 60 Hz. Accordingly, in cases in which the operations of the present embodiment are carried out under fluorescent lighting, interference of the two frequencies will create a new problem. For example, completely different detection results will be obtained in cases in which the time period from t4 to t5 coincides with the bright time period of flicker of the fluorescent lighting, as opposed to cases in which the time period coincides with the dark time period. Accordingly, in the present embodiment, fluctuating conditions of outside light are monitored using the outside light sensor, and in the event that periodicity is detected, sensing of the outside light is carried out during times when the brightest results are detected. By so doing, it is possible to reliably ascertain outside lighting conditions. Furthermore, in order to prevent stray light produced by outside lighting from interfering with detection of the light source conditions, calibration of the light sources is carried out at times when the outside lighting is darkest. An even higher level of accuracy is possible thereby. The operation and effects of the twenty-second embodiment are otherwise the same as the eighteenth embodiment.

Figure 34:
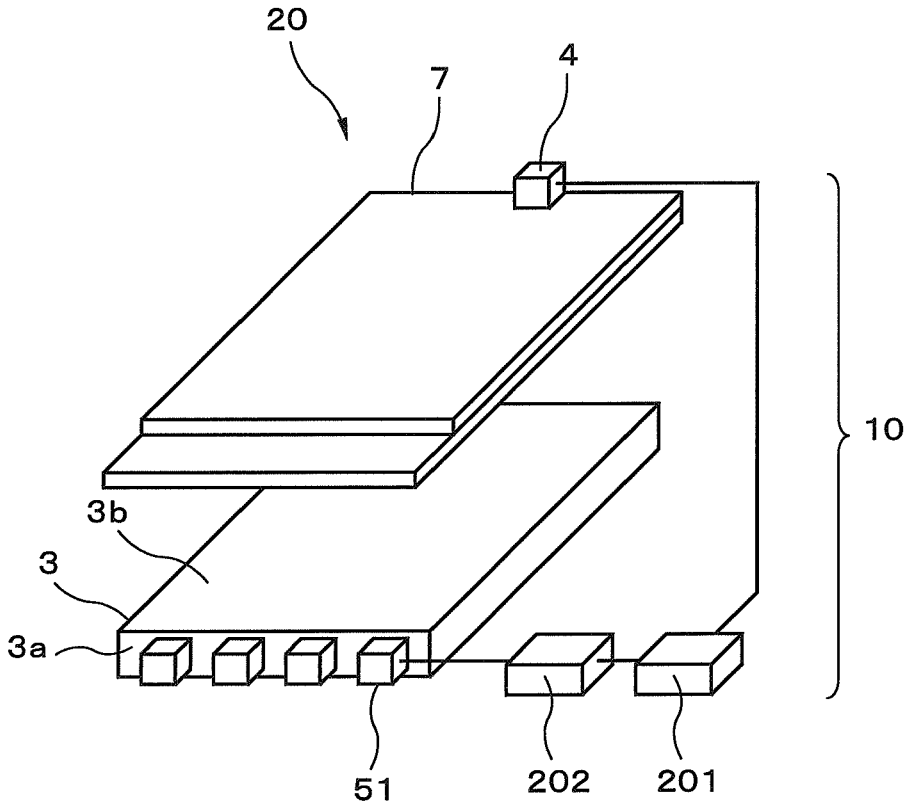
FIG. 34 is a perspective view showing the display apparatus according to the twenty-third embodiment of the present invention.
Figures 35A, 35B, 35C, 35D, 35E, 35F, 35G:
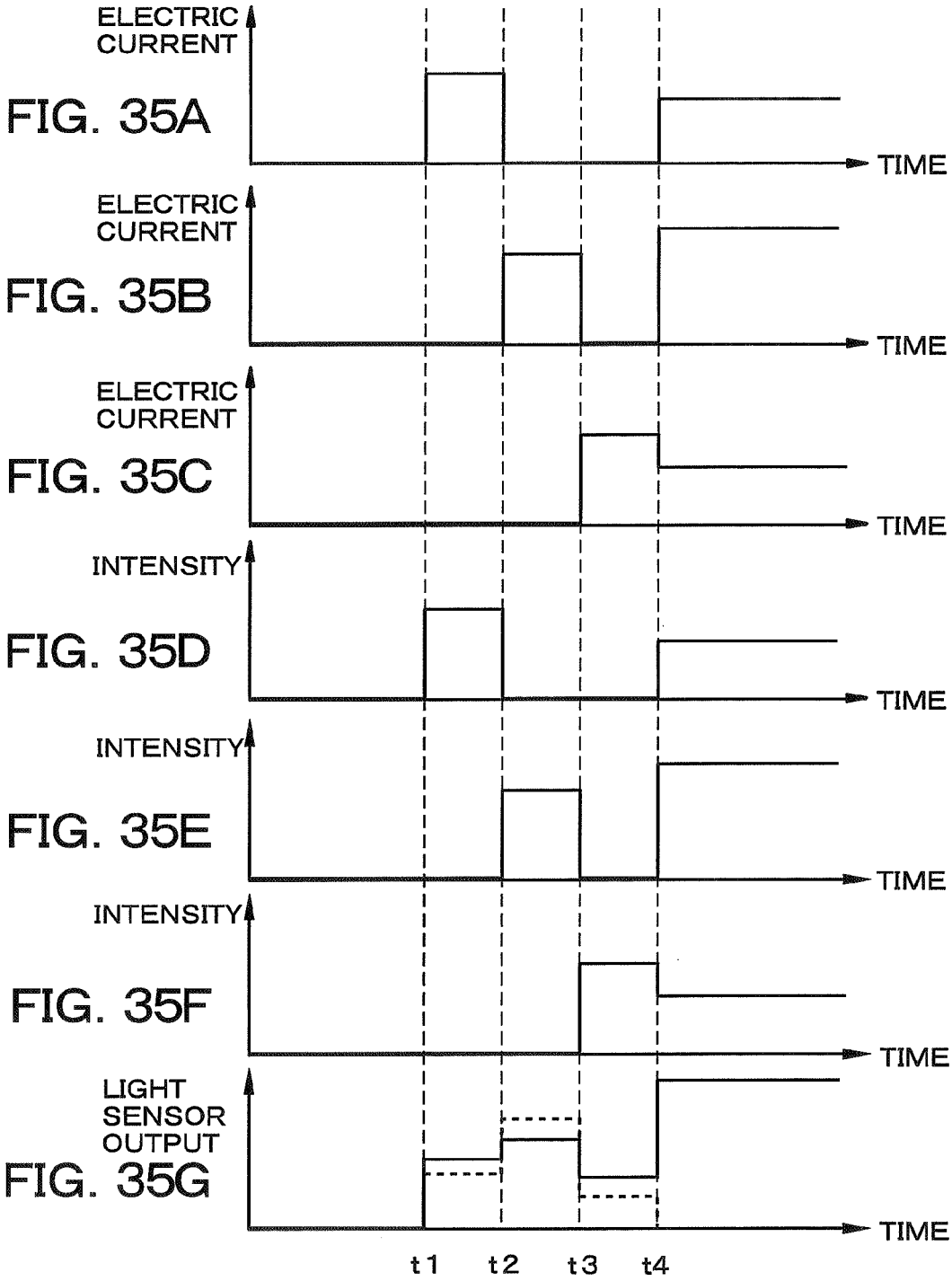
FIGS. 35A through 35G are timing charts showing the hue correction operation of the light source apparatus according to the present embodiment, wherein time is plotted on the horizontal axis of each chart, FIG. 35A has the electric current sent to the red element of the RGB-LEDs by the light source drive circuit plotted on the vertical axis, FIG. 35B has the electric current sent to the green element of the RGB-LEDs by the light source drive circuit plotted on the vertical axis, FIG. 35C has the electric current sent to the blue element of the RGB-LEDs by the light source drive circuit plotted on the vertical axis, FIG. 35D has the light emission intensity of the red element of the RGB-LEDs plotted on the vertical axis, FIG. 35E has the light emission intensity of the green element of the RGB-LEDs plotted on the vertical axis, FIG. 35F has the light emission intensity of the blue element of the RGB-LEDs plotted on the vertical axis, and FIG. 35G has values of the output results of the light sensor plotted on the vertical axis.

Next, the twenty-third embodiment of the present invention will be described. FIG. 34 is a perspective view showing the display apparatus according to the present embodiment.

As shown in FIG. 34, the display apparatus 20 and the light source apparatus 10 of the twenty-third embodiment differ appreciably from the display apparatus 2 and the light source apparatus 1 of the first embodiment described above in that the light sensor 4 is disposed on the side of the display panel that faces the observer, rather than on the side that faces the light source apparatus. Specifically, the design makes it possible for the light sensor 4 to detect light that has been transmitted through the display panel. For this reason, in the present embodiment, it is possible not only to correct change in hue caused by change over time in the light source apparatus such as the light guide plate, but also to correct change in hue caused by change of the display panel over time, or by temperature changes.

Accordingly, the light sensor is designed so that outside light is not incident directly on the sensor. Specifically, the incident-light face of the light sensor is positioned lying towards the display panel. In order to be able to detect light that has been transmitted through the display panel, a light-transmitting hole is disposed in the frame region of the display panel. The hole is designed to enable detection of light transmitted through the principal components of the display panel, i.e. the liquid crystals, the polarization plate, and the like, by means of passing through this hole. In order for this hole to transmit light, it is preferable to use a display panel of normally white type. Since it is acceptable for the hole portion alone to transmit light from the light sources, it is also possible to accomplish this by providing a dedicated electrode pattern in a corresponding area on the display panel, and to conduct operations so as improve transmittance. The configuration of the present embodiment is otherwise identical to the first embodiment described above.

Next, the operation of the display apparatus of the present embodiment constituted in the above manner, i.e., the method for controlling the light source apparatus of the present embodiment will be described. FIGS. 35A to 35G are timing charts showing the hue correction operation of the light source apparatus according to the present embodiment, wherein time is plotted along the horizontal axis of each chart and wherein FIG. 35A has the electric current that the light source drive circuit has sent to the red element of the RGB-LEDs plotted on the vertical axis, FIG. 35B has the electric current that the light source drive circuit has sent to the green element of the RGB-LEDs plotted on the vertical axis, FIG. 35C has the electric current that the light source drive circuit has sent to the blue element of the RGB-LEDs plotted on the vertical axis, FIG. 35D has the light-emitting intensity of the red element of the RGB-LEDs plotted on the vertical axis, FIG. 35E has the light-emitting intensity of the green element of the RGB-LEDs plotted on the vertical axis, FIG. 35F has the light-emitting intensity of the blue element of the RGB-LEDs plotted on the vertical axis, and FIG. 35G has the values of the output results of the light sensor plotted on the vertical axis.

As shown in FIG. 35, in this twenty-third embodiment, the calibration operation is substantially similar to that of the first embodiment described above. In particular, since change in the display panel is superimposed on the output results of the optical sensor, the light sources are controlled on the basis of these output results.

In the present embodiment, it is possible to detect and correct changes in the hue of the display due to changes in the display panel, and light similar to that noticed by the user can be detected with a simpler design. The operation and effects of the twenty-third embodiment are otherwise the same as the first embodiment.

Figure 36:
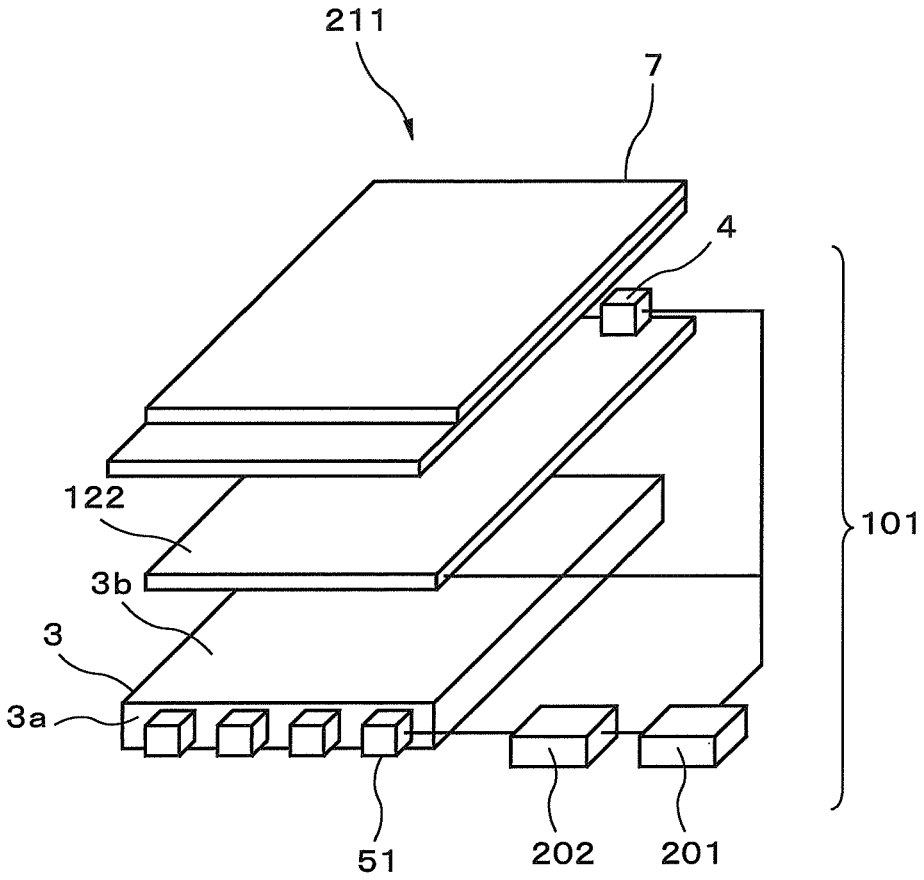
FIG. 36 is a perspective view showing the display apparatus according to the twenty-fourth embodiment of the present invention.
Figure 37:
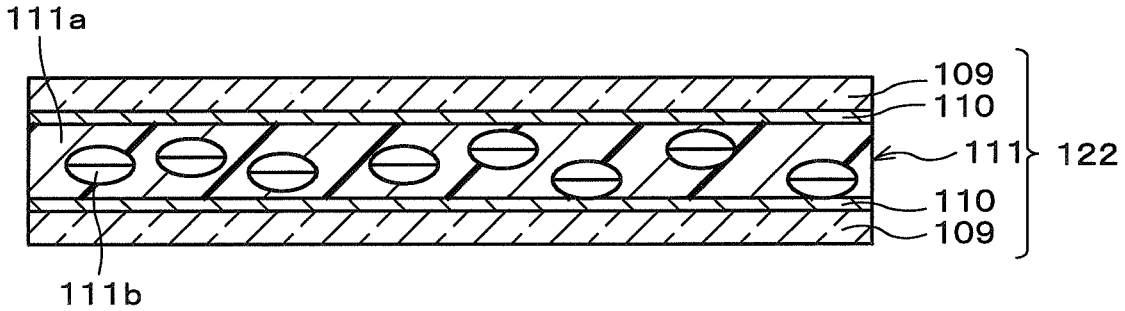
FIG. 37 is a cross-sectional view showing a transparent/scattering switching element, which is a constituent element of the display apparatus in the present embodiment.

Next, the twenty-fourth embodiment of the present invention will be described. FIG. 36 is a perspective view showing the display apparatus according to the present embodiment; FIG. 37 is a cross-sectional view showing a transparent/scattering switching element which is a constituent element of the display apparatus. As shown in FIG. 36, the display apparatus 211 and the light source apparatus 101 according to the twenty-fourth embodiment differ from the display apparatus 2 and the light source apparatus 1 according to the first embodiment described above in that a transparent/scattering switching element 122 is provided as a constituent element. During the time that light entering from the light guide plate 3 exits on the opposite side thereof, the transparent/scattering switching element 122 switches between a state of scattering the light and a state of transmitting the light without scattering. The light output surface 3*b* of the light guide plate 3 is provided with a hologram pattern for the purpose of increasing directivity of output light in the normal direction. As a result, light having high directivity in the normal direction of the light output surface 3*b* is outputted from the light guide plate 3. Specifically, the light source apparatus in the present embodiment is designed so that, using the scattering switching function of the transparent/scattering switching element, light of high directivity outputted from the light guide plate is outputted in such a manner that the angular range of light outputted from the light source apparatus is variable. Also, through the use of this light source apparatus, the display apparatus has a visible angular range that is variable. The control circuit 201 has the function of driving and controlling the transparent/scattering switching element 122. The light sensor 4 is disposed on the side of the transparent/scattering switching element 122 that faces the display panel, and detects light transmitted through the transparent/scattering switching element 122.

FIG. 37 is a cross-sectional view showing the transparent/scattering switching element 122 disposed on the light guide plate 3 on the light output surface thereof. In the transparent/scattering switching element 122, a pair of transparent substrates 109 are arranged parallel to one another, with the opposing faces of the pair of transparent substrates 109 each having an electrode 110 disposed thereon so as to cover the surface of the transparent substrate 109. A PDLC (Polymer Dispersed Liquid Crystal) layer 111 is interposed between the pair of transparent substrates 109, i.e., between the electrodes 110.

The PDLC layer 111 contains liquid crystal molecules 111*b* dispersed through a polymer matrix 111*a*. The PDLC layer 111 is formed, for example, by exposing and curing a mixture of a liquid crystal material and a photocuring resin.

In the transparent/scattering switching element 122, the orientation of the liquid crystal molecules 111*b* within the PDLC layer 111 changes through the application of electrical voltage to the PDLC layer 111 by the pair of electrodes 110. For example, when no electric field is applied to the PDLC layer, the apparent refractive indices of the polymer matrix and the liquid crystal molecules will differ, whereby input light is scattered and outputted in scattered condition. On the other hand, when an electric field is applied to the PDLC layer, the apparent refractive indices of the polymer matrix and the liquid crystal molecules substantially coincide, and the layer assumes a transparent condition in which input light is outputted without scattering. In this way, the transparent/scattering switching element 122 scatters or transmits input light and outputs it to the display panel. The configuration of the present embodiment is otherwise identical to the first embodiment described above.

Figures 38A, 38B, 38C, 38D, 38E, 38F, 38G, 38H:
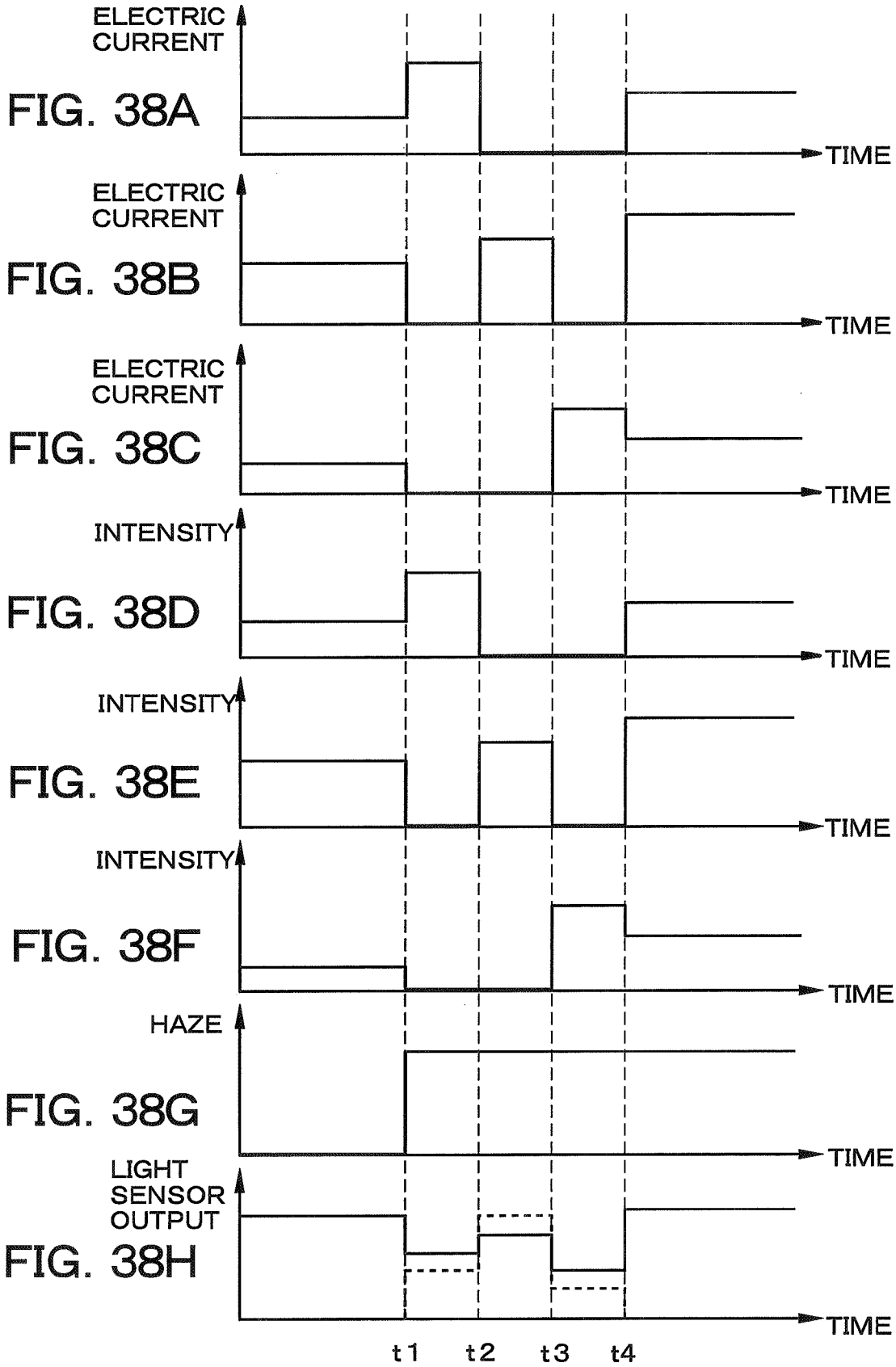
FIGS. 38A through 38H are timing charts showing the hue correction operation of the light source apparatus according to the present embodiment, wherein time is plotted on the horizontal axis of each chart, FIG. 38A has the electric current sent to the red element of the RGB-LEDs by the light source drive circuit plotted on the vertical axis, FIG. 38B has the electric current sent to the green element of the RGB-LEDs by the light source drive circuit plotted on the vertical axis, FIG. 38C has the electric current sent to the blue element of the RGB-LEDs by the light source drive circuit plotted on the vertical axis, FIG. 38D has the light emission intensity of the red element of the RGB-LEDs plotted on the vertical axis, FIG. 38E has the light emission intensity of the green element of the RGB-LEDs plotted on the vertical axis, FIG. 38F has the light emission intensity of the blue element of the RGB-LEDs plotted on the vertical axis, FIG. 38G has the haze values of the transparent/scattering switching element plotted on the vertical axis, and FIG. 38H has values of the output results of the light sensor plotted on the vertical axis.

Next, the operation of the display apparatus of the present embodiment constituted as described above, i.e., the method for controlling the light source apparatus of the present embodiment, will be described. FIGS. 38A to 38H are timing charts showing the hue correction operation of the light source apparatus according to the present embodiment, wherein time is plotted along the horizontal axis of each chart and wherein FIG. 38A has the electric current that the light source drive circuit has sent to the red element of the RGB-LEDs plotted on the vertical axis, FIG. 38B has the electric current that the light source drive circuit has sent to the green element of the RGB-LEDs plotted on the vertical axis, FIG. 38C has the electric current that the light source drive circuit has sent to the blue element of the RGB-LEDs plotted on the vertical axis, FIG. 38D has the light-emitting intensity of the red element of the RGB-LEDs plotted on the vertical axis, FIG. 38E has the light-emitting intensity of the green element of the RGB-LEDs plotted on the vertical axis, FIG. 38F has the light-emitting intensity of the blue element of the RGB-LEDs plotted on the vertical axis, FIG. 38G plots the haze value of the transparent/scattering switching element, and FIG. 38H has the values of the output results of the light sensor plotted on the vertical axis; in particular, an instance of switching from a narrow viewing angle condition to a wide viewing angle condition is shown.

The method of controlling the light source apparatus will now be described. This will be preceded by a description of the operation of the light source apparatus, i.e., the operation that provides a variable angular range for light outputted from the light source apparatus. First, a case of narrow angular range illumination will be discussed. High-directivity light outputted from the light guide plate 3 is inputted to the transparent/scattering switching element 122. At this time, since the transparent/scattering switching element 122 is in the transparent condition through application of voltage, the high-directivity light is transmitted directly without being scattered by the transparent/scattering switching element 122. That is, the light is outputted from the transparent/scattering switching element 122 while maintaining high directivity. The light having a high-directivity distribution is inputted to the display panel 7, an image is added, and the light is outputted with its high directivity unchanged. As a result, the display apparatus is only visible over a narrow angular range, and images are displayed in narrow viewing angle conditions.

Next, a case of wide angular range illumination will be discussed. High-directivity light outputted from the light guide plate 3 is inputted to the transparent/scattering switching element 122. At this time, since the transparent/scattering switching element 122 is in the scattering condition in the absence of applied voltage, the high-directivity light is scattered uniformly by the transparent/scattering switching element 122, becoming distributed over a wide angular range. That is, the light is scattered by the transparent/scattering switching element 122 and decreases in directivity, becoming wide-angle light. The widely distributed light is inputted to the display panel 7, an image is added, and the wide-angle light is outputted as-is. As a result, the display apparatus is visible over a wide angular range, and images are displayed in wide viewing angle conditions.

Typically, in an element that has a micro structure such as a PDLC layer and that scatters light by means of the refractive index distribution of the micro structure, the extent of scattering of light will be dependent upon the wavelength of the light, with light of shorter wavelengths being scattered more intensely, and light of longer wavelengths being scattered with more difficultly. Specifically, in the event that the transparent/scattering switching element is in the scattering condition, blue light will be scattered easily while red light will be scattered with difficulty, so the light outputted from the transparent/scattering switching element will have a lower proportion of blue and will take on a yellowish tinge. In this way, the hue of the light outputted from the transparent/scattering switching element is dependent on the degree of transparency.

In the event that the degree of transparency of the transparent/scattering switching element has been switched, it will be necessary to adjust the quantity of light of the light sources as well. This is because, in a wide viewing angle condition, it is necessary for the high-directivity light outputted from the light guide plate to be scattered in various directions. Specifically, if the quantity of light of the light sources is the same both in the narrow viewing angle condition and the wide viewing angle condition, frontal luminance in the wide viewing angle condition will be lower than that in the narrow viewing angle condition. Meanwhile, for the main user disposed in the frontal direction, it is preferable that luminance not change between narrow viewing angle display and wide viewing angle display. Accordingly, in order to avoid a decline in frontal luminance during switching from narrow viewing angle display to wide viewing angle display, it is necessary to increase the quantity of light of the light sources so that frontal luminance is undiminished.

Also, when switching from wide viewing angle display to narrow viewing angle display, the quantity of light of the light sources is decreased in order to avoid appreciable increase of frontal luminance. In this way, switching between narrow viewing angle display and wide viewing angle display requires not only switching of the transparent/scattering switching element between the transparent and scattering conditions, but also simultaneous switching of the quantity of emitted light by the light sources. However, when the quantity of emitted light by the light sources is switched, the characteristics of the light sources vary, and the hue of the light emitted by the light sources also changes.

In this way, when switching between the narrow viewing angle condition and the wide viewing angle condition, the spectrum of the light transmitted through the transparent/scattering switching element varies, and the spectrum of the light emitted by the light sources also varies. Accordingly, in the present embodiment, it is important to control the light source apparatus according to the present embodiment.

As shown in FIG. 38, prior to time t1, a narrow viewing angle condition is maintained and the transparent/scattering switching element has a low haze value. That is, the transparent/scattering switching element is in the transparent condition. At this time, the light-emitting elements that make up the light sources emit light in a prescribed condition. When the narrow viewing angle condition is subsequently switched to the wide viewing angle condition at time t1, drive conditions are modified so that the transparent/scattering switching element now exhibits a high haze value and assumes the scattering condition. The detection operation of the light-emitting elements of each color is carried out thereafter. Since the light sensor is positioned on the light output surface of the transparent/scattering switching element, utilizing the time-divided detection method of the present invention will make it possible to also detect spectral variation caused by change in haze and the like. The specific detection operation, i.e. the detection operation during the time period from t1 to t4, is similar to that of the first embodiment described above and will be omitted here. Starting at time t4, application of the detection results makes it possible to establish a wide viewing angle condition for which a hue correction has been carried out. Similar implementation can be made when switching from the wide viewing angle condition to the narrow viewing angle condition as well.

In the present embodiment, it is possible to produce a display apparatus with a switchable viewing angle by using a transparent/scattering switching element having a switchable degree of scattering to obtain a combination with a light source apparatus or display panel having a switchable illumination angle range. By carrying out the calibration operation of the light source apparatus in synchrony with switching of the transparent/scattering switching element, it is possible to detect and correct the hue of the display during switching of the viewing angle range.

In the present embodiment, a case where light-emitting elements of the three colors red, blue, and green has been described. However, the present invention is not limited to this configuration, and can instead use a combination of a white BY-LED and the blue BY-LED of the tenth embodiment.

The transparent/scattering switching element used in the present invention is not limited to one having a PDLC layer, and it is possible to use any element capable of switching between the transparent condition and the scattering condition. Examples include an element employing polymer network liquid crystals (PNLC), and an element employing dynamic scattering (DS). Also, it is possible to use as the PDLC layer described above a layer that assumes the scattering condition in the absence of applied voltage, and assumes the transparent state when voltage is applied. By so doing, the transparent/scattering switching element will not consume power while in the condition of scattering input light, and thus a corresponding amount of power is allocated to the backlight light sources, making it easy to improve brightness of the light source apparatus when in the scattering condition. However, it is also acceptable to use a PDLC layer that assumes the transparent condition in the absence of applied voltage, and assumes the scattering state when voltage is applied. Such a PDLC layer can be fabricated by curing through exposure to light while applying voltage. In portable information terminals, this eliminates the need to apply voltage to the PDLC layer in the frequently used narrow viewing display mode so that power consumption can be suppressed. Cholesteric liquid crystals, ferroelectric liquid crystals, or the like can be used as the liquid crystal molecules of the PDLC layer. These liquid crystals have memory, i.e., even after applied current has been turned off, the crystals continue to maintain the orientation produced through the application of the current. It is possible to reduce power consumption through the use of such a PDLC layer.

Although various types of transparent/scattering switching elements are used, switching of the light sources typically is carried out at higher speed. It is therefore preferable for the calibration operation in association with switching the viewing angle condition to be carried out after the transparent/scattering switching element has been switched, making more accurate calibration possible.

Furthermore, the calibration operation of the present invention is implemented for the purpose of suppressing the phenomenon of change of hue during control of the viewing angle by means of the transparent/scattering switching element, but the invention is not limited to this embodiment.

As disclosed in the fourth embodiment described above, the light sensors in the present embodiment may be constituted using thin film transistors formed on the display panel. Since the display panel is positioned directly above the transparent/scattering switching element, this design can be implemented advantageously and will make possible reduced thickness and lower cost through a reduced number of parts. In this case, it is preferable for a light-blocking layer to be formed on the observer side of the light sensor in order to prevent outside light from being inputted to the light sensor. Particularly in the case where the light sensor has been formed in a frame portion of the display panel, this can be accomplished by forming the light sensor on the substrate that, of the two substrates making up the display panel, lies towards the light sources, and forming the light-blocking layer on the substrate that lies towards the observer. The light-blocking layer formed on the substrate lying towards the observer can be formed simultaneously with the black matrix that blocks the pixel boundary regions, making an additional process unnecessary.

The present embodiment may also be provided with a beam direction regulating element for further enhancing the directivity of light inputted to the display panel. This approach can be adopted in cases in which the transparent/scattering switching element is in the transparent condition. An example of such a beam direction regulating element is a louver composed of transparent regions that transmit light, as well as absorbent regions that absorb light, positioned in an alternating fashion in a direction parallel to the surface. For example, by placing this louver on the light output surface of the light guide plate, light advancing in the wide angle direction can be reduced further, leakage of light in the diagonal direction can thus be suppressed during narrow viewing angle display, and the effect of preventing surreptitious viewing by others can be enhanced. Additionally, by positioning the light sensor so as to detect light transmitted through the louver, it is possible to correct change in hue caused by change over time of the louver as well. The operation and effects of the twenty-fourth embodiment are otherwise the same as the first embodiment.

Figure 39:
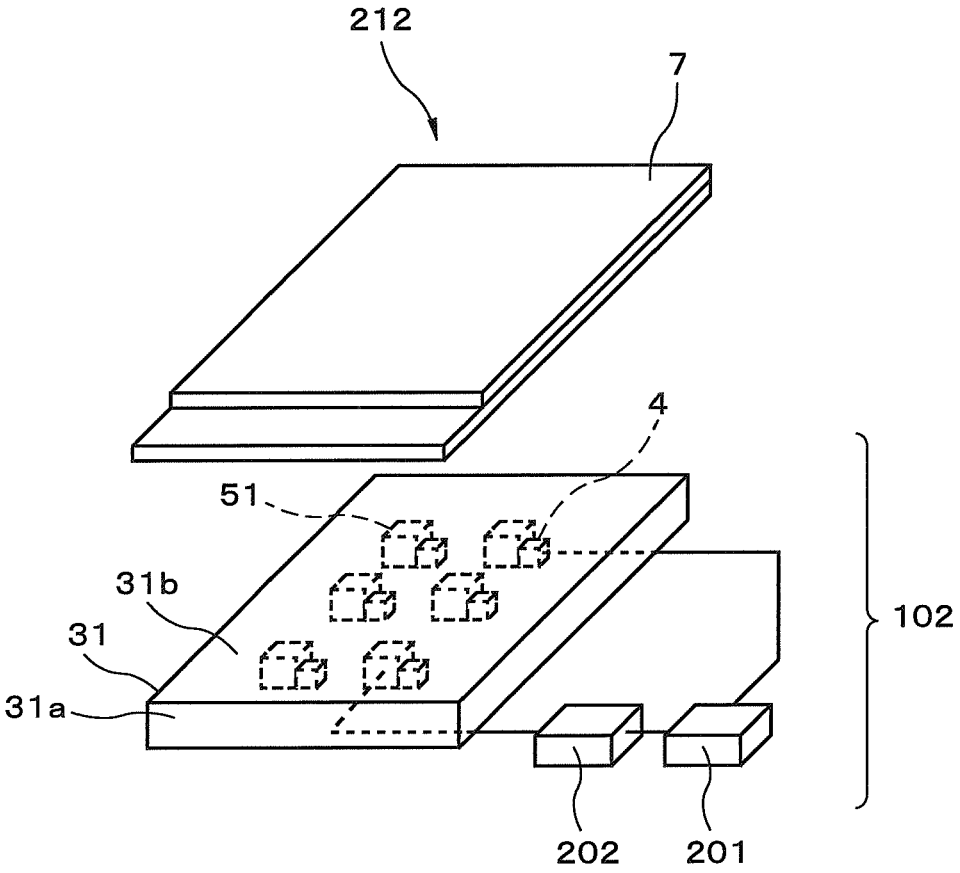
FIG. 39 is a perspective view showing the display apparatus according to the twenty-fifth embodiment of the present invention.
Figure 40:
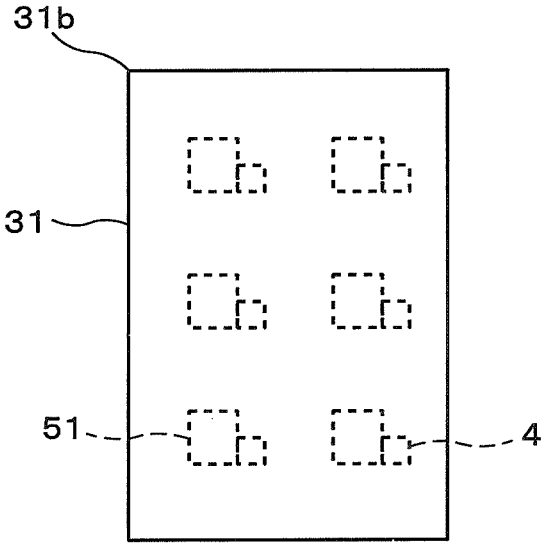
FIG. 40 is a top view showing the placement of the light source, the light sensor, and the diffusion plate, which are constituent elements of the display apparatus in the present embodiment.

Next, the twenty-fifth embodiment of the present invention will be described. FIG. 39 is a perspective view showing the display apparatus according to the present embodiment, and FIG. 40 is a top view showing the placement of the light sources, the light sensors, and the diffusion plate which are constituent elements of the display apparatus. As shown in FIG. 39, the configurations of the display apparatus 212 and the light source apparatus 102 of the twenty-fifth embodiment differ appreciably from the display apparatus 2 and the light source apparatus 1 of the first embodiment described above, in that light sources of directly-below type are used. Specifically, in the first embodiment described above, no light sources were positioned on the back surface of the display area of the display panel, whereas in the present embodiment light sources are positioned on the back surface of the display area. Thus, the diffusion plate 31 is used in place of the light guide plate 3. The diffusion plate 31 has the action whereby light emitted by the light sources 51 disposed on the back surface is rendered uniform within the display surface. Light sensors 4 are positioned adjacently to the light sources 51. The light sources 51 and the light sensors 4 are arranged in sets of one each. In each set, the light sensor can detect mainly the condition of the light source with which the sensor is paired. This is because some of the beams outputted from the light source are reflected by the diffusion plate and inputted to the light sensor making up the pair. The light sources are top-view type RGB-LEDs composed of light-emitting elements of the three colors red, green, and blue.

FIG. 40 is a top view, i.e., the view apparent to the observer, showing the placement of the light sources, the light sensors, and the diffusion plate which are constituent elements of the display apparatus. As shown in FIG. 40, a total of six sets, namely, two in the horizontal and three in the vertical direction, each composed of a light source 51 and a light sensors 4, are disposed in a matrix arrangement. In the present embodiment, the set located at upper left is defined as being located at row 1, column 1; and the set located at lower right is defined as being located at row 3, column 2. The arrangement is such that scanning is possible through the first row, second row, and third row in that order. The light source and light sensor sets of each row are designed to operate similar to those of the eighteenth embodiment described earlier. The configuration of the present embodiment is otherwise identical to the first embodiment described above.

Figures 41A, 41B, 41C:
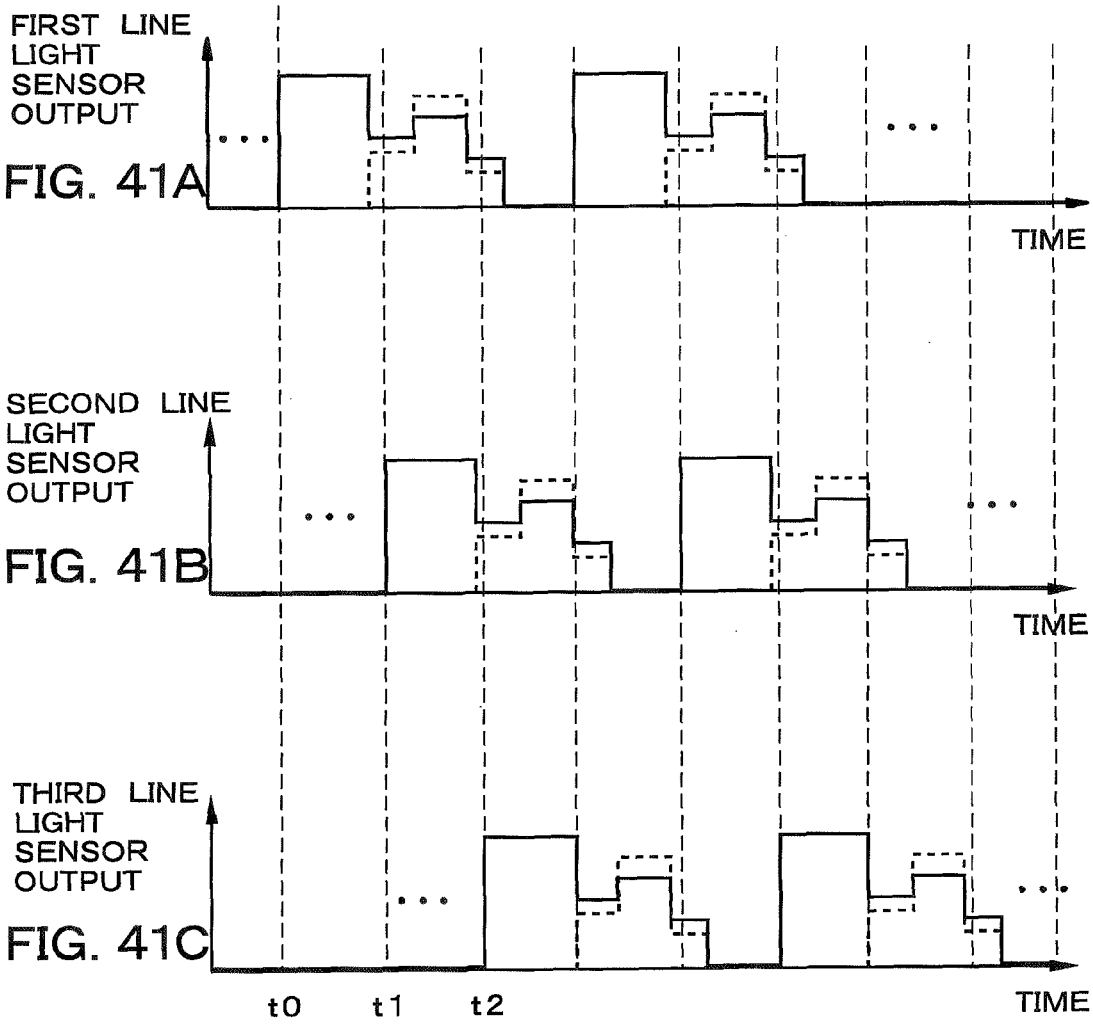
FIGS. 41A through 41C are timing charts showing the hue correction operation of the light source apparatus according to the present embodiment, wherein time is plotted on the horizontal axis of each chart, FIG. 41A has values of the output results of the light sensor in the first column/first row plotted on the vertical axis, FIG. 41B has values of the output results of the light sensor in the second column and first row plotted on the vertical axis, and FIG. 41C has values of the output results of the light sensor in the third column/first row plotted on the vertical axis.

Next, the operation of the display apparatus of the present embodiment described above, i.e., the method for controlling the light source apparatus of the present embodiment will be described. FIGS. 41A to 41C are timing charts showing the hue correction operation of the light source apparatus according to the present embodiment, wherein time is plotted along the horizontal axis of each chart and wherein FIG. 41A has the output values of the light sensor located at row 1, column 1 plotted on the vertical axis, FIG. 41B has the output values of the light sensor located at row 2, column 1 plotted on the vertical axis, and FIG. 41C has the output values of the light sensor located at row 3, column 1 plotted on the vertical axis.

As shown in FIG. 41, the light source/light sensor sets of each row carry out detection and correction operations in the same manner as those of the eighteenth embodiment described earlier. Each row operates at a lag equivalent to ⅓ cycle of the detection operation. Specifically, once the sets of the first row turn on at time t0, the sets of the second row will turn on at time t1 after a lag of ⅓ cycle. Then, the sets of the third row will turn on at time t2 after a lag of ⅓ cycle. In this way, the calibration operation is performed independently for each row. Scanning of the light sources is driven so as to be synchronized at prescribed timing with scanning of the horizontal direction of the display panel.

In the present embodiment, using light sensors and light sources of directly-below type makes it possible to scan the light sources and to improve picture quality to a greater extent than with the eighteenth embodiment described earlier. This is because partial turning off, as practiced in the present embodiment, is less noticeable to the user as screen flicker than is the method of turning off the entire screen all at once. On the other hand, since black conditions are introduced, there is no loss of motion display capability. Moreover, directly-below light sources of high output type can be used, and higher luminance of the display screen is therefore possible. The operation and effects of the twenty-fifth embodiment are otherwise the same as the first embodiment described above.

While the embodiments described hereinabove each may be implemented independently, they may also be implemented in suitable combinations. Specifically, the essence of each embodiment may be extracted and combined in suitable fashion, or a multiplicity of the calibration methods disclosed in the embodiments may be installed and switched according to conditions.

The present invention can be utilized advantageously, e.g., as display devices in mobile telephones, PDAs, gaming devices, digital cameras, video cameras, video players, and other mobile terminal apparatuses; or as display devices in terminal apparatuses such as notebook-type personal computers, cash dispensers, and vending machines.

What is claimed is:

1. A light source apparatus comprising:

two or more light sources that have different light-emission spectra and that can be controlled independently;

a transparent/scattering switching element that is switchable between a state of transmitting light emitted from each of the two or more light sources and a state of scattering light emitted from each of the two or more light sources;

a light sensor that has a light-receiving wavelength range that corresponds to a light-emitting wavelength range of each of the two or more light sources and senses, in a time sequential fashion, a quantity of light emitted by each of the two or more light sources and passed through the transparent/scattering switching element; and a controller that controls each of the two or more light sources based on sensing results outputted from the light sensor, wherein the controller controls each of the two or more light sources to emit a predetermined quantity of light in a time sequential fashion in response to an action that a state of the transparent/scattering switching element is switched, obtains chronological sensing results outputted from the light sensor in accordance with the control in a time sequential fashion, and thereafter controls the quantity of light emitted by each of the two or more light sources based on the obtained chronological sensing results.

2. The light source apparatus according to claim 1, wherein a time period in which the control in a time sequential fashion is used to detect and control the quantity of light emitted by each of the two or more light sources is separate from a time period in which the light emitted by each of the two or more light sources is used as illumination means.

3. The light source apparatus according to claim 2, wherein a time period in which the two or more light sources simultaneously emit light is included in the time period for detecting and controlling the quantity of light emitted by each of the two or more light sources by using the control in a time sequential fashion.

4. The light source apparatus according to claim 2, wherein a time period for reducing the light quantity of each of the two or more light sources is included between the time period for detecting and controlling the quantity of light emitted by each of the two or more light sources by using the control in a time sequential fashion, and the time period in which the light emitted by each of the two or more light sources is used as illumination means.

5. The light source apparatus according to claim 2, wherein the time period for detecting and controlling the quantity of light emitted by each of the two or more light sources by using the control in a time sequential fashion is started by an external signal inputted to the controller.

6. A display apparatus comprising:

the light source apparatus according to claim 5; and a transmissive display panel for transmitting light emitted from the light source apparatus and thereby adding an image to the light.

7. The display apparatus according to claim 6, wherein a transmittance of the transmissive display panel is reduced at least in the time period for detecting and controlling the quantity of light emitted by each of the two or more light sources by using the control in a time sequential fashion.

8. A terminal apparatus comprising the display apparatus according to claim 6, wherein:

an instruction is sent to the controller in accordance with the external signal when a display of the display apparatus is changed; and the quantity of light emitted by each of the two or more light sources is detected and controlled by using the control in a time sequential fashion based on this instruction.

9. The light source apparatus according to claim 1, further comprising:

a unit for detecting external light, wherein the controller uses detection results obtained by the unit for detecting external light to control the quantity of light emitted by each of the two or more light sources.

10. A display apparatus comprising:

the light source apparatus according to claim 1; and a transmissive display panel for transmitting light emitted from the light source apparatus and thereby adding an image to the light.

11. The display apparatus according to claim 10, wherein the transmissive display panel is a display panel in field sequential mode.

12. A terminal apparatus, comprising the display apparatus according to claim 10.

13. The terminal apparatus according to claim 12, wherein the terminal apparatus is a portable phone, a personal information terminal, a game console, a digital camera, a video camera, a video player, a notebook personal computer, a cash dispenser, or a vending machine.

14. The light source apparatus according to claim 1, further comprising a light guide plate having a rectangular shape, the light guide plate receiving light on a first end surface thereof, propagating the light therethrough, and emitting the light from a main surface thereof, wherein:

the two or more light sources are located on the first end surface of the light guide plate, and the transparent/scattering switching element is switchable between states of transmitting and scattering light that is emitted by at least one of the two or more light sources, propagated through the light guide plate, and emitted from the main surface of the light guide plate.

15. The light source apparatus according to claim 14, wherein the light sensor is located on a light emitting surface side of the transparent/scattering switching element.

16. A control method for a light source apparatus comprising two or more light sources that have different light-emission spectra and that can be controlled independently, a transparent/scattering switching element that is switchable between a state of transmitting light emitted from each of the two or more light sources and a state of scattering light emitted from each of the two or more light sources, a light detector that has a light-receiving wavelength range that corresponds to a light-emitting wavelength range of each of the two or more light sources and detects, in a time sequential fashion, a quantity of light emitted by each of the two or more light sources and passed through the transparent/scattering switching element, and a controller that controls each of the two or more light sources based on detection results outputted from the light detector, wherein the controller controls each of the two or more light sources to emit a predetermined quantity of light in a time sequential fashion in response to an action that a state of the transparent/scattering switching element is switched, obtains chronological detection results outputted from the light detector in accordance with the control in a time sequential fashion, and thereafter controls the quantity of light emitted by each of the two or more light sources based on the obtained chronological detection results.

17. A control method for a display apparatus comprising two or more light sources that have different light-emission spectra and that can be controlled independently, a transparent/scattering switching element that is switchable between a state of transmitting light emitted from each of the two or more light sources and a state of scattering light emitted from each of the two or more light sources, alight detector that has a light-receiving wavelength range that corresponds to a light-emitting wavelength range of each of the two or more light sources and detects, in a time sequential fashion, a quantity of light emitted by each of the two or more light sources and passed through the transparent/scattering switching element, a controller that controls each of the two or more light sources based on detection results outputted from the lightdetector, and a transmissive display panel for transmitting light emitted from each of the two or more light sources and thereby adding an image to the light, wherein the controller controls each of the two or more light sources to emit a predetermined quantity of light in a time sequential fashion in response to an action that a state of the transparent/scattering switching element is switched, obtains chronological detection results outputted from the light detector in accordance with the control in a time sequential fashion, and reduces a transmittance of the transmissive display panel in a time period of obtaining the chronological detection results outputted by the light detector in accordance with the control in a time sequential fashion.

* * * * *